US008627901B1

(12) United States Patent
Underwood et al.

(10) Patent No.: US 8,627,901 B1
(45) Date of Patent: Jan. 14, 2014

(54) LASER BOTTOM HOLE ASSEMBLY

(75) Inventors: Lance D. Underwood, Morrison, CO (US); Ryan J. Norton, Lone Tree, CO (US); Ryan P. McKay, Littleton, CO (US); David R. Mesnard, Boulder, CO (US); Jason D. Fraze, Littleton, CO (US); Mark S. Zediker, Castle Rock, CO (US); Brian O. Faircloth, Evergreen, CO (US)

(73) Assignee: Foro Energy, Inc., Littleton, CO (US)

( * ) Notice: Subject to any disclaimer, the term of this patent is extended or adjusted under 35 U.S.C. 154(b) by 428 days.

(21) Appl. No.: 12/896,021

(22) Filed: Oct. 1, 2010

Related U.S. Application Data

(60) Provisional application No. 61/247,796, filed on Oct. 1, 2009.

(51) Int. Cl.
*E21B 7/15* (2006.01)

(52) U.S. Cl.
USPC ..... 175/16; 175/107; 175/11

(58) Field of Classification Search
USPC ..... 175/11, 15, 16, 107
See application file for complete search history.

(56) References Cited

U.S. PATENT DOCUMENTS

| | | | |
|---|---|---|---|
| 914,636 | A | 3/1909 | Case |
| 2,548,463 | A | 4/1951 | Blood |
| 2,742,555 | A | 4/1956 | Murray |
| 3,122,212 | A | 2/1964 | Karlovitz |
| 3,383,491 | A | 5/1968 | Muncheryan |
| 3,461,964 | A | 8/1969 | Venghiattis |
| 3,493,060 | A | 2/1970 | Van Dyk |
| 3,503,804 | A | 3/1970 | Schneider et al. |
| 3,539,221 | A | 11/1970 | Gladstone |
| 3,544,165 | A | 12/1970 | Snedden |
| 3,556,600 | A | 1/1971 | Shoupp et al. |
| 3,574,357 | A | 4/1971 | Alexandru et al. |
| 3,586,413 | A | 6/1971 | Adams |
| 3,652,447 | A | 3/1972 | Yant |
| 3,693,718 | A | 9/1972 | Stout |
| 3,699,649 | A | 10/1972 | McWilliams |
| 3,802,203 | A | 4/1974 | Ichise et al. |
| 3,820,605 | A | 6/1974 | Barber et al. |
| 3,821,510 | A | 6/1974 | Muncheryan |

(Continued)

FOREIGN PATENT DOCUMENTS

| | | | |
|---|---|---|---|
| EP | 0 295 045 | A2 | 12/1988 |
| EP | 0 515 983 | A1 | 12/1992 |

(Continued)

OTHER PUBLICATIONS

International Search Report for PCT Application No. PCT/US2011/044548, dated Jan. 24, 2012, 17 pgs.

(Continued)

*Primary Examiner* — David Andrews
*Assistant Examiner* — Richard Alker
(74) *Attorney, Agent, or Firm* — Glen P. Belvis; Steptoe & Johnson LLP

(57) ABSTRACT

There is provided for laser bottom hole assembly for providing a high power laser beam having greater than 5 kW of power for a laser mechanical drilling process to advance a borehole. This assembly utilizes a reverse Moineau motor type power section and provides a self-regulating system that addresses fluid flows relating to motive force, cooling and removal of cuttings.

53 Claims, 17 Drawing Sheets

(56) References Cited

U.S. PATENT DOCUMENTS

| | | | |
|---|---|---|---|
| 3,823,788 | A | 7/1974 | Garrison et al. |
| 3,871,485 | A | 3/1975 | Keenan, Jr. |
| 3,882,945 | A | 5/1975 | Keenan, Jr. |
| 3,938,599 | A | 2/1976 | Horn |
| 3,960,448 | A | 6/1976 | Schmidt et al. |
| 3,977,478 | A | 8/1976 | Shuck |
| 3,992,095 | A | 11/1976 | Jacoby et al. |
| 3,998,281 | A | 12/1976 | Salisbury et al. |
| 4,019,331 | A | 4/1977 | Rom et al. |
| 4,025,091 | A | 5/1977 | Zeile, Jr. |
| 4,026,356 | A | 5/1977 | Shuck |
| 4,046,191 | A | 9/1977 | Neath |
| 4,047,580 | A | 9/1977 | Yahiro et al. |
| 4,057,118 | A | 11/1977 | Ford |
| 4,061,190 | A | 12/1977 | Bloomfield |
| 4,066,138 | A | 1/1978 | Salisbury et al. |
| 4,090,572 | A | 5/1978 | Welch |
| 4,113,036 | A | 9/1978 | Stout |
| 4,125,757 | A | 11/1978 | Ross |
| 4,151,393 | A | 4/1979 | Fenneman et al. |
| 4,162,400 | A | 7/1979 | Pitts, Jr. |
| 4,189,705 | A | 2/1980 | Pitts, Jr. |
| 4,194,536 | A | 3/1980 | Stine et al. |
| 4,199,034 | A | 4/1980 | Salisbury et al. |
| 4,227,582 | A | 10/1980 | Price |
| 4,228,856 | A | 10/1980 | Reale |
| 4,243,298 | A | 1/1981 | Kao et al. |
| 4,249,925 | A | 2/1981 | Kawashima et al. |
| 4,252,015 | A | 2/1981 | Harbon et al. |
| 4,256,146 | A | 3/1981 | Genini et al. |
| 4,266,609 | A | 5/1981 | Rom et al. |
| 4,280,535 | A | 7/1981 | Willis |
| 4,281,891 | A | 8/1981 | Shinohara et al. |
| 4,282,940 | A | 8/1981 | Salisbury et al. |
| 4,332,401 | A | 6/1982 | Stephenson et al. |
| 4,336,415 | A | 6/1982 | Walling |
| 4,340,245 | A | 7/1982 | Stalder |
| 4,367,917 | A | 1/1983 | Gray |
| 4,370,886 | A | 2/1983 | Smith, Jr. et al. |
| 4,374,530 | A | 2/1983 | Walling |
| 4,375,164 | A | 3/1983 | Dodge et al. |
| 4,389,645 | A | 6/1983 | Wharton |
| 4,415,184 | A | 11/1983 | Stephenson et al. |
| 4,417,603 | A | 11/1983 | Argy |
| 4,436,177 | A | 3/1984 | Elliston |
| 4,444,420 | A | 4/1984 | McStravick et al. |
| 4,453,570 | A | 6/1984 | Hutchison |
| 4,459,731 | A | 7/1984 | Hutchison |
| 4,477,106 | A | 10/1984 | Hutchison |
| 4,504,112 | A | 3/1985 | Gould et al. |
| 4,522,464 | A | 6/1985 | Thompson et al. |
| 4,531,552 | A | 7/1985 | Kim |
| 4,533,814 | A | 8/1985 | Ward |
| 4,565,351 | A | 1/1986 | Conti et al. |
| 4,662,437 | A | 5/1987 | Renfro |
| 4,694,865 | A | 9/1987 | Tauschmann |
| 4,725,116 | A | 2/1988 | Spencer et al. |
| 4,741,405 | A | 5/1988 | Moeny et al. |
| 4,744,420 | A | 5/1988 | Patterson et al. |
| 4,770,493 | A | 9/1988 | Ara et al. |
| 4,793,383 | A | 12/1988 | Gyory et al. |
| 4,830,113 | A | 5/1989 | Geyer |
| 4,860,654 | A | 8/1989 | Chawla et al. |
| 4,860,655 | A | 8/1989 | Chawla |
| 4,872,520 | A | 10/1989 | Nelson |
| 4,924,870 | A | 5/1990 | Wlodarczyk et al. |
| 4,952,771 | A | 8/1990 | Wrobel |
| 4,989,236 | A | 1/1991 | Myllymäki |
| 4,997,250 | A | 3/1991 | Ortiz, Jr. |
| 5,003,144 | A | 3/1991 | Lindroth et al. |
| 5,004,166 | A | 4/1991 | Sellar |
| 5,033,545 | A | 7/1991 | Sudol |
| 5,049,738 | A | 9/1991 | Gergely et al. |
| 5,084,617 | A | 1/1992 | Gergely |
| 5,086,842 | A | 2/1992 | Cholet |
| 5,107,936 | A | 4/1992 | Foppe |
| 5,121,872 | A | 6/1992 | Legget |
| 5,125,061 | A | 6/1992 | Marlier et al. |
| 5,125,063 | A | 6/1992 | Panuska et al. |
| 5,128,882 | A | 7/1992 | Cooper et al. |
| 5,140,664 | A | 8/1992 | Bosisio et al. |
| 5,163,321 | A | 11/1992 | Perales |
| 5,168,940 | A | 12/1992 | Foppe |
| 5,172,112 | A | 12/1992 | Jennings |
| 5,212,755 | A | 5/1993 | Holmberg |
| 5,269,377 | A | 12/1993 | Martin |
| 5,285,204 | A | 2/1994 | Sas-Jaworsky |
| 5,348,097 | A | 9/1994 | Giannesini et al. |
| 5,351,533 | A | 10/1994 | Macadam et al. |
| 5,353,875 | A | 10/1994 | Schultz et al. |
| 5,355,967 | A | 10/1994 | Mueller et al. |
| 5,356,081 | A | 10/1994 | Sellar |
| 5,396,805 | A | 3/1995 | Surjaatmadja |
| 5,411,081 | A | 5/1995 | Moore et al. |
| 5,411,085 | A | 5/1995 | Moore et al. |
| 5,411,105 | A | 5/1995 | Gray |
| 5,413,045 | A | 5/1995 | Miszewski |
| 5,413,170 | A | 5/1995 | Moore |
| 5,419,188 | A | 5/1995 | Rademaker et al. |
| 5,423,383 | A | 6/1995 | Pringle |
| 5,425,420 | A | 6/1995 | Pringle |
| 5,435,351 | A | 7/1995 | Head |
| 5,435,395 | A | 7/1995 | Connell |
| 5,463,711 | A | 10/1995 | Chu |
| 5,465,793 | A | 11/1995 | Pringle |
| 5,469,878 | A | 11/1995 | Pringle |
| 5,479,860 | A | 1/1996 | Ellis |
| 5,483,988 | A | 1/1996 | Pringle |
| 5,488,992 | A | 2/1996 | Pringle |
| 5,500,768 | A | 3/1996 | Doggett et al. |
| 5,503,014 | A | 4/1996 | Griffith |
| 5,503,370 | A | 4/1996 | Newman et al. |
| 5,505,259 | A | 4/1996 | Wittrisch et al. |
| 5,515,926 | A | 5/1996 | Boychuk |
| 5,526,887 | A | 6/1996 | Vestavik |
| 5,561,516 | A | 10/1996 | Noble et al. |
| 5,566,764 | A | 10/1996 | Elliston |
| 5,573,225 | A | 11/1996 | Boyle et al. |
| 5,577,560 | A | 11/1996 | Coronado et al. |
| 5,586,609 | A | 12/1996 | Schuh |
| 5,599,004 | A | 2/1997 | Newman et al. |
| 5,615,052 | A | 3/1997 | Doggett |
| 5,638,904 | A | 6/1997 | Misselbrook et al. |
| 5,655,745 | A | 8/1997 | Morrill |
| 5,694,408 | A | 12/1997 | Bott et al. |
| 5,707,939 | A | 1/1998 | Patel |
| 5,735,502 | A | 4/1998 | Levett et al. |
| 5,757,484 | A | 5/1998 | Miles et al. |
| 5,759,859 | A | 6/1998 | Sausa |
| 5,771,984 | A | 6/1998 | Potter et al. |
| 5,773,791 | A | 6/1998 | Kuykendal |
| 5,794,703 | A | 8/1998 | Newman et al. |
| 5,813,465 | A | 9/1998 | Terrell et al. |
| 5,828,003 | A | 10/1998 | Thomeer et al. |
| 5,832,006 | A | 11/1998 | Rice et al. |
| 5,833,003 | A | 11/1998 | Longbottom et al. |
| 5,847,825 | A | 12/1998 | Alexander |
| 5,862,273 | A | 1/1999 | Pelletier |
| 5,862,862 | A | 1/1999 | Terrell |
| 5,864,113 | A | 1/1999 | Cossi |
| 5,896,482 | A | 4/1999 | Blee et al. |
| 5,896,938 | A | 4/1999 | Moeny et al. |
| 5,902,499 | A | 5/1999 | Richerzhagen |
| 5,909,306 | A | 6/1999 | Goldberg et al. |
| 5,913,337 | A | 6/1999 | Williams et al. |
| 5,924,489 | A | 7/1999 | Hatcher |
| 5,929,986 | A | 7/1999 | Slater et al. |
| 5,933,945 | A | 8/1999 | Thomeer et al. |
| 5,938,954 | A | 8/1999 | Onuma et al. |
| 5,973,783 | A | 10/1999 | Goldner et al. |
| 5,986,236 | A | 11/1999 | Gainand et al. |
| 5,986,756 | A | 11/1999 | Slater et al. |
| RE36,525 | E | 1/2000 | Pringle |
| 6,015,015 | A | 1/2000 | Luft et al. |

(56) References Cited

U.S. PATENT DOCUMENTS 6,038,363 A 3/2000 Slater et al.
6,059,037 A 5/2000 Longbottom et al.
6,060,662 A 5/2000 Rafie et al.
6,065,540 A 5/2000 Thomeer et al.
RE36,723 E 6/2000 Moore et al.
6,076,602 A 6/2000 Gano et al.
6,084,203 A 7/2000 Bonigen
6,092,601 A 7/2000 Gano et al.
6,104,022 A 8/2000 Young et al.
RE36,880 E 9/2000 Pringle
6,116,344 A 9/2000 Longbottom et al.
6,135,206 A 10/2000 Gano et al.
6,147,754 A 11/2000 Theriault et al.
6,157,893 A 12/2000 Berger et al.
6,166,546 A 12/2000 Scheihing et al.
6,215,734 B1 4/2001 Moeny et al.
6,227,200 B1 5/2001 Crump et al.
6,250,391 B1 6/2001 Proudfoot
6,273,193 B1 8/2001 Hermann et al.
6,275,645 B1 8/2001 Vereecken et al.
6,281,489 B1 8/2001 Tubel et al.
6,301,423 B1 10/2001 Olson
6,309,195 B1 10/2001 Bottos et al.
6,321,839 B1 11/2001 Vereecken et al.
6,352,114 B1 3/2002 Toalson et al.
6,355,928 B1 3/2002 Skinner et al.
6,356,683 B1 3/2002 Hu et al.
6,377,591 B1 4/2002 Hollister et al.
6,384,738 B1 5/2002 Carstensen et al.
6,386,300 B1 5/2002 Curlett et al.
6,401,825 B1 6/2002 Woodrow
6,426,479 B1 7/2002 Bischof
6,437,326 B1 8/2002 Yamate et al.
6,450,257 B1 9/2002 Douglas
6,494,259 B2 12/2002 Surjaatmadja
6,497,290 B1 12/2002 Misselbrook et al.
6,557,249 B1 5/2003 Pruett et al.
6,561,289 B2 5/2003 Portman et al.
6,564,046 B1 5/2003 Chateau
6,591,046 B2 7/2003 Stottlemyer
6,615,922 B2 9/2003 Deul et al.
6,626,249 B2 9/2003 Rosa
6,644,848 B1 11/2003 Clayton et al.
6,710,720 B2 3/2004 Carstensen et al.
6,712,150 B1 3/2004 Misselbrook et al.
6,725,924 B2 4/2004 Davidson et al.
6,737,605 B1 5/2004 Kern
6,747,743 B2 6/2004 Skinner et al.
6,755,262 B2 6/2004 Parker
6,808,023 B2 10/2004 Smith et al.
6,832,654 B2 12/2004 Ravensbergen et al.
6,847,034 B2 1/2005 Shah et al.
6,851,488 B2 2/2005 Batarseh
6,867,858 B2 3/2005 Owen et al.
6,870,128 B2 3/2005 Kobayashi et al.
6,874,361 B1 4/2005 Meltz et al.
6,880,646 B2 4/2005 Batarseh
6,885,784 B2 4/2005 Bohnert
6,888,097 B2 5/2005 Batarseh
6,888,127 B2 5/2005 Jones et al.
6,912,898 B2 7/2005 Jones et al.
6,913,079 B2 7/2005 Tubel
6,920,395 B2 7/2005 Brown
6,920,946 B2 7/2005 Oglesby
6,923,273 B2 8/2005 Terry et al.
6,957,576 B2 10/2005 Skinner et al.
6,967,322 B2 11/2005 Jones et al.
6,977,367 B2 12/2005 Tubel et al.
6,978,832 B2 12/2005 Gardner et al.
6,981,561 B2 1/2006 Krueger et al.
6,994,162 B2 2/2006 Robison
7,040,746 B2 5/2006 McCain et al.
7,055,604 B2 6/2006 Jee et al.
7,055,629 B2 6/2006 Oglesby
7,072,044 B2 7/2006 Kringlebotn et al.
7,072,588 B2 7/2006 Skinner
7,086,484 B2 8/2006 Smith, Jr.
7,087,865 B2 8/2006 Lerner
7,088,437 B2 8/2006 Blomster et al.
7,126,332 B2 10/2006 Blanz et al.
7,134,488 B2 11/2006 Tudor et al.
7,134,514 B2 11/2006 Riel et al.
7,140,435 B2 11/2006 Defretin et al.
7,147,064 B2 12/2006 Batarseh et al.
7,152,700 B2 12/2006 Church et al.
7,163,875 B2 1/2007 Richerzhagen
7,172,026 B2 2/2007 Misselbrook
7,172,038 B2 2/2007 Terry et al.
7,174,067 B2 2/2007 Murshid et al.
7,188,687 B2 3/2007 Rudd et al.
7,195,731 B2 3/2007 Jones
7,196,786 B2 3/2007 DiFoggio
7,199,869 B2 4/2007 MacDougall
7,201,222 B2 4/2007 Kanady et al.
7,210,343 B2 5/2007 Shammai et al.
7,212,283 B2 5/2007 Hother et al.
7,249,633 B2 7/2007 Ravensbergen et al.
7,264,057 B2 9/2007 Rytlewski et al.
7,270,195 B2 9/2007 MacGregor et al.
7,273,108 B2 9/2007 Misselbrook
7,334,637 B2 2/2008 Smith, Jr.
7,337,660 B2 3/2008 Ibrahim et al.
7,362,422 B2 4/2008 DiFoggio et al.
7,372,230 B2 5/2008 McKay
7,394,064 B2 7/2008 Marsh
7,395,696 B2 7/2008 Bissonnette et al.
7,395,866 B2 7/2008 Milberger et al.
7,416,032 B2 8/2008 Moeny et al.
7,416,258 B2 8/2008 Reed et al.
7,424,190 B2 9/2008 Dowd et al.
7,471,831 B2 12/2008 Bearman et al.
7,487,834 B2 2/2009 Reed et al.
7,490,664 B2 2/2009 Skinner et al.
7,503,404 B2 3/2009 McDaniel et al.
7,515,782 B2 4/2009 Zhang et al.
7,516,802 B2 4/2009 Smith, Jr.
7,518,722 B2 4/2009 Julian et al.
7,527,108 B2 5/2009 Moeny
7,530,406 B2 5/2009 Moeny et al.
7,559,378 B2 7/2009 Moeny
7,587,111 B2 9/2009 de Montmorillon et al.
7,600,564 B2 10/2009 Shampine et al.
7,603,011 B2 10/2009 Varkey et al.
7,617,873 B2 11/2009 Lovell et al.
7,624,743 B2 12/2009 Sarkar et al.
7,628,227 B2 12/2009 Marsh
7,646,953 B2 1/2010 Dowd et al.
7,647,948 B2 1/2010 Quigley et al.
7,671,983 B2 3/2010 Shammai et al.
7,715,664 B1 5/2010 Shou et al.
7,720,323 B2 5/2010 Yamate et al.
7,769,260 B2 8/2010 Hansen et al.
7,802,385 B2 9/2010 Maringer et al.
7,834,777 B2 11/2010 Gold
7,848,368 B2 12/2010 Gapontsev et al.
7,900,699 B2 3/2011 Ramos et al.
7,938,175 B2 5/2011 Skinner et al.
8,011,454 B2 9/2011 Castillo
8,074,332 B2 12/2011 Keatch et al.
8,082,996 B2 12/2011 Kocis et al.
8,091,638 B2 1/2012 Dusterhoft et al.
8,109,345 B2 2/2012 Jeffryes
8,175,433 B2 5/2012 Caldwell et al.
8,322,441 B2 12/2012 Fenton
2002/0007945 A1 1/2002 Neuroth et al.
2002/0039465 A1 4/2002 Skinner
2002/0189806 A1 12/2002 Davidson et al.
2003/0000741 A1 1/2003 Rosa
2003/0053783 A1 3/2003 Shirasaki
2003/0056990 A1 3/2003 Oglesby
2003/0085040 A1 5/2003 Hemphill et al.
2003/0094281 A1 5/2003 Tubel
2003/0132029 A1 7/2003 Parker
2003/0145991 A1 8/2003 Olsen

(56) References Cited

U.S. PATENT DOCUMENTS

2003/0159283 A1 8/2003 White
2003/0160164 A1 8/2003 Jones et al.
2003/0226826 A1 12/2003 Kobayashi et al.
2004/0006429 A1 1/2004 Brown
2004/0016295 A1 1/2004 Skinner et al.
2004/0020643 A1 2/2004 Thomeer et al.
2004/0026382 A1 2/2004 Richerzhagen
2004/0033017 A1 2/2004 Kringlebotn et al.
2004/0074979 A1 4/2004 McGuire
2004/0093950 A1 5/2004 Bohnert
2004/0112642 A1 6/2004 Krueger et al.
2004/0119471 A1 6/2004 Blanz et al.
2004/0129418 A1 7/2004 Jee et al.
2004/0195003 A1 10/2004 Batarseh
2004/0206505 A1 10/2004 Batarseh
2004/0207731 A1 10/2004 Bearman et al.
2004/0211894 A1 10/2004 Hother et al.
2004/0218176 A1 11/2004 Shammal et al.
2004/0244970 A1 12/2004 Smith, Jr.
2004/0252748 A1 12/2004 Gleitman
2004/0256103 A1 12/2004 Batarseh
2005/0007583 A1 1/2005 DiFoggio
2005/0012244 A1 1/2005 Jones
2005/0034857 A1 2/2005 Defretin et al.
2005/0094129 A1 5/2005 MacDougall
2005/0099618 A1 5/2005 DiFoggio et al.
2005/0115741 A1 6/2005 Terry et al.
2005/0121235 A1 6/2005 Larsen et al.
2005/0189146 A1 9/2005 Oglesby
2005/0201652 A1 9/2005 Ellwood, Jr.
2005/0230107 A1 10/2005 McDaniel et al.
2005/0252286 A1 11/2005 Ibrahim et al.
2005/0263281 A1 12/2005 Lovell et al.
2005/0268704 A1 12/2005 Bissonnette et al.
2005/0269132 A1 12/2005 Batarseh et al.
2005/0272512 A1 12/2005 Bissonnette et al.
2005/0272513 A1 12/2005 Bissonnette et al.
2005/0272514 A1 12/2005 Bissonnette et al.
2005/0282645 A1 12/2005 Bissonnette et al.
2006/0038997 A1 2/2006 Julian et al.
2006/0049345 A1 3/2006 Rao et al.
2006/0065815 A1 3/2006 Jurca
2006/0070770 A1 4/2006 Marsh
2006/0102343 A1 5/2006 Skinner et al.
2006/0118303 A1 6/2006 Schultz et al.
2006/0124354 A1* 6/2006 Witte ..... 175/40
2006/0137875 A1 6/2006 Dusterhoft et al.
2006/0185843 A1 8/2006 Smith, Jr.
2006/0191684 A1 8/2006 Smith, Jr.
2006/0204188 A1 9/2006 Clarkson et al.
2006/0207799 A1 9/2006 Yu
2006/0231257 A1 10/2006 Reed et al.
2006/0237233 A1 10/2006 Reed et al.
2006/0260832 A1 11/2006 McKay
2006/0266522 A1 11/2006 Eoff et al.
2006/0283592 A1 12/2006 Sierra et al.
2006/0289724 A1 12/2006 Skinner et al.
2007/0034409 A1 2/2007 Dale et al.
2007/0081157 A1 4/2007 Csutak et al.
2007/0125163 A1 6/2007 Dria et al.
2007/0193990 A1 8/2007 Richerzhagen et al.
2007/0217736 A1 9/2007 Zhang et al.
2007/0227741 A1 10/2007 Lovell et al.
2007/0242265 A1 10/2007 Vessereau et al.
2007/0247701 A1 10/2007 Akasaka et al.
2007/0267220 A1 11/2007 Magiawala et al.
2007/0278195 A1 12/2007 Richerzhagen et al.
2007/0280615 A1 12/2007 de Montmorillon et al.
2008/0023202 A1 1/2008 Keatch et al.
2008/0053702 A1 3/2008 Smith, Jr.
2008/0073077 A1 3/2008 Tunc et al.
2008/0093125 A1 4/2008 Potter et al.
2008/0112760 A1 5/2008 Curlett
2008/0128123 A1 6/2008 Gold
2008/0138022 A1 6/2008 Tassone
2008/0165356 A1 7/2008 DiFoggio et al.
2008/0166132 A1 7/2008 Lynde et al.
2008/0180787 A1 7/2008 DiGiovanni et al.
2008/0245568 A1 10/2008 Jeffryes
2008/0273852 A1 11/2008 Parker et al.
2009/0020333 A1 1/2009 Marsh
2009/0031870 A1 2/2009 O'Connor
2009/0033176 A1 2/2009 Huang et al.
2009/0049345 A1 2/2009 Mock et al.
2009/0050371 A1 2/2009 Moeny
2009/0078467 A1 3/2009 Castillo
2009/0105955 A1 4/2009 Castillo et al.
2009/0126235 A1 5/2009 Kobayashi et al.
2009/0133871 A1 5/2009 Skinner et al.
2009/0133929 A1 5/2009 Rodland
2009/0139768 A1 6/2009 Castillo
2009/0166042 A1 7/2009 Skinner
2009/0190887 A1 7/2009 Freeland et al.
2009/0194292 A1 8/2009 Oglesby
2009/0205675 A1 8/2009 Sarkar et al.
2009/0260834 A1 10/2009 Henson et al.
2009/0266552 A1 10/2009 Barra et al.
2009/0266562 A1 10/2009 Greenaway
2009/0272424 A1 11/2009 Ortabasi
2009/0272547 A1 11/2009 Dale et al.
2009/0279835 A1 11/2009 de Montmorillon et al.
2009/0294050 A1 12/2009 Traggis et al.
2009/0308852 A1 12/2009 Alpay et al.
2009/0324183 A1 12/2009 Bringuier et al.
2010/0000790 A1 1/2010 Moeny
2010/0001179 A1 1/2010 Kobayashi et al.
2010/0008631 A1 1/2010 Herbst
2010/0013663 A1 1/2010 Cavender et al.
2010/0018703 A1 1/2010 Lovell et al.
2010/0025032 A1 2/2010 Smith et al.
2010/0032207 A1 2/2010 Potter et al.
2010/0044102 A1 2/2010 Rinzler et al.
2010/0044103 A1 2/2010 Moxley et al.
2010/0044104 A1 2/2010 Zediker et al.
2010/0044105 A1 2/2010 Faircloth et al.
2010/0044106 A1 2/2010 Zediker et al.
2010/0071794 A1 3/2010 Homan
2010/0078414 A1 4/2010 Perry et al.
2010/0084132 A1 4/2010 Noya et al.
2010/0089571 A1 4/2010 Revellat et al.
2010/0089574 A1 4/2010 Wideman et al.
2010/0089576 A1 4/2010 Wideman et al.
2010/0089577 A1 4/2010 Wideman et al.
2010/0155059 A1 6/2010 Ullah
2010/0170672 A1 7/2010 Schwoebel et al.
2010/0170680 A1 7/2010 McGregor et al.
2010/0187010 A1 7/2010 Abbasi et al.
2010/0197116 A1 8/2010 Shah et al.
2010/0197119 A1 8/2010 Lai et al.
2010/0215326 A1 8/2010 Zediker et al.
2010/0218993 A1 9/2010 Wideman et al.
2010/0224408 A1 9/2010 Kocis et al.
2010/0226135 A1 9/2010 Chen
2010/0236785 A1 9/2010 Collis et al.
2010/0326659 A1 12/2010 Schultz et al.
2010/0326665 A1 12/2010 Redlinger et al.
2011/0030367 A1 2/2011 Dadd
2011/0030957 A1 2/2011 Constantz et al.
2011/0035154 A1 2/2011 Kendall et al.
2011/0048743 A1 3/2011 Stafford et al.
2011/0061869 A1 3/2011 Abass et al.
2011/0079437 A1 4/2011 Hopkins et al.
2011/0127028 A1 6/2011 Strickland
2011/0139450 A1 6/2011 Vasques et al.
2011/0147013 A1 6/2011 Kilgore
2011/0162854 A1 7/2011 Bailey et al.
2011/0168443 A1 7/2011 Smolka
2011/0174537 A1 7/2011 Potter et al.
2011/0186298 A1 8/2011 Clark et al.
2011/0198075 A1 8/2011 Okada et al.
2011/0205652 A1 8/2011 Abbasi et al.
2011/0220409 A1 9/2011 Foppe
2011/0240314 A1 10/2011 Greenaway
2011/0266062 A1 11/2011 Shuman et al.

(56) References Cited

U.S. PATENT DOCUMENTS

| | | | |
|---|---|---|---|
| 2011/0278070 | A1 | 11/2011 | Hopkins et al. |
| 2011/0290563 | A1 | 12/2011 | Kocis et al. |
| 2011/0303460 | A1 | 12/2011 | Von Rohr et al. |
| 2012/0000646 | A1 | 1/2012 | Liotta et al. |
| 2012/0012392 | A1 | 1/2012 | Kumar |
| 2012/0012393 | A1 | 1/2012 | Kumar |
| 2012/0020631 | A1 | 1/2012 | Rinzler et al. |
| 2012/0048550 | A1 | 3/2012 | Dusterhoft et al. |
| 2012/0048568 | A1 | 3/2012 | Li et al. |
| 2012/0061091 | A1 | 3/2012 | Radi |
| 2012/0067643 | A1 | 3/2012 | DeWitt et al. |
| 2012/0068086 | A1 | 3/2012 | DeWitt et al. |
| 2012/0068523 | A1 | 3/2012 | Bowles |
| 2012/0074110 | A1 | 3/2012 | Zediker et al. |
| 2012/0103693 | A1 | 5/2012 | Jeffryes |
| 2012/0111578 | A1 | 5/2012 | Tverlid |
| 2012/0118568 | A1 | 5/2012 | Kleefisch et al. |
| 2012/0118578 | A1 | 5/2012 | Skinner |
| 2012/0217015 | A1 | 8/2012 | Zediker et al. |
| 2012/0217017 | A1 | 8/2012 | Zediker et al. |
| 2012/0217018 | A1 | 8/2012 | Zediker et al. |
| 2012/0217019 | A1 | 8/2012 | Zediker et al. |
| 2012/0248078 | A1 | 10/2012 | Zediker et al. |
| 2012/0255774 | A1 | 10/2012 | Grubb et al. |
| 2012/0255933 | A1 | 10/2012 | McKay et al. |
| 2012/0261188 | A1 | 10/2012 | Zediker et al. |
| 2012/0266803 | A1 | 10/2012 | Zediker et al. |
| 2012/0267168 | A1 | 10/2012 | Grubb et al. |
| 2012/0273269 | A1 | 11/2012 | Rinzler et al. |
| 2012/0273470 | A1 | 11/2012 | Zediker et al. |
| 2012/0275159 | A1 | 11/2012 | Fraze et al. |
| 2013/0011102 | A1 | 1/2013 | Rinzler et al. |

FOREIGN PATENT DOCUMENTS

| | | | |
|---|---|---|---|
| EP | 0 565 287 | A1 | 10/1993 |
| EP | 0 950 170 | B1 | 9/2002 |
| FR | 2 716 924 | A1 | 9/1995 |
| GB | 1 284 454 | | 8/1972 |
| GB | 2420358 | B | 5/2006 |
| JP | 09072738 | A | 3/1997 |
| JP | 09-242453 | A | 9/1997 |
| JP | 2000-334590 | A | 12/2000 |
| JP | 2004-108132 | A | 4/2004 |
| JP | 2006-307481 | A | 11/2006 |
| JP | 2007-120048 | A | 5/2007 |
| WO | WO 95/32834 | A1 | 12/1995 |
| WO | WO 97/49893 | A1 | 12/1997 |
| WO | WO 98/50673 | A1 | 11/1998 |
| WO | WO 98/56534 | A1 | 12/1998 |
| WO | WO 02/057805 | A2 | 7/2002 |
| WO | WO 03/027433 | A1 | 4/2003 |
| WO | WO 03/060286 | A1 | 7/2003 |
| WO | WO 2004/009958 | A1 | 1/2004 |
| WO | WO 2004/094786 | A1 | 11/2004 |
| WO | WO 2005/001232 | A2 | 1/2005 |
| WO | WO 2005/001239 | A1 | 1/2005 |
| WO | WO 2006/008155 | A1 | 1/2006 |
| WO | WO 2006/041565 | A1 | 4/2006 |
| WO | WO 2006/054079 | A1 | 5/2006 |
| WO | WO 2007/002064 | A1 | 1/2007 |
| WO | WO 2007/112387 | A2 | 10/2007 |
| WO | WO 2007/136485 | A2 | 11/2007 |
| WO | WO 2008/016852 | A1 | 2/2008 |
| WO | WO 2008/070509 | A2 | 6/2008 |
| WO | WO 2008/085675 | A1 | 7/2008 |
| WO | WO 2009/042774 | A2 | 4/2009 |
| WO | WO 2009/042781 | A2 | 4/2009 |
| WO | WO 2009/042785 | A2 | 4/2009 |
| WO | WO 2009/131584 | A1 | 10/2009 |
| WO | WO 2010/036318 | A1 | 4/2010 |
| WO | WO 2010/060177 | A1 | 6/2010 |
| WO | WO 2010/087944 | A1 | 8/2010 |
| WO | WO 2011/008544 | A2 | 1/2011 |
| WO | WO 2011/032083 | A1 | 3/2011 |
| WO | WO 2011/041390 | A2 | 4/2011 |
| WO | WO 2011/075247 | A2 | 6/2011 |
| WO | WO 2011/106078 | A2 | 9/2011 |
| WO | WO 2012/003146 | A2 | 1/2012 |
| WO | WO 2012/012006 | A1 | 1/2012 |
| WO | WO 2012/027699 | A1 | 3/2012 |
| WO | WO 2012/064356 | A1 | 5/2012 |
| WO | WO 2012/116189 | A2 | 8/2012 |

OTHER PUBLICATIONS

International Search Report for PCT Application No. PCT/US2011/047902, dated Jan. 17, 2012, 9 pgs.

International Search Report for PCT Application No. PCT/US2011/050044 dated Feb. 1, 2012, 26 pgs.

International Search Report for PCT Application No. PCT/US2012/026277, dated May 30, 2012, 11 pgs.

International Search Report for PCT Application No. PCT/US2012/026265, dated May 30, 2012, 14 pgs.

International Search Report for PCT Application No. PCT/US2012/026280, dated May 30, 2012, 12 pgs.

International Search Report for PCT Application No. PCT/US2012/026337, dated Jun. 7, 2012, 21 pgs.

International Search Report for PCT Application No. PCT/US2012/026471, dated May 30, 2012, 13 pgs.

International Search Report for PCT Application No. PCT/US2012/026525, dated May 31, 2012, 8 pgs.

International Search Report for PCT Application No. PCT/US2012/026526, dated May 31, 2012, 10 pgs.

International Search Report for PCT Application No. PCT/US2012/026494, dated May 31, 2012, 12 pgs.

International Search Report for PCT Application No. PCT/US2012/020789, dated Jun. 29, 2012, 9 pgs.

International Search Report for PCT Application No. PCT/US2012/040490, dated Oct. 22, 2012, 14 pgs.

International Search Report for PCT Application No. PCT/US2012/049338, dated Jan. 22, 2013, 14 pgs.

Abdulagatova, Z. et al., "Effect of Temperature and Pressure on the Thermal Conductivity of Sandstone", *International Journal of Rock Mechanics & Mining Sciences*, vol. 46, 2009, pp. 1055-1071.

Abousleiman, Y. et al., "Poroelastic Solution of an Inclined Borehole in a Transversely Isotropic Medium", *Rock Mechanics*, Daemen & Schultz (eds), 1995, pp. 313-318.

Ackay, H. et al., Paper titled "Orthonormal Basis Functions for Continuous-Time Systems and Lp Convergence", date unknown but prior to Aug. 19, 2009, pp. 1-12.

Acosta, A. et al., paper from X Brazilian MRS meeting titled "Drilling Granite With Laser Light", X Encontro da SBPMat Granado-RS, Sep. 2011, 4 pages including pp. 56 and 59.

Ahmadi, M. et al., "The Effect of Interaction Time and Saturation of Rock on Specific Energy in ND:YAG Laser Perforating", *Optics and Laser Technology*, vol. 43, 2011, pp. 226-231.

Akhatov, I. et al., "Collapse and Rebound of a Laser-Induced Cavitation Bubble", *Physics of Fluids*, vol. 13, No. 10, Oct 2001, pp. 2805-2819.

Albertson, M. L. et al., "Diffusion of Submerged Jets", a paper for the *American Society of Civil Engineers*, Nov. 5, 1852, pp. 1571-1596.

Al-Harthi, A. A. et al., "The Porosity and Engineering Properties of Vesicular Basalt in Saudi Arabia", *Engineering Geology*, vol. 54, 1999, pp. 313-320.

Anand, U. et al., "Prevention of Nozzle Wear in Abrasive Water Suspension Jets (AWSJ) Using PoroLubricated Nozzles", *Transactions of the ASME*, vol. 125, Jan. 2003, pp. 168-181.

Andersson, J. C. et al., "The Aspo Pillar Stability Experiment: Part II—Rock Mass Response to Coupled Excavation-Induced and Thermal-Induced Stresses", *International Journal of Rock Mechanics & Mining Sciences*, vol. 46, 2009, pp. 879-895.

Anovitz, L. M. et al., "A New Approach to Quantification of Metamorphism Using Ultra-Small and Small Angle Neutron Scattering", *Geochimica et Cosmochimica Acta*, vol. 73, 2009, pp. 7303-7324.

(56) References Cited

OTHER PUBLICATIONS

Antonucci, V. et al., "Numerical and Experimental Study of a Concentrated Indentation Force on Polymer Matrix Composites", an excerpt from the *Proceedings of the COMSOL Conference*, 2009, 4 pages.
Aptukov, V. N., "Two Stages of Spallation", publisher unknown, while the date of the publication is unknown, it is believed to be prior to Aug. 19, 2009, 6 pages.
ASTM International, "Standard Test Method for Thermal Conductivity of Solids by Means of the Guarded-Comparative-Longitudinal Heat Flow Technique", Standard under the fixed Designation E1225-09, 2009, pp. 1-9.
Atkinson, B. K., "Introduction to Fracture Mechanics and Its Geophysical Applications", *Fracture Mechanics of Rock*, 1987, pp. 1-26.
Aubertin, M. et al., "A Multiaxial Stress Criterion for Short- and Long-Term Strength of Isotropic Rock Media", *International Journal of Rock Mechanics & Mining Sciences*, vol. 37, 2000, pp. 1169-1193.
Author unknown, by Rio Technical Services, "Sub-Task 1: Current Capabilities of Hydraulic Motors, Air/Nitrogen Motors, and Electric Downhole Motors", a final report for Department of Energy National Petroleum Technology Office for the Contract Task 03NT30429, Jan. 30, 2004, 26 pages.
Avar, B. B. et al., "Porosity Dependence of the Elastic Modulof Lithophysae-rich Tuff: Numerical and Experimental Investigations", *International Journal of Rock Mechanics & Mining Sciences*, vol. 40, 2003, pp. 919-928.
Backers, T. et al., "Tensile Fracture Propagation and Acoustic Emission Activity in Sandstone: The Effect of Loading Rate", *International Journal of Rock Mechanics & Mining Sciences*, vol. 42, 2005, pp. 1094-1101.
Baek, S. Y. et al., "Simulation of the Coupled Thermal/Optical Effects for Liquid Immersion Micro-/Nanolithography", source unknown, believed to be publically available prior to 2012, 13 pages.
Bagatur, T. et al., "Air-entrainment Characteristics in a Plunging Water Jet System Using Rectangular Nozzles with Rounded Ends", *Water SA*, vol. 29, No. 1, Jan. 2003, pp. 35-38.
Baird, J. A. et al., "Analyzing the Dynamic Behavior of Downhole Equipment During Drilling", government Sandia Report, SAND-84-0758C, DE84 008840, 7 pages.
Batarseh, S. I. et al, "Innovation in Wellbore Perforation Using High-Power Laser", *International Petroleum Technology Conference*, IPTC N0. 10981, Nov. 2005, 7 pages.
Batarseh, S. et al., "Well Perforation Using High-Power Lasers", a paper prepared for presentation at the SPE (Society of Petroleum Engineers) Annual Technical Conference and Exhibition, SPE No. 84418, Oct. 2003, 10 pages.
Baykasoglu, A. et al., "Prediction of Compressive and Tensile Strength of Limestone via Genetic Programming", *Expert Systems with Applications*, vol. 35, 2008, pp. 111-123.
Bechtel SAIC Company LLC, "Heat Capacity Analysis", a report prepared for Department of Energy, Nov. 2004, 100 pages.
Belushi, F. et al., "Demonstration of the Power of Inter-Disciplinary Integration to Beat Field Development Challenges in Complex Brown Field-South Oman", *Society of Petroleum Engineers*, a paper prepared for presentation at the Abu Dhabi International Petroleum Exhibition & Conference, SPE No. 137154, Nov. 2010, 18 pages.
Belyaev, V. V., "Spall Damage Modelling and Dynamic Fracture Specificities of Ceramics", *Journal of Materials Processing Technology*, vol. 32, 1992, pp. 135-144.
Benavente, D. et al., "The Combined Influence of Mineralogical, Hygric and Thermal Properties on the Durability of PoroBuilding Stones", *Eur. J. Mineral*, vol. 20, Aug. 2008, pp. 673-685.
Bieniawski, Z. T., "Mechanism of Brittle Fracture of Rock: Part I—Theory of the Fracture Process", *Int. J. Rock Mech. Min. Sci.*, vol. 4, 1967, pp. 395-406.
Bilotsky, Y. et al., "Modelling Multilayers Systems with Time-Depended Heaviside and New Transition Functions", excerpt from the Proceedings of the 2006 Nordic COMSOL Conference, 2006, 4 pages.
Birkholzer, J. T. et al., "The Impact of Fracture—Matrix Interaction on Thermal—Hydrological Conditions in Heated Fractured Rock", an origial research paper published online http://vzy.scijournals.org/cgi/content/ful1/5/2/657, May 26, 2006, 27 pages.
Blackwell, D. D. et al., "Geothermal Resources in Sedimentary Basins", a presentation for the Geothermal Energy Generation in Oil and Gas Settings, Mar. 13, 2006, 28 pages.
Blair, S. C. et al., "Analysis of Compressive Fracture in Rock Using Statistical Techniques: Part I. A Non-linear Rule-based Model", *Int. J. Rock Mech. Min. Sci.*, vol. 35 No. 7, 1998, pp. 837-848.
Blomqvist, M. et al., "All-in-Quartz Optics for Low Focal Shifts", *SPIE Photonics West Conference in San Francisco*, Jan. 2011, 12 pages.
Boechat, A. A. P. et al., "Bend Loss in Large Core Multimode Optical Fiber Beam Delivery Systems", *Applied Optics.*, vol. 30 No. 3, Jan. 20, 1991, pp. 321-327.
Bolme, C. A., "Ultrafast Dynamic Ellipsometry of Laser Driven Shock Waves", a dissertation for the degree of Doctor of Philosophy in Physical Chemistry at Massachusetts Institute of Technology, Sep. 2008, pp. 1-229.
Britz, Dieter, "Digital Simulation in Electrochemistry", *Lect. Notes Phys.*, vol. 666, 2005, pp. 103-117.
Brown, G., "Development, Testing and Track Record of Fiber-Optic, Wet-Mate, Connectors", *IEEE*, 2003, pp. 83-88.
Brujan, E. A. et al., "Dynamics of Laser-Induced Cavitation Bubbles Near an Elastic Boundar", *J. Fluid Mech.*, vol. 433, 2001, pp. 251-281.
Burdine, N. T., "Rock Failure Under Dynamic Loading Conditions", Society of Petroleum Engineers Journal, Mar. 1963, pp. 1-8.
Bybee, K., "Modeling Laser-Spallation Rock Drilling", *JPT*, an SPE available at www.spe.org/jpt, Feb. 2006, 2 pages 62-63.
Bybee, Karen, highlight of "Drilling a Hole in Granite Submerged in Water by Use of CO2 Laser", an SPE available at www.spe.org/jpt, *JPT*, Feb. 2010, pp. 48, 50 and 51.
Cai, W. et al., "Strength of Glass from Hertzian Line Contact", *Optomechanics 2011: Innovations and Solutions*, 2011, 5 pages.
Capetta, I. S. et al., "Fatigue Damage Evaluation on Mechanical Components Under Multiaxial Loadings", European Comsol Conference, University of Ferrara, Oct. 16, 2009, 25 pages.
Carstens, J. P. et al., "Rock Cutting by Laser", a paper of *Society of Petroleum Engineers of AIME*, 1971, 11 pages.
Caruso, C. et al., "Dynamic Crack Propagation in Fiber Reinforced Composites", Excerpt from the Proceedings of the COMSOL Conference, 2009, 5 pages.
Chastain, T. et al., "Deepwater Drilling Riser System", *SPE Drilling Engineering*, Aug. 1986, pp. 325-328.
Chen, H. Y. et al., "Characterization of the Austin Chalk Producing Trend", *SPE*, a paper prepared for presentation at the 61st Annual Technical Conference and Exhibition of the Society of Petroleum Engineers, SPE No. 15533, Oct 1986, pp. 1-12.
Chen, K., paper titled "Analysis of Oil Film Interferometry Implementation in Non-Ideal Conditions", source unknown, Jan. 7, 2010, pp. 1-18.
Chraplyvy, A. R., "Limitations on Lightwave Communications Imposed by Optical-Fiber Nonlinearities", *Journal of Lightwave Technology*, vol. 8 No. 10, Oct. 1990, pp. 1548-1557.
Churcher, P. L. et al., "Rock Properties of Berea Sandstone, Baker Dolomite, and Indiana Limestone", a paper prepared for presentation at the SPE International Symposium on Oilfield Chemistry), *SPE*, SPE No. 21044, Feb. 1991, pp. 431-446 and 3 pages.
Cimetiere, A. et al., "A Damage Model for Concrete Beams in Compression", *Mechanics Research Communications*, vol. 34, 2007, pp. 91-96.
Close, F. et al., "Successful Drilling of Basalt in a West of Shetland Deepwater Discovery", a paper prepared for presentation at Offshore Europe 2005 by SPE (Society of Petroleum Engineers) Program Committee, SPE No. 96575, Sep. 2005, pp. 1-10.

(56) References Cited

OTHER PUBLICATIONS

Cohen, J. H., "High-Power Slim-Hole Drilling System", a paper presented at the conference entitled Natural Gas RD&D Contractor's Review Meeting, Office of Scientific and Technical Information, Apr. 1995, 10 pages.
Cone, C., "Case History of the University Block 9 (Wolfcamp) Field—Gas-Water Injection Secondary Recovery Project", *Journal of Petroleum Technology*, Dec. 1970, pp. 1485-1491.
Contreras, E. et al., "Effects of Temperature and Stress on the Compressibilities, Thermal Expansivities, and Porosities of Cerro Prieto and Berea Sandstones to 9000 PSI and 208 degrees Celsius", Proceedings Eighth Workshop Geothermal Reservoir Engineering, Leland Stanford Junior University, Dec. 1982, pp. 197-203.
Cooper, R., "Coiled Tubing Deployed ESPs Utilizing Internally Installed Power Cable—A Project Update", a paper prepared by SPE (Society of Petroleum Engineers) Program Committee for presentation at the 2nd North American Coiled Tubing Roundtable, SPE 38406, Apr. 1997, pp. 1-6.
Coray, P. S. et al., "Measurements on 5:1 Scale Abrasive Water Jet Cutting Head Models", source unknown, available prior to 2012, 15 pages.
Cruden, D. M., "The Static Fatigue of Brittle Rock Under Uniaxial Compression", *Int. J. Rock Mech. Min. Sci. & Geomech. Abstr.,* vol. 11, 1974, pp. 67-73.
da Silva, B. M. G., "Modeling of Crack Initiation, Propagation and Coalescence in Rocks", a thesis for the degree of Master of Science in Civil and Environmental Engineering at the Massachusetts Institute of Technology, Sep. 2009, pp. 1-356.
Dahl, F. et al., "Development of a New Direct Test Method for Estimating Cutter Life, Based on the Sievers' J Miniature Drill Test", *Tunnelling and Underground Space Technology*, vol. 22, 2007, pp. 106-116.
de Castro Lima, J. J. et al., "Linear Thermal Expansion of Granitic Rocks: Influence of Apparent Porosity, Grain Size and Quartz Content", *Bull Eng Geol Env.*, 2004, vol. 63, pp. 215-220.
Degallaix, J. et al., "Simulation of Bulk-Absorption Thermal Lensing in Transmissive Optics of Gravitational Waves Detector", *Appl. Phys.,* B77, 2003, pp. 409-414.
Dey, T. N. et al., "Some Mechanisms of Microcrack Growth and Interaction in Compressive Rock Failure", *Int. J. Rock Mech. Min. Sci. & Geomech. Abstr.*, vol. 18, 1981, pp. 199-209.
Diamond-Cutter Drill Bits, by Geothermal Energy Program, Office of Geothermal and Wind Technologies, 2000, 2 pgs.
Dimotakis, P. E. et al., "Flow Structure and Optical Beam Propagation in High-Reynolds-Number Gas-Phase Shear Layers and Jets", *J. Fluid Mech.*, vol. 433, 2001, pp. 105-134.
Dole, L. et al., "Cost-Effective CementitioMaterial Compatible with Yucca Mountain Repository Geochemistry", a paper prepared by Oak Ridge National Laboratory for the Department of Energy, No. ORNL/TM-2004/296, Dec. 2004, 128 pages.
Dumans, C. F. F. et al., "PDC Bit Selection Method Through the Analysis of Past Bit Performances", a paper prepared for presentation at the *SPE* (Society of Petroleum Engineers—Latin American Petroleum Engineering Conference), Oct. 1990, pp. 1-6.
Dutton, S. P. et al., "Evolution of Porosity and Permeability in the Lower CretaceoTravis Peak Formation, East Texas", *The American Association of Petroleum Geologists Bulletin*, vol. 76, No. 2, Feb. 1992, pp. 252-269.
Dyskin, A. V. et al., "Asymptotic Analysis of Crack Interaction with Free Boundary", *International Journal of Solids and Structure*, vol. 37, 2000, pp. 857-886.
Eckel, J. R. et al., "Nozzle Design and its Effect on Drilling Rate and Pump Operation", a paper presented at the spring meeting of the Southwestern District, Division of Production, Beaumont, Texas, Mar. 1951, pp. 28-46.
Ehrenberg, S. N. et al., "Porosity-Permeability Relationship in Interlayered Limestone-Dolostone Reservoir", *The American Association of Petroleum Geologists Bulletin*, vol. 90, No. 1, Jan. 2006, pp. 91-114.
Ersoy, A., "Wear Characteristics of PDC Pin and Hybrid Core Bits in Rock Drilling", *Wear*, vol. 188, 1995, pp. 150-165.
Extreme Coil Drilling, by Extreme Drilling Corporation, 2009, 10 pgs.
Falcao, J. L. et al., "PDC Bit Selection Through Cost Prediction Estimates Using Crossplots and Sonic Log Data", *SPE*, a paper prepared for presentation at the 1993 SPE/IADC Drilling Conference, Feb. 1993, pp. 525-535.
Falconer, I. G. et al., "Separating Bit and Lithology Effects from Drilling Mechanics Data", *SPE*, a paper prepared for presentation at the 1988 IADC/SPE Drilling Conference, Feb./Mar. 1988, pp. 123-136.
Farra, G., "Experimental Observations of Rock Failure Due to Laser Radiation", a thesis for the degree of Master of Science at Massachusetts Institute of Technology, Jan. 1969, 128 pages.
Farrow, R. L. et al., "Peak-Power Limits on Fiber Amplifiers Imposed by Self-Focusing", *Optics Letters*, vol. 31, No. 23, Dec. 1, 2006, pp. 3423-3425.
Fertl, W. H. et al., "Spectral Gamma-Ray Logging in the Texas Austin Chalk Trend", *SPE of AIME*, a paper for Journal of Petroleum Technology, Mar. 1980, pp. 481-488.
Field, F. A., "A Simple Crack-Extension Criterion for Time-Dependent Spallation", *J. Mech. Phys. Solids*, vol. 19, 1971, pp. 61-70.
Finger, J. T. et al., "PDC Bit Research at Sandia National Laboratories", Sandia Report No. SAND89-0079-UC-253, a report prepared for Department of Energy, Jun. 1989, 88 pages.
Freeman, T. T. et al., "THM Modeling for Reservoir Geomechanical Applications", presented at the COMSOL Conference, Oct. 2008, 22 pages.
Friant, J. E. et al., "Disc Cutter Technology Applied to Drill Bits", a paper prepared by Exacavation Engineering Associates, Inc. for the Department of Energy's Natural Gas Conference, Mar. 1997, pp. 1-16.
Fuerschbach, P. W. et al., "Understanding Metal Vaporization from Laser Welding", Sandia Report No. SAND-2003-3490, a report prepared for DOE, Sep. 2003, pp. 1-70.
Gahan, B. C. et al., "Analysis of Efficient High-Power Fiber Lasers for Well Perforation", *SPE*, No. 90661, a paper prepared for presentation at the SPE Annual Technical Conference and Exhibition, Sep. 2004, 9 pages.
Gahan, B. C. et al., "Effect of Downhole Pressure Conditions on High-Power Laser Perforation", *SPE*, No. 97093, a paper prepared for the 2005 SPE (Society of Petroleum Engineers) Annual Technical Conference and Exhibition, Oct. 12, 2005, 7 pages.
Gahan, B. C. et al., "Laser Drilling: Drilling with the Power of Light, Phase 1: Feasibility Study", a Topical Report by the *Gas Technology Institute*, for the Government under Cooperative Agreement No. DE-FC26-00NT40917, Sep. 30, 2001, 107 pages.
Gahan, B. C., et al., "Laser Drilling—Drilling with the Power of Light: High Energy Laser Perforation and Completion Techniques", Annual Technical Progress Report by the *Gas Technology Institute*, to the Department of Energy, Nov. 2006, 94 pages.
Gale, J. F. W. et al., "Natural Fractures in the Barnett Shale and Their Importance for Hydraulic Fracture Treatments", The American Assoction of Petroleum Geologists, *AAPG Bulletin*, vol. 91, No. 4, Apr. 2007, pp. 603-622.
Gardner, R. D. et al., "Flourescent Dye Penetrants Applied to Rock Fractures", *Int. J. Rock Mech. Min. Sci.*, vol. 5, 1968, pp. 155-158 with 2 additional pages.
Gelman, A., "Multi-level (hierarchical) modeling: what it can and can't do", source unknown, Jun. 1, 2005, pp. 1-6.
Gerbaud, L. et al., "PDC Bits: All Comes From the Cutter/Rock Interaction", SPE, No. IADC/SPE 98988, a paper presented at the IADC/SPE Drilling Conference, Feb. 2006, pp. 1-9.
Gonthier, F. "High-power All-Fiber® components: The missing link for high power fiber fasers", source unknown, 11 pages.
Graves, R. M. et al., "Comparison of Specific Energy Between Drilling With High Power Lasers and Other Drilling Methods", *SPE*, No. SPE 77627, a paper presented at the SPE (Society of Petroleum Engineers) Annual Technical Conference and Exhibiton, Sep. 2002, pp. 1-8.

(56) References Cited

OTHER PUBLICATIONS

Graves, R. M. et al., "Spectral signatures and optic coeffecients of surface and reservoir rocks at COIL, CO2 and Nd:YAG laser wavelenghts", source unknown, 13 pages.
Graves, R. M. et al., "StarWars Laser Technology Applied to Drilling and Completing Gas Wells", *SPE,* No. 49259, a paper prepared for presentation at the 1998 SPE Annual Technical Conference and Exhibition, 1998, pp. 761-770.
Green, D. J. et al., "Crack Arrest and Multiple Crackling in Glass Through the Use of Designed Residual Stress Profiles", *Science*, vol. 283, No. 1295, 1999, pp. 1295-1297.
Grigoryan, V., "InhomogeneoBoundary Value Problems", a lecture for Math 124B, Jan. 26, 2010, pp. 1-5.
Grigoryan, V., "Separathion of variables: Neumann Condition", a lecture for Math 124A, Dec. 1, 2009, pp. 1-3.
Gunn, D. A. et al., "Laboratory Measurement and Correction of Thermal Properties for Application to the Rock Mass", *Geotechnical and Geological Engineering*, vol. 23, 2005, pp. 773-791.
Guo, B. et al., "Chebyshev Rational Spectral and Pseudospectral Methods on a Semi-infinite Interval", *Int. J. Numer. Meth. Engng*, vol. 53, 2002, pp. 65-84.
Gurarie, V. N., "Stress Resistance Parameters of Brittle Solids Under Laser/Plasma Pulse Heating", *Materials Science and Engineering*, vol. A288, 2000, pp. 168-172.
Hagan, P. C., "The Cuttability of Rock Using a High Pressure Water Jet", University of New South Wales, Sydney, Australia, obtained form the Internet on Sep. 7, 2010, at: http://www.mining.unsw.edu.au/Publications/publications_staff/Paper_Hagan_WASM.htm, 16 pages.
Hall, K. et al., "Rock Albedo and Monitoring of Thermal Conditions in Respect of Weathering: Some Expected and Some Unexpected Results", *Earth Surface Processes and Landforms*, vol. 30, 2005, pp. 801-811.
Hammer, D. X. et al., "Shielding Properties of Laser-Induced Breakdown in Water for Pulse Durations from 5 ns to 125 fs", *Applied Optics*, vol. 36, No. 22, Aug. 1, 1997, pp. 5630-5640.
Hancock, M. J., "The 1-D Heat Equation: 18.303 Linear Partial Differential Equations", source unknown, 2004, pp. 1-41.
Hareland, G. et al., "Drag—Bit Model Including Wear", *SPE*, No. 26957, a paper prepared for presentation at the Latin American/Caribbean Petroleum Engineering Conference, Apr. 1994, pp. 657-667.
Hareland, G., et al., "A Drilling Rate Model for Roller Cone Bits and Its Application", *SPE*, No. 129592, a paper prepared for presentation at the CPS/SPE International Oil and Gas Conference and Exhibition, Jun. 2010, pp. 1-7.
Harrison, C. W. III et al., "Reservoir Characterization of the Frontier Tight Gas Sand, Green River Basin, Wyoming", *SPE*, No. 21879, a paper prepared for presentation at the Rocky Mountain Regional Meeting and Low-Permeability Reservoirs Symposium, Apr. 1991, pp. 717-725.
Hashida, T. et al., "Numerical simulation with experimental verification of the fracture behavior in granite under confining pressures based on the tension-softening model", *International Journal of Fracture*, vol. 59, 1993, pp. 227-244.
Hasting, M. A. et al., "Evaluation of the Environmental Impacts of Induced Seismicity at the Naknek Geothermal Energy Project, Naknek, Alaska", a final report prepared for ASRC Energy Services Alaska Inc., May 2010, pp. 1-33.
Head, P. et al., "Electric Coiled Tubing Drilling (E-CTD) Project Update", *SPE*, No. 68441, a paper prepared for presentation at the SPE/CoTA Coiled Tubing Roundtable, Mar. 2001, pp. 1-9.
Hood, M., "Waterjet-Assisted Rock Cutting Systems—The Present State of the Art", *International Journal of Mining Engineering*, vol. 3, 1985, pp. 91-111.
Howard, A. D. et al., "VOLAN Interpretation and Application in the Bone Spring Formation (Leonard Series) in Southeastern New Mexico", *SPE*, No. 13397, a paper presented at the 1984 SPE Production Technology Symposium, Nov. 1984, 10 pages.
Howells, G., "Super-Water [R] Jetting Applications from 1974 to 1999", paper presented st the Proceedings of the 10th American Waterjet Confeence in Houston, Texas, 1999, 25 pages.
Hu, H. et al., "SimultaneoVelocity and Concentration Measurements of a Turbulent Jet Mixing Flow", *Ann. N. Y. Acad. Sci*., vol. 972, 2002, pp. 254-259.
Huang, C. et al., "A Dynamic Damage Growth Model for Uniaxial Compressive Response of Rock Aggregates", *Mechanics of Materials*, vol. 34, 2002, pp. 267-277.
Huang, H. et al., "Intrinsic Length Scales in Tool-Rock Interaction", *International Journal of Geomechanics*, Jan./Feb. 2008, pp. 39-44.
Huenges, E. et al., "The Stimulation of a Sedimentary Geothermal Reservoir in the North German Basin: Case Study Grob Schonebeck", Proceedings, *Twenty-Ninth Workshop on Geothermal Reservoir Engineering*, Stanford University, Stanford, California, Jan. 26-28, 2004, 4 pages.
Hutchinson, J. W., "Mixed Mode Cracking in Layered Materials", *Advances in Applied Mechanics*, vol. 29, 1992, pp. 63-191.
IADC Dull Grading System for Fixed Cutter Bits, by Hughes Christensen, 1996, 14 pgs.
Imbt, W. C. et al., "Porosity in Limestone and Dolomite Petroleum Reservoirs", paper presented at the Mid Continent District, Division of Production, Oklahoma City, Oklahoma, Jun. 1946, pp. 364-372.
Jackson, M. K. et al., "Nozzle Design for Coherent Water Jet Production", source unknown, believed to be published prior to 2012, pp. 53-89.
Jadoun, R. S., "Study on Rock-Drilling Using PDC Bits for the Prediction of Torque and Rate of Penetration", *Int. J. Manufacturing Technology and Management*, vol. 17, No. 4, 2009, pp. 408-418.
Jain, R. K. et al., "Development of Underwater Laser Cutting Technique for Steel and Zircaloy for Nuclear Applications", *Journal of Physics for Indian Academy of Sciences*, vol. 75 No. 6, Dec. 2010, pp. 1253-1258.
Jen, C. K. et al., "Leaky Modes in Weakly Guiding Fiber Acoustic Waveguides", *IEEE Transactions on Ultrasonic Ferroelectrics and Frequency Control*, vol. UFFC-33 No. 6, Nov. 1986, pp. 634-643.
Judzis, A. et al., "Investigation of Smaller Footprint Drilling System; Ultra-High Rotary Speed Diamond Drilling Has Potential for Reduced Energy Requirements", IADC/SPE No. 99020, 33 pages.
Jurewicz, B. R., "Rock Excavation with Laser Assistance", *Int. J. Rock Mech. Min. Sci. & Geomech. Abstr*., vol. 13, 1976, pp. 207-219.
Karakas, M., "Semianalytical Productivity Models for Perforated Completions", *SPE*, No. 18247, a paper for SPE (Society of Petroleum Engineers) Production Engineering, Feb. 1991, pp. 73-82.
Karasawa, H. et al., "Development of PDC Bits for Downhole Motors", *Proceedings 17th NZ Geothermal Workshop*, 1995, pp. 145-150.
Kemeny, J. M., "A Model for Non-linear Rock Deformation Under Compression Due to Sub-critical Crack Growth", *Int. J. Rock Mech. Min. Sci. & Geomech. Abstr*., vol. 28 No. 6, 1991, pp. 459-467.
Khandelwal, M., "Prediction of Thermal Conductivity of Rocks by Soft Computing", *Int. J. Earth Sci.* (*GeoL Rundsch*), May 11, 2010, 7 pages.
Kim, C. B. et al., "Measurement of the Refractive Index of Liquids at 1.3 and 1.5 Micron Using a Fibre Optic Fresnel Ratio Meter", *Meas. Sci. Technol*.,vol. 5, 2004, pp. 1683-1686.
Kiwata, T. et al., "Flow Visualization and Characteristics of a Coaxial Jet with a Tabbed Annular Nozzle", *JSME International Journal Series B*, vol. 49, No. 4, 2006, pp. 906-913.
Kobayashi, T. et al., "Drilling a 2-inch in Diameter Hole in Granites Submerged in Water by CO2 Lasers", *SPE*, No. 119914, a paper prepared for presentation at the SPE/IADC Drilling Conference and Exhibition, Mar. 2009, 6 pages.
Kobyakov, A. et al., "Design Concept for Optical Fibers with Enhanced SBS Threshold", *Optics Express*, vol. 13, No. 14, Jun. 11, 2005, pp. 5338-5346.
Kolari, K., "Damage Mechanics Model for Brittle Failure of Transversely Isotropic Solids (Finite Element Implementation)", *VTT Publications 628*, 2007, 210 pages.
Kollé, J. J., "A Comparison of Water Jet, Abrasive Jet and Rotary Diamond Drilling in Hard Rock", *Tempress Technologies Inc*., 1999, pp. 1-8.

(56) References Cited

OTHER PUBLICATIONS

Kolle, J. J., "HydroPulse Drilling", a Final Report for Department of Energy under Cooperative Development Agreement No. DE-FC26-FT34367, Apr. 2004, 28 pages.
Kovalev, V. I. et al., "Observation of Hole Burning in Spectrum in SBS in Optical Fibres Under CW Monochromatic Laser Excitation", *IEEE*, Jun. 3, 2010, pp. 56-57.
Koyamada, Y. et al., "Simulating and Designing Brillouin Gain Spectrum in Single-Mode Fibers", *Journal of Lightwave Technology*, vol. 22, No. 2, Feb. 2004, pp. 631-639.
Krajcinovic, D. et al., "A Micromechanical Damage Model for Concrete", *Engineering Fracture Mechanics*, vol. 25, No. 5/6, 1986, pp. 585-596.
Kranz, R. L., "Microcracks in Rocks: A Review", *Tectonophysics*, vol. 100, 1983, pp. 449-480.
Labuz, J. F. et al., "Experiments with Rock: Remarks on Strength and Stability Issues", *International Journal of Rock Mechanics & Mining Science*, vol. 44, 2007, pp. 525-537.
Labuz, J. F. et al., "Size Effects in Fracture of Rock", *Rock Mechanics for Industry*, Amadei, Kranz, Scott & Smeallie (eds), 1999, pp. 1137-1143.
Langeveld, C. J., "PDC Bit Dynamics", a paper prepared for presentation at the 1992 IADC/SPE Drilling Conference, Feb. 1992, pp. 227-241.
Lee, S. H. et al., "Themo-Poroelastic Analysis of Injection-Induced Rock Deformation and Damage Evolution", *Proceedings Thirty-Fifth Workshop on Geothermal Reservoir Engineering*, Feb. 2010, 9 pages.
Lee, Y. W. et al., "High-Power Yb3+ Doped Phosphate Fiber Amplifier", *IEEE Journal of Selected Topics in Quantum Electronics*, vol. 15, No. 1, Jan./Feb. 2009, pp. 93-102.
Legarth, B. et al., "Hydraulic Fracturing in a Sedimentary Geothermal Reservoir: Results and Implications", *International Journal of Rock Mechanics & Mining Sciences*, vol. 42 , 2005, pp. 1028-1041.
Lehnhoff, T. F. et al., "The Influence of Temperature Dependent Properties on Thermal Rock Fragmentation", *Int. J. Rock Mech. Min. Sci. & Geomech. Abstr.*, vol. 12, 1975, pp. 255-260.
Leong, K. H., "Modeling Laser Beam-Rock Interaction", a report prepared for Department of Energy (http://www.doe.gov/bridge), 8 pages.
Li, Q. et al., "Experimental Research on Crack Propagation and Failure in Rock-type Materials under Compression", *EJGE*, vol. 13, Bund. D, 2008, p. 1-13.
Li, X. B. et al., "Experimental Investigation in the Breakage of Hard Rock by the PDC Cutters with Combined Action Modes", *Tunnelling and Underground Space Technology*, vol. 16., 2001, pp. 107-114.
Liddle, D. et al., "Cross Sector Decommissioning Workshop", presentation, Mar. 23, 2011, 14 pages.
Lindholm, U. S. et al., "The Dynamic Strength and Fracture Properties of Dresser Basalt", *Int. J. Rock Mech. Min. Sci. & Geomech. Abstr.*, vol. 11, 1974, pp. 181-191.
Loland, K. E., "ContinuoDamage Model for Load-Response Estimation of Concrete", *Cement and Concrete Research*, vol. 10, 1980, pp. 395-402.
Lorenzana, H. E. et al., "Metastability of Molecular Phases of Nitrogen: Implications to the Phase Diagram", a manuscript submitted to the European Hight Pressure Research Group 39 Conference, *Advances on High Pressure*, Sep. 21, 2001, 18 pages.
Lubarda, V. A. et al., "Damage Model for Brittle Elastic Solids with Unequal Tensile and Compressive Strengths", *Engineering Fracture Mechanics*, vol. 29, No. 5, 1994, pp. 681-692.
Lucia, F. J. et al., "Characterization of Diagenetically Altered Carbonate Reservoirs, South Cowden Grayburg Reservoir, West Texas", a paper prepared for presentation at the 1996 SPE Annual Technical Conference and Exhibition, Oct. 1996, pp. 883-893.
Luffel, D. L. et al., "Travis Peak Core Permeability and Porosity Relationships at Reservoir Stress", *SPE Formation Evaluation*, Sep. 1991, pp. 310-318.
Luft, H. B. et al., "Development and Operation of a New Insulated Concentric Coiled Tubing String for ContinuoSteam Injection in Heavy Oil Production", Conference Paper published by Society of Petroleum Engineers on the Internet at: (http://www.onepetro.org/mslib/servlet/onepetropreview?id=00030322), on Aug. 8, 2012, 1 page.
Lund, M. et al., "Specific Ion Binding to Macromolecules: Effect of Hydrophobicity and Ion Pairing", *Langmuir*, 2008 vol. 24, 2008, pp. 3387-3391.
Manrique, E. J. et al., "EOR Field Experiences in Carbonate Reservoirs in the United States", *SPE Reservoir Evaluation & Engineering*, Dec. 2007, pp. 667-686.
Maqsood, A. et al., "Thermophysical Properties of PoroSandstones: Measurement and Comparative Study of Some Representative Thermal Conductivity Models", *International Journal of Thermophysics*, vol. 26, No. 5, Sep. 2005, pp. 1617-1632.
Marcuse, D., "Curvature Loss Formula for Optical Fibers", *J. Opt. Soc. Am.*, vol. 66, No. 3, 1976, pp. 216-220.
Martin, C. D., "Seventeenth Canadian Geotechnical Colloquium: The Effect of Cohesion Loss and Stress Path on Brittle Rock Strength", Canadian Geotechnical Journal, vol. 34, 1997, pp. 698-725.
Martins, A. et al., "Modeling of Bend Losses in Single-Mode Optical Fibers", Institutu de Telecomunicacoes, Portugal, 3 pages.
Maurer, W. C. et al., "Laboratory Testing of High-Pressure, High-Speed PDC Bits", a paper prepared for presentation at the 61st Annual Technical Conference and Exhibition of the Society of Petroleum Engineers, Oct. 1986, pp. 1-8.
McKenna, T. E. et al., "Thermal Conductivity of Wilcox and Frio Sandstones in South Texas (Gulf of Mexico Basin)", *AAPG Bulletin*, vol. 80, No. 8, Aug. 1996, pp. 1203-1215.
Meister, S. et al., "Glass Fibers for Stimulated Brillouin Scattering and Phase Conjugation", *Laser and Particle Beams*, vol. 25, 2007, pp. 15-21.
Mejia-Rodriguez, G. et al., "Multi-Scale Material Modeling of Fracture and Crack Propagation", Final Project Report in Multi-Scale Methods in Applied Mathematics, while the date of the publication is unknown, it is believed to be prior to Aug. 19, 2009, pp. 1-9.
Mensa-Wilmot, G. et al., "New PDC Bit Technology, Improved Drillability Analysis, and Operational Practices Improve Drilling Performance in Hard and Highly HeterogeneoApplications", a paper prepared for the 2004 SPE (Society of Petroleum Engineers) Eastern Regional Meeting, Sep. 2004, pp. 1-14.
Messica, A. et al., "Theory of Fiber-Optic Evanescent-Wave Spectroscopy and Sensor", *Applied Optics*, vol. 35, No. 13, May 1, 1996, pp. 2274-2284.
Mills, W. R. et al., "Pulsed Neutron Porosity Logging", SPWLA Twenty-Ninth Annual Logging Symposium, Jun. 1988, pp. 1-21.
Mirkovich, V. V., "Experimental Study Relating Thermal Conductivity to Thermal Piercing of Rocks", *Int. J. Rock Mech. Min. Sci.*, vol. 5, 1968, pp. 205-218.
Mittelstaedt, E. et al., "A Noninvasive Method for Measuring the Velocity of Diffuse Hydrothermal Flow by Tracking Moving Refractive Index Anomalies", *Geochemistry Geophysics Geosystems*, vol. 11, No. 10, Oct. 8, 2010, pp. 1-18.
Moavenzadeh, F. et al., "Thin Disk Technique for Analyzing Fock Fractures Induced by Laser Irradiation", a report prepared for the Department of Transportation under Contract C-85-65, May 1968, 91 pages.
Montross, C. S. et al., "Laser-Induced Shock Wave Generation and Shock Wave Enhancement in Basalt", *International Journal of Rock Mechanics and Mining Sciences*, 1999, pp. 849-855.
Morozumi, Y. et al., "Growth and Structures of Surface Disturbances of a Round Liquid Jet in a Coaxial Airflow", *Fluid Dynamics Research*, vol. 34, 2004, pp. 217-231.
Morse, J. W. et al., "Experimental and Analytic Studies to Model Reaction Kinetics and Mass Transport of Carbon Dioxide Sequestration in Depleted Carbonate Reservoirs", a Final Scientific/Technical Report for DOE, while the date of the publication is unknown, it is believed to be prior to Aug. 19, 2009, 158 pages.
Moshier, S. O., "Microporosity in Micritic Limestones: A Review", *Sedimentary Geology*, vol. 63, 1989, pp. 191-213.

(56) References Cited

OTHER PUBLICATIONS

Mostafa, M. S. et al., "Investigation of Thermal Properties of Some Basalt Samples in Egypt", *Journal of Thermal Analysis and Calorimetry*, vol. 75, 2004, pp. 178-188.
Mukhin, I. B. et al., "Experimental Study of Kilowatt-Average-Power Faraday Isolators", OSA/ASSP, 2007, 3 pages.
Multari, R. A. et al., "Effect of Sampling Geometry on Elemental Emissions in Laser-Induced Breakdown Spectroscopy", *Applied Spectroscopy*, vol. 50, No. 12, 1996, pp. 1483-1499.
Munro, R. G., "Effective Medium Theory of the Porosity Dependence of Bulk Moduli", *Communications of American Ceramic Society*, vol. 84, No. 5, 2001, pp. 1190-1192.
Murphy, H. D., "Thermal Stress Cracking and Enhancement of Heat Extraction from Fractured Geothermal Reservoirs", a paper submitted to the Geothermal Resource Council for its 1978 Annual Meeting, Jul. 1978, 7 pages.
Murrell, S. A. F. et al., "The Effect of Temperature on the Strength at High Confining Pressure of Granodiorite Containing Free and Chemically-Bound Water", *Mineralogy and Petrology*, vol. 55, 1976, pp. 317-330.
Myung, I. J., "Tutorial on Maximum Likelihood Estimation", *Journal of Mathematical Psychology*, vol. 47, 2003, pp. 90-100.
Nakano, A. et al., "Visualization for Heat and Mass Transport Phenomena in Supercritical Artificial Air", *Cryogenics*, vol. 45, 2005, pp. 557-565.
Nara, Y. et al., "Study of Subcritical Crack Growth in Andesite Using the Double Torsion Test", *International Journal of Rock Mechanics & Mining Sciences*, vol. 42, 2005, pp. 521-530.
Nicklaus, K. et al., "Optical Isolator for Unpolarized Laser Radiation at Multi-Kilowatt Average Power", *Optical Society of America*, 2005, 3 pages.
Nikles, M. et al., "Brillouin Gain Spectrum Characterization in Single-Mode Optical Fibers", *Journal of Lightwave Technology*, vol. 15, No. 10, Oct. 1997, pp. 1842-1851.
Nilsen, B. et al., "Recent Developments in Site Investigation and Testing for Hard Rock TBM Projects", *1999 RETC Proceedings*, 1999, pp. 715-731.
Nimick, F. B., "Empirical Relationships Between Porosity and the Mechanical Properties of Tuff", *Key Questions in Rock Mechanics*, Cundall et al. (eds), 1988, pp. 741-742.
Nolen-Hoeksema, R., "Fracture Development and Mechnical Stratigraphy of Austin Chalk, Texas: Discussion", a discussion for The American Association of Petroleum Geologists Bulletin, vol. 73, No. 6, Jun. 1989, pp. 792-793.
Oglesby, K. et al., "Advanced Ultra High Speed Motor for Drilling", a project update by Impact Technologies LLC for the Department of Energy, Sep. 12, 2005, 36 pages.
Olsen, F. O., "Fundamental Mechanisms of Cutting Front Formation in Laser Cutting", *SPIE*, vol. 2207, pp. 402-413.
Ouyang, L. B. et al., "General Single Phase Wellbore Flow Model", a report prepared for the COE/PETC, May 2, 1997, 51 pages.
Palchaev, D. K. et al., "Thermal Expansion of Silicon Carbide Materials", *Journal of Engineering Physics and Thermophysics*, vol. 66, No. 6, 1994, 3 pages.
Parker, R. et al., "Drilling Large Diameter Holes in Rocks Using Multiple Laser Beams (504)", while the date of the publication is unknown, it is believed to be prior to Aug. 19, 2009, 6 pages.
Patricio, M. et al., "Crack Propagation Analysis", while the date of the publication is unknown, it is believed to be prior to Aug. 19, 2009, 24 pages.
Pavlina, E. J. et al., "Correlation of Yield Strength and Tensile Strength with Hardness for Steels", *Journals of Materials Engineering and Performance*, vol. 17, No. 6, 2008, pp. 888-893.
Peebler, R. P. et al., "Formation Evaluation with Logs in the Deep Anadarko Basin", *SPE of AIME*, 1972, 15 pages.
Pepper, D. W. et al., "Benchmarking COMSOL Multiphysics 3.5a—CFD Problems", a presentation, Oct. 10, 2009, 54 pages.
Percussion Drilling Manual, by Smith Tools, 2002, 67 pgs.
Pettitt, R. et al., "Evolution of a Hybrid Roller Cone/PDC Core Bit", a paper prepared for Geothermal Resources Council 1980 Annual Meeting, Sep. 1980, 7 pages.
Phani, K. K. et al., "Pororsity Dependence of Ultrasonic Velocity and Elastic Modulin Sintered Uranium Dioxide—a discussion", *Journal of Materials Science Letters*, vol. 5, 1986, pp. 427-430.
Plumb, R. A. et al., "Influence of Composition and Texture on Compressive Strength Variations in the Travis Peak Formation", a paper prepared for presentation at the 67th Annual Technical Conference and Exhibition of the Society of Petroleum Engineers, Oct. 1992, pp. 985-998.
Pooniwala, Shahvir, "Lasers: The Next Bit", *Society of Petroleum Engineers*, No. SPE 104223, 2006, 10 pgs.
Porter, J. A. et al., "Cutting Thin Sheet Metal with a Water Jet Guided Laser Using VarioCutting Distances, Feed Speeds and Angles of Incidence", *Int. J. Adv. Manuf. Technol.*, vol. 33, 2007, pp. 961-967.
Potyondy, D. O., "Simulating Stress Corrosion with a Bonded-Particle Model for Rock", *International Journal of Rock Mechanics & Mining Sciences*, vol. 44, 2007, pp. 677-691.
Potyondy, D., "Internal Technical Memorandum—Molecular Dynamics with PFC", a Technical Memorandum to PFC Development Files and Itasca Website, *Molecular Dynamics with PFC*, Jan. 6, 2010, 35 pages.
Powell, M. et al., "Optimization of UHP Waterjet Cutting Head, The Orifice", Flow International, while the date of the publication is unknown, it is believed to be prior to Aug. 19, 2009, 19 pages.
Price, R. H. et al., "Analysis of the Elastic and Strength Properties of Yuccs Mountain tuff, Nevada", 26th Symposium on Rock Mechanics, Jun. 1985, pp. 89-96.
Quinn, R. D. et al., "A Method for Calculating Transient Surface Temperatures and Surface Heating Rates for High-Speed Aircraft", NASA, Dec. 2000, 35 pages.
Ramadan, K. et al., "On the Analysis of Short-Pulse Laser Heating of Metals Using the Dual Phase Lag Heat Conduction Model", *Journal of Heat Transfer*, vol. 131, Nov. 2009, pp. 111301-1 to 111301-7.
Rao, M. V. M. S. et al., "A Study of Progressive Failure of Rock Under Cyclic Loading by Ultrasonic and AE Monitoring Techniques", *Rock Mechanics and Rock Engineering*, vol. 25, No. 4, 1992, pp. 237-251.
Rauenzahn, R. M., "Analysis of Rock Mechanics and Gas Dynamics of Flame-Jet Thermal Spallation Drilling", a dissertation for the degree of Doctor of Philosophy at Massachusettes Institute of Technology, Sep. 1986, pp. 1-524.
Ravishankar, M. K., "Some Results on Search Complexity vs Accuracy", DARPA Spoken Systems Technology Workshop, Feb. 1997, 4 pages.
Ream, S. et al., "Zinc Sulfide Optics for High Power Laser Applications", Paper 1609, while the date of the publication is unknown, it is believed to be prior to Aug. 19, 2009, 7 pages.
Rice, J. R., "On the Stability of Dilatant Hardening for Saturated Rock Masses", *Journal of Geophysical Research*, vol. 80, No. 11, Apr. 10, 1975, pp. 1531-1536.
Richter, D. et al., "Thermal Expansion Behavior of IgneoRocks", *Int. J. Rock Mech. Min. Sci. & Geomech. Abstr.*, vol. 11, 1974, pp. 403-411.
Rietman, N. D. et al., "Comparative Economics of Deep Drilling in Anadarka Basin", a paper presented at the 1979 Society of Petroleum Engineers of AIME Deep Drilling and Production Symposium, Apr. 1979, 5 pages.
Rijken, P. et al., "Predicting Fracture Attributes in the Travis Peak Formation Using Quantitative Mechanical Modeling and Stractural Diagenesis", Gulf Coast Association of Geological Societies Transactions vol. 52, 2002, pp. 837-847.
Rijken, P. et al., "Role of Shale Thickness on Vertical Connectivity of Fractures: Application of Crack-Bridging Theory to the Austin Chalk, Texas", *Tectonophysics*, vol. 337 ,2001, pp. 117-133.
Rosler, M., "Generalized Hermite Polynomials and the Heat Equation for Dunkl Operators", a paper, while the date of the publication is unknown, it is believed to be prior to Aug. 19, 2009, pp. 1-24.
Rossmanith, H. P. et al., "Fracture Mechanics Applications to Drilling and Blasting", *Fatigue & Fracture Engineering Materials & Structures*, vol. 20, No. 11, 1997, pp. 1617-1636.

(56) References Cited

OTHER PUBLICATIONS

Rubin, A. M. et al., "Dynamic Tensile-Failure-Induced Velocity Deficits in Rock", *Geophysical Research Letters*, vol. 18, No. 2, Feb. 1991, pp. 219-222.
Sachpazis, C. I, M. Sc., Ph. D., "Correlating Schmidt Hardness With Compressive Strength and Young's ModulOf Carbonate Rocks", *International Association of Engineering Geology*, Bulletin, No. 42, 1990, pp. 75-83.
Salehi, I. A. et al., "Laser Drilling—Drilling with the Power Light", a final report a contract with DOE with award No. DE-FC26-00NT40917, May 2007, in parts 1-4 totaling 318 pages.
Sandler, I. S. et al., "An Algorithm and a Modular Subroutine for the Cap Model", *International Journal for Numerical and Analytical Methods in Geomechanics*, vol. 3, 1979, pp. 173-186.
Santarelli, F. J. et al., "Formation Evaluation From Logging on Cuttings", *SPE Reservoir Evaluation & Engineering*, Jun. 1998, pp. 238-244.
Sattler, A. R., "Core Analysis in a Low Permeability Sandstone Reservoir: Results from the Multiwell Experiment", a report by Sandia National Laboratories for The Department of Energy, Apr. 1989, 69 pages.
Scaggs, M. et al., "Thermal Lensing Compensation Objective for High Power Lasers", published by Haas Lasers Technologies, Inc., while the date of the publication is unknown, it is believed to be prior to Aug. 19, 2009, 7 pages.
Schaff, D. P. et al., "Waveform Cross-Correlation-Based Differential Travel-Time Measurements at the Northern California Seismic Network", *Bulletin of the Seismological Society of America*, vol. 95, No. 6, Dec. 2005, pp. 2446-2461.
Schaffer, C. B. et al., "Dynamics of Femtosecond Laser-Induced Breakdown in Water from Femtoseconds to Microseconds", *Optics Express*, vol. 10, No. 3, Feb. 11, 2002, pp. 196-203.
Scholz, C. H., "Microfracturing of Rock in Compression", a dissertation for the degree of Doctor of Philosophy at Massachusettes Instutute of Trechnology, Sep. 1967, 177 pages.
Schroeder, R. J. et al., "High Pressure and Temperature Sensing for the Oil Industry Using Fiber Bragg Gratings Written onto Side Hole Single Mode Fiber", publisher unknown, while the date of the publication is unknown, it is believed to be prior to Aug. 19, 2009, 4 pages.
Shiraki, K. et al., "SBS Threshold of a Fiber with a Brillouin Frequency Shift Distribution", *Journal of Lightwave Technology*, vol. 14, No. 1, Jan. 1996, pp. 50-57.
Simple Drilling Methods, WEDC Loughborough University, United Kingdom, 1995, 4 pgs.
Singh, T. N. et al., "Prediction of Thermal Conductivity of Rock Through Physico-Mechanical Properties", *Building and Environment*, vol. 42, 2007, pp. 146-155.
Sinha, D., "Cantilever Drilling—Ushering a New Genre of Drilling", a paper prepared for presentation at the SPE/IADC Middle East Drilling Technology Conference and Exhibition, Oct. 2003, 6 pages.
Sinor, A. et al., "Drag Bit Wear Model", *SPE Drilling Engineering*, Jun. 1989, pp. 128-136.
Smith, D., "Using Coupling Variables to Solve Compressible Flow, Multiphase Flow and Plasma Processing Problems", COMSOL Users Conference 2006, 38 pages.
Sneider, RM et al., "Rock Types, Depositional History, and Diangenetic Effects, Ivishak reservoir Prudhoe Bay Field", *SPE Reservoir Engineering*, Feb. 1997, pp. 23-30.
Soeder, D. J. et al., "Pore Geometry in High- and Low-Permeability Sandstones, Travis Peak Formation, East Texas", *SPE Formation Evaluation*, Dec. 1990, pp. 421-430.
Somerton, W. H. et al., "Thermal Expansion of Fluid Saturated Rocks Under Stress", SPWLA Twenty-Second Annual Logging Symposium, Jun. 1981, pp. 1-8.
Stowell, J. F. W., "Characterization of Opening-Mode Fracture Systems in the Austin Chalk", *Gulf Coast Association of Geological Societies Transactions*, vol. L1, 2001, pp. 313-320.
Straka, W. A. et al., "Cavitation Inception in Quiescent and Co-Flow Nozzle Jets", 9th International Conference on Hydrodynamics, Oct. 2010, pp. 813-819.
Suarez, M. C. et al., "COMSOL in a New Tensorial Formulation of Non-Isothermal Poroelasticity", publisher unknown, while the date of the publication is unknown, it is believed to be prior to Aug. 19, 2009,2 pages.
Summers, D. A., "Water Jet Cutting Related to Jet & Rock Properties", publisher unknown, while the date of the publication is unknown, it is believed to be prior to Aug. 19, 2009, 13 pages.
Suwarno, et al., "Dielectric Properties of Mixtures Between Mineral Oil and Natural Ester from Palm Oil", *WSEAS Transactions on Power Systems*, vol. 3, Issue 2, Feb. 2008, pp. 37-46.
Tang, C. A. et al., "Numerical Studies of the Influence of Microstructure on Rock Failure in Uniaxial Compression—Park I: Effect of Heterogeneity", *International Journal of Rock Mechanics and Mining Sciences*, vol. 37, 2000, pp. 555-569.
Tao, Q. et al., "A Chemo-Poro-Thermoelastic Model for Stress/Pore Pressure Analysis around a Wellbore in Shale", a paper prepared for presentation at the Symposium on Rock Mechanics (USRMS): *Rock Mechanics for Energy*, Mineral and Infrastracture Development in the Northern Regions, Jun. 2005, 7 pages.
Terra, O. et al., "Brillouin Amplification in Phase Coherent Transfer of Optical Frequencies over 480 km Fiber", publisher unknown, while the date of the publication is unknown, it is believed to be prior to Aug. 19, 2009, 9 pages.
Terzopoulos, D. et al., "Modeling Inelastic Deformation: Viscoelasticity, Plasticity, Fracture", *SIGGRAPH '88*, Aug. 1988, pp. 269-278.
Thomas, R. P., "Heat Flow Mapping at the Geysers Geothermal Field", published by the California Department of Conservation Division of Oil and Gas, 1986, 56 pages.
Thompson, G. D., "Effects of Formation Compressive Strength on Perforator Performance", a paper presented of the Southern District API Division of Production, Mar. 1962, pp. 191-197.
Tovo, R. et al., "Fatigue Damage Evaluation on Mechanical Components Under Multiaxial Loadings", excerpt from the Proceedings of the COMSOL Conference, 2009, 8 pages.
Tuler, F. R. et al., "A Criterion for the Time Dependence of Dynamic Fracture", *The International Jopurnal of Fracture Mechanics*, vol. 4, No. 4, Dec. 1968, pp. 431-437.
Turner, D. et al., "New DC Motor for Downhole Drilling and Pumping Applications", a paper prepared for presentation at the SPE/ICoTA Coiled Tubing Roundtable, Mar. 2001, pp. 1-7.
Turner, D. R. et al., "The All Electric BHA: Recent Developments Toward an Intelligent Coiled-Tubing Drilling System", a paper prepared for presentation at the 1999 SPE/ICoTA Coiled Tubing Roundtable, May 1999, pp. 1-10.
Tutuncu, A. N. et al., "An Experimental Investigation of Factors Influencing Compressional- and Shear-Wave Velocities and Attenuations in Tight Gas Sandstones", *Geophysics*, vol. 59, No. 1, Jan. 1994, pp. 77-86.
Udd, E. et al., "Fiber Optic Distributed Sensing Systems for Harsh Aerospace Environments", publisher unknown, while the date of the publication is unknown, it is believed to be prior to Aug. 19, 2009, 12 pages.
Valsangkar, A. J. et al., Stress-Strain Relationship for Empirical Equations of Creep in Rocks, *Engineering Geology*, Mar. 29, 1971, 5 pages.
Wagh, A. S. et al., "Dependence of Ceramic Fracture Properties on Porosity", *Journal of Material Sience*, vol. 28, 1993, pp. 3589-3593.
Wagner, F. et al., "The Laser Microjet Technology—10 Years of Development (M401)", publisher unknown, while the date of the publication is unknown, it is believed to be prior to Aug. 19, 2009, 9 pages.
Waldron, K. et al., "The Microstructures of Perthitic Alkali Feldspars Revealed by Hydroflouric Acid Etching", *Contributions to Mineralogy and Petrology*, vol. 116, 1994, pp. 360-364.
Walker, B. H. et al., "Roller-Bit Penetration Rate Response as a Function of Rock Properties and Well Depth", a paper prepared for presentation at the 61st Annual Technical Conference and Exhibition of the Society of Petroleum Engineers, Oct. 1986, 12 pages.

(56) References Cited

OTHER PUBLICATIONS

Wandera, C. et al., "Characterization of the Melt Removal Rate in Laser Cutting of Thick-Section Stainless Steel", *Journal of Laser Applications*, vol. 22, No. 2, May 2010, pp. 62-70.
Wandera, C. et al., "Inert Gas Cutting of Thick-Section Stainless Steel and Medium Section Aluminun Using a High Power Fiber Laser", *Journal of Chemical Physics*, vol. 116, No. 4, Jan. 22, 2002, pp. 154-161.
Wandera, C. et al., "Laser Power Requirement for Cutting of Thick-Section Steel and Effects of Processing Parameters on Mild Steel Cut Quality", a paper accepted for publication in the Proceedings IMechE Part B, *Journal of Engineering Manufactur*, vol. 225, 2011, 23 pages.
Wandera, C. et al., "Optimization of Parameters for Fiber Laser Cutting of 10mm Stainless Steel Plate", a paper for publication in the Proceeding IMechE Part B, *Journal of Engineering Manufacture*, vol. 225, 2011, 22 pages.
Wandera, C., "Performance of High Power Fibre Laser Cutting of Thick-Section Steel and Medium-Section Aluminium", a thesis for the degree of Doctor of Science (Technology) at , Lappeenranta University of Technology, Oct. 2010, 74 pages.
Wang, C. H., "Introduction to Fractures Mechanics", published by DSTO Aeronautical and Maritime Research Laboratory, Jul. 1996, 82 pages.
Wang, G. et al., "Particle Modeling Simulation of Thermal Effects on Ore Breakage", *Computational Materials Science*, vol. 43, 2008, pp. 892-901.
Waples, D. W. et al., "A Review and Evaluation of Specific Heat Capacities of Rocks, Minerals, and Subsurface Fluids. Part 1: Minerals and NonporoRocks", *Natural Resources Research*, vol. 13, No. 2, Jun. 2004, pp. 97-122.
Waples, D. W. et al., "A Review and Evaluation of Specific Heat Capacities of Rocks, Minerals, and Subsurface Fluids. Part 2: Fluids and PoroRocks", *Natural Resources Research*, vol. 13 No. 2, Jun. 2004, pp. 123-130.
Warren, T. M. et al., "Laboratory Drilling Performance of PDC Bits", *SPE Drilling Engineering*, Jun. 1988, pp. 125-135.
White, E. J. et al., "Reservoir Rock Characteristics of the Madison Limestone in the Williston Basin", *The Log Analyst*, Sep.-Oct. 1970, pp. 17-25.
White, E. J. et al., "Rock Matrix Properties of the Ratcliffe Interval (Madison Limestone) Flat Lake Field, Montana", *SPE of AIME*, Jun. 1968, 16 pages.
Wilkinson, M. A. et al., "Experimental Measurement of Surface Temperatures During Flame-Jet Induced Thermal Spallation", *Rock Mechanics and Rock Engineering*, 1993, pp. 29-62.
Winters, W. J. et al., "Roller Bit Model with Rock Ductility and Cone Offset", a paper prepared for presentation at 62nd Annual Technical Conference and Exhibition of the Society of Petroleum Engineers, Sep. 1987, 12 pages.
Wippich, M. et al., "Tunable Lasers and Fiber-Bragg-Grating Sensors", Obatined from the at: from the Internet website of the Industrial Physicist at: http://www.aip.org/tip/INPHFA/vol-9/iss-3/p24.html, on May 18, 2010, pp. 1-5.
Wu, X. Y. et al., "The Effects of Thermal Softening and Heat Conductin on the Dynamic Growth of Voids", *International Journal of Solids and Structures*, vol. 40, 2003, pp. 4461-4478.
Xiao, J. Q. et al., "Inverted S-Shaped Model for Nonlinear Fatigue Damage of Rock", *International Journal of Rock Mechanics & Mining Sciences*, vol. 46, 2009, pp. 643-648.
Xu, Z. et al., "Application of High Powered Lasers to Perforated Completions", *International Congress on Applications of Laser & Electro-Optics*, Oct. 2003, 6 pages.
Xu, Z. et al., "Laser Rock Drilling by a Super-Pulsed CO2 Laser Beam", a manuscript created for the Department of Energy, while the date of the publication is unknown, it is believed to be prior to Aug. 19, 2009, 9 pages.
Xu, Z. et al., "Modeling of Laser Spallation Drilling of Rocks for Gas-and Oilwell Drilling", a paper prepared for the presentation at the 2005 SPE (Society of Petroleum Engineers) Annual Technical Conference and Exhibition, Oct. 2005, 6 pages.
Xu, Z. et al., "Rock Perforation by Pulsed Nd: YAG Laser", Proceedings of the 23rd International Congress on Applications of Lasers and Electro-Optics 2004, 2004, 5 pages.
Yabe, T. et al., "The Constrained Interpolation Profile Method for Multiphase Analysis", *Journal of Computational Physics*, vol. 169, 2001, pp. 556-593.
Yamamoto, K. Y. et al., "Detection of Metals in the Environment Using a Portable Laser-Induced Breakdown Spectroscopy Instrument", *Applied Spectroscopy*, vol. 50, No. 2, 1996, pp. 222-233.
Yamashita, Y. et al., "Underwater Laser Welding by 4kW CW YAG Laser", *Journal of Nuclear Science and Technology*, vol. 38, No. 10, Oct. 2001, pp. 891-895.
Yasar, E. et al., "Determination of the Thermal Conductivity from Physico-Mechanical Properties", *Bull Eng. Geol. Environ*., vol. 67, 2008, pp. 219-225.
York, J. L. et al., "The Influence of Flashing and Cavitation on Spray Formation", a progress report for UMRI Project 2815 with Delavan Manufacturing Company, Oct. 1959, 27 pages.
Zamora, M. et al., "An Empirical Relationship Between Thermal Conductivity and Elastic Wave Velocities in Sandstone", *Geophysical Research Letters*, vol. 20, No. 16, Aug. 20, 1993, pp. 1679-1682.
Zehnder, A. T., "Lecture Notes on Fracture Mechanics", 2007, 227 pages.
Zeng, Z. W. et al., "Experimental Determination of Geomechanical and Petrophysical Properties of Jackfork Sandstone—A Tight Gas Formation", a paper prepared for the presentation at the 6th North American Rock Mechanics Symposium (NARMS): *Rock Mechanics Across Borders and Disciplines*, Jun. 2004, 9 pages.
Zeuch, D. H. et al., "Rock Breakage Mechanisms With a PDC Cutter", a paper prepared for presentation at the 60th Annual Technical Conference and Exhibition of the Society of Petroleum Engineers, Sep. 1985, 12 pages.
Zhang, L. et al., "Energy from Abandoned Oil and Gas Reservoirs", a paper prepared for presentation at the 2008 SPE (Society of Petroleum Engineers) Asia Pacific Oil & Gas Conference and Exhibition, 2008, pp. 1-10.
Zheleznov, D. S. et al., "Faraday Rotators With Short Magneto-Optical Elements for 50-kW Laser Power", *IEEE Journal of Quantum Electronics*, vol. 43, No. 6, Jun. 2007, pp. 451-457.
Zhou, T. et al., "Analysis of Stimulated Brillouin Scattering in Multi-Mode Fiber by Numerical Solution", *Journal of Zhejiang University of Science*, vol. 4 No. 3, May-Jun. 2003, pp. 254-257.
Zhu, X. et al., "High-Power ZBLAN Glass Fiber Lasers: Review and Prospect", *Advances in OptoElectronics*, vol. 2010, pp. 1-23.
Zietz, J. et al., "Determinants of House Prices: A Quantile Regression Approach", *Department of Economics and Finance Working Paper Series*, May 2007, 27 pages.
Zuckerman, N. et al., "Jet Impingement Heat Transfer: Physics, Correlations, and Numerical Modeling", *Advances in Heat Transfer*, vol. 39, 2006, pp. 565-631.
"Chapter I—Laser-Assisted Rock-Cutting Tests", publisher unknown, while the date of the publication is unknown, it is believed to be prior to Aug. 19, 2009, 64 pages.
"Chapter 7: Energy Conversion Systems—Options and Issues", publisher unknown, while the date of the publication is unknown, it is believed to be prior to Aug. 19, 2009, pp. 7-1 to 7-32 and table of contents page.
"Cross Process Innovations", Obtained from the Internat at: http://www.mrl.columbia.edu/ntm/CrossProcess/CrossProcessSect5.htm, on Feb. 2, 2010, 11 pages.
"Fourier Series, Generalized Functions, Laplace Transform", publisher unknown, while the date of the publication is unknown, it is believed to be prior to Aug. 19, 2009, 6 pages.
"Introduction to Optical Liquids", published by Cargille-Sacher Laboratories Inc., Obtained from the Internet at: http://www.cargille.com/opticalintro.shtml, on Dec. 23, 2008, 5 pages.
"Laser Drilling", Oil & Natural Gas Projects (Exploration & Production Technologies) Technical Paper, Dept. of Energy, Jul. 2007, 3 pages.
"Leaders in Industry Luncheon", IPAA & TIPRO, Jul. 8, 2009, 19 pages.

(56) References Cited

OTHER PUBLICATIONS

"Measurement and Control of Abrasive Water-Jet Velocity", publisher unknown, while the date of the publication is unknown, it is believed to be prior to Aug. 19, 2009, 8 pages.
"NonhomogeneoPDE—Heat Equation with a Forcing Term", a lecture, 2010, 6 pages.
"Performance Indicators for Geothermal Power Plants", prepared by International Geothermal Association for World Energy Council Working Group on Performance of Renewable Energy Plants, author unknown, Mar. 2011, 7 pages.
"Rock Mechanics and Rock Engineering", publisher unknown, while the date of the publication is unknown, it is believed to be prior to Aug. 19, 2009, 69 pages.
"Shock Tube", Cosmol MultiPhysics 3.5a, 2008, 5 pages.
"Silicone Fluids: Stable, Inert Media", Gelest, Inc., while the date of the publication is unknown, it is believed to be prior to Aug. 19, 2009, 27 pages.
"Stimulated Brillouin Scattering (SBS) in Optical Fibers", Centro de Pesquisa em Optica e Fotonica, Obtained from the Internet at: http://cepof.ifi.unicamp.br/index.php...), on Jun. 25, 2012, 2 pages.
"Underwater Laser Cutting", TWI Ltd, May/Jun. 2011, 2 pages.
Utility U.S. Appl. No. 13/768,149, filed Feb. 15, 2013, 27 pages.
Utility U.S. Appl. No. 13/777,650, filed Feb. 26, 2013, 73 pages.
Utility U.S. Appl. No. 13/782,869, filed Mar. 1, 2013, 80 pages.
Utility U.S. Appl. No. 13/782,942, filed Mar. 1, 2013, 81 pages.
Utility U.S. Appl. No. 13/800,559, filed Mar. 13, 2013, 73 pages.
Utility U.S. Appl. No. 13/800,820, filed Mar. 13, 2013, 73 pages.
Utility U.S. Appl. No. 13/800,879, filed Mar. 13, 2013, 73 pages.
Utility U.S. Appl. No. 13/800,933, filed Mar. 13, 2013, 73 pages.
Utility U.S. Appl. No. 13/849,831, filed Mar. 25, 2013, 83 pages.
Utility U.S. Appl. No. 13/852,719, filed Mar. 28, 2013, 85 pages.
U.S. Appl. No. 12/840,978, filed Jul. 21, 2009, 61 pgs.
International Search Report for PCT Application No. PCT/US09/54295, dated Apr. 26, 2010, 16 pgs.
International Search Report and Written Opinion for PCT App. No. PCT/US10/24368, dated Nov. 2, 2010, 16 pgs.
Agrawal Dinesh et al., Report on "Development of Advanced Drill Components for BHA Using Mircowave Technology Incorporating Carbide Diamond Composites and Functionally Graded Materials", Microwave Processing and Engineering Center, Material Research Institute, The Pennsylvania State University, 2003, 10 pgs.
Agrawal Dinesh et al., Report on "Graded Steele-Tungsten Cardide/Cobalt-Diamond Systems Using Microwave Heating", Material Research Institute, Penn State University, *Proceedings of the 2002 International Conference on Functionally Graded Materials*, 2002, pp. 50-58.
Agrawal Dinesh et al., "Microstructural by TEM of WC/Co composites Prepared by Conventional and Microwave Processes", Materials Research Lab, The Pennsylvania State University, *15th International Plansee Seminar*, vol. 2,, 2001, pp. 677-684.
Agrawal, Govind P., "Nonlinear Fiber Optics", Chap. 9, Fourth Edition, Academic Press copyright 2007, pp. 334-337.
Ai, H.A. et al., "Simulation of dynamic response of granite: A numerical approach of shock-induced damage beneath impact craters", *International Journal of Impact Engineering*, vol. 33, 2006, pp. 1-10.
Anton, Richard J. et al., "Dynamic Vickers indentation of brittle materials", *Wear*, vol. 239, 2000, pp. 27-35.
Ashby, M. F. et al., "The Failure of Brittle Solids Containing Small Cracks Under Compressive Stress States", *Acta Metall.*, vol. 34, No. 3,1986, pp. 497-510.
Aydin, A. et al., "The Schmidt hammer in rock material characterization", *Engineering Geology*, vol. 81, 2005, pp. 1-14.
Baflon, Jean-Paul et al., "On The Relationship Between The Parameters of Paris' Law for Fatigue Crack Growth in Aluminium Alloys", *Scripta Metallurgica*, vol. 11, No. 12, 1977, pp. 1101-1106.
Bailo, El Tahir et al., "Spectral signatures and optic coefficients of surface and reservoir shales and limestones at COIL, $CO_2$ and Nd:YAG laser wavelengths", *Petroleum Engineering Department, Colorado School of Mines*, 2004, 13 pgs.
Baird, J. A. "GEODYN: A Geological Formation/Drillstring Dynamics Computer Program", *Society of Petroleum Engineers of AIME*, 1964, 9 pgs.
Baird, Jerold et al., Phase 1 Theoretical Description, A Geological Formation Drill String Dynamic Interaction Finite Element Program (GEODYN), *Sandia National Laboratories*, Report No. Sand-84-7101, 1984, 196 pgs.
Batarseh, S. et al. "Well Perforation Using High-Power Lasers", *Society of Petroleum Engineers*, SPE 84418, 2003, pp. 1-10.
BDM Corporation, Geothermal Completion Technology Life-Cycle Cost Model (GEOCOM), *Sandia National Laboratories*, for the U.S. Dept. of Energy, vols. 1 and 2, 1982, 222 pgs.
Beste, U. et al., "Micro-scratch evaluation of rock types—a means to comprehend rock drill wear", *Tribology International*, vol. 37, 2004, pp. 203-210.
Blackwell, B. F., "Temperature Profile in Semi-infinite Body With Exponential Source and Convective Boundary Condition", *Journal of Heat Transfer, Transactions of the ASME*, vol. 112, 1990, pp. 567-571.
Browning, J. A. et al., "Recent Advances In Flame Jet Working of Minerals", *7th Symposium on Rock Mechanics*, Pennsylvania State Univ., 1965, pp. 281-313.
Cardenas, R., "Protected Polycrystalline Diamond Compact Bits for Hard Rock Drilling", Report No. DOE-99049-1381, *U.S. Department of Energy*, 2000, pp. 1-79.
Carstens, Jeffrey et al., "Heat-Assisted Tunnel Boring Machines", *Federal Railroad Administration and Urban Mass Transportation Administration*, U.S. Dept. of Transportation, Report No. FRA-RT-71-63, 1970, 340 pgs.
Clegg, John et al., "Improved Optimisation of Bit Selection Using Mathematically Modelled Bit-Performance Indices", *IADC/SPE International 102287*, 2006, pp. 1-10.
Close, F. et al., "Successful Drilling of Basalt in a West of Shetland Deepwater Discovery", *SPE International 96575*, Society of Petroleum Engineers, 2006, pp. 1-10.
Cobern, Martin E., "Downhole Vibration Monitoring & Control System Quarterly Technical Report #1", *APS Technology, Inc.*, Quarterly Technical Report #1, DVMCS, 2003, pp. 1-15.
Cogotsi, G. A. et al., "Use of Nondestructive Testing Methods in Evaluation of Thermal Damage for Ceramics Under Conditions of Nonstationary Thermal Effects", *Institute of Strength Problems, Academy of Sciences of the Ukrainian SSR*, 1985, pp. 52-56.
Cook, Troy, "Chapter 23, Calculation of Estimated Ultimate Recovery (EUR) for Wells in Continuous-Type Oil and Gas Accumulations", *U.S. Geological Survey Digital Data Series DDS-69-D*, Denver, Colorado: Version 1, 2005, pp. 1-9.
Dahl, Filip et al., "Development of a new direct test method for estimating cutter life, based on the Sievers J miniature drill test", *Tunnelling and Underground Space Technology*, vol. 22, 2007, pp. 106-116.
Damzen, M. J. et al., "Stimulated Brillion Scattering", Chapter 8—SBS in Optical Fibres, OP Publishing Ltd, Published by Institute of Physics, London, England, 2003, pp. 137-153.
Das, A. C. et al., "Acousto-ultrasonic study of thermal shock damage in castable refractory", *Journal of Materials Science Letters*, vol. 10, 1991, pp. 173-175.
De Guire, Mark R., "Thermal Expansion Coefficient (start)", *EMSE 201—Introduction to Materials Science & Engineering*, 2003, pp. 15.1-15.15.
Dinçer, Ismail et al., "Correlation between Schmidt hardness, uniaxial compressive strength and Young's modulus for andesites, basalts and tuffs", *Bull Eng Geol Env*, vol. 63, 2004, pp. 141-148.
Dunn, James C., "Geothermal Technology Development at Sandia", *Geothermal Research Division, Sandia National Laboratories*, 1987, pp. 1-6.
Eichler, H.J. et al., "Stimulated Brillouin Scattering in Multimode Fibers for Optical Phase Conjugation", *Optics Communications*, vol. 208, 2002, pp. 427-431.
Elsayed, M.A. et al., "Measurement and analysis of Chatter in a Compliant Model of a Drillstring Equipped With a PDC Bit", *Mechanical Engineering Dept., University of Southwestern Louisiana and Sandia National Laboratories*, 2000, pp. 1-10.

(56) References Cited

OTHER PUBLICATIONS

Ferro, D. et al., "Vickers and Knoop hardness of electron beam deposited ZrC and HfC thin films on titanium", *Surface & Coatings Technology*, vol. 200, 2006, pp. 4701-4707.
Figueroa, H. et al., "Rock removal using high power lasers for petroleum exploitation purposes", *Gas Technology Institute, Colorado School of Mines, Halliburton Energy Services, Argonne National Laboratory*, 2002, pp. 1-13.
Finger, John T. et al., "PDC Bit Research at Sandia National Laboratories", Sandia Report, *Geothermal Research Division 6252, Sandia National Laboratories*, SAND89-0079-UC-253, 1989, pp. 1-88.
Gahan, Brian C. et al. "Analysis of Efficient High-Power Fiber Lasers for Well Perforation", *Society of Petroleum Engineers*, SPE 90661, 2004, pp. 1-9.
Gahan, Brian C. et al. "Efficient of Downhole Pressure Conditions on High-Power Laser Perforation", *Society of Petroleum Engineers*, SPE 97093, 2005, pp. 1-7.
Gahan, B. C. et al., "Laser Drilling: Determination of Energy Required to Remove Rock", *Society of Petroleum Engineers* International, SPE 71466, 2001, pp. 1-11.
Gahan, Brian C. et al., "Laser Drilling: Drilling with the Power of Light, Phase 1: Feasibility Study", *Topical Report*, Cooperative Agreement No. DE-FC26-00NT40917, 2000-2001, pp. 1-148.
Glowka, David A., "Design Considerations for a Hard-Rock PDC Drill Bit", *Geothermal Technology Development Division 6241, Sandia National Laboratories*, SAND-85-0666C, DE85 008313, 1985, pp. 1-23.
Glowka, David A., "Development of a Method for Predicting the Performance and Wear of PDC Drill Bits", *Sandia National Laboratories*, SAND86-1745-UC-66c, 1987, pp. 1-206.
Glowka, David A. et al., "Program Plan for the Development of Advanced Synthetic-Diamond Drill Bits for Hard-Rock Drilling", *Sandia National Laboratories*, SAND 93-1953, 1993, pp. 1-50.
Glowka, David A. et al., "Progress in the Advanced Synthetic-Diamond Drill Bit Program", *Sandia National Laboratories*, SAND95-2617C, 1994, pp. 1-9.
Glowka, David A., "The Use of Single—Cutter Data in the Analysis of PDC Bit Designs", *61st Annual Technical Conference and Exhibition of Society of Petroleum Engineers*, 1986, pp. 1-37.
Graves, Ramona M. et al., "Application of High Power Laser Technology to Laser/Rock Destruction: Where Have We Been? Where Are We Now?", *SW AAPG Convention*, 2002, pp. 213-224.
Graves, Ramona M. et al., "Laser Parameters That Effect Laser-Rock Interaction: Determining the Benefits of Applying Star Wars Laser Technology for Drilling and Completing Oil and Natural Gas Wells", Topical Report, *Petroleum Engineering Department, Colorado School of Mines*, 2001, pp. 1-157.
Habib, P. et al., "The Influence of Residual Stresses on Rock Hardness", *Rock Mechanics*, vol. 6, 1974, pp. 15-24.
Hall, Kevin, "The role of thermal stress fatigue in the breakdown of rock in cold regions", *Geomorphology*, vol. 31, 1999, pp. 47-63.
Han, Wei, "Computational and experimental investigations of laser drilling and welding for microelectronic packaging", *Dorchester Polytechnic Institute*, A Dissertation submitted in May 2004, 242 pgs.
Hareland, G. et al., "Cutting Efficiency of a Single PDC Cutter on Hard Rock", *Journal of Canadian Petroleum Technology*, vol. 48, No. 6, 2009, pp. 1-6.
Healy, Thomas E., "Fatigue Crack Growth in Lithium Hydride", *Lawrence Livermore National Laboratory*, 1993, pp. 1-32.
Hettema, M. H. H. et al., "The Influence of Steam Pressure on Thermal Spalling of Sedimentary Rock: Theory and Experiments", *Int. J. Rock Mech. Min. Sci.*, vol. 35, No. 1, 1998, pp. 3-15.
Hibbs, Louis E. et al., "Wear Machanisms for Polycrystalline-Diamond Compacts as Utilized fro Drilling in Geothermal Environments", *Sandia National Laboratories*, for The United States Government, Report No. SAND-82/7213, 1983, 287 pgs.
Hoek, E., "Fracture of Anisotropic Rock", *Journal of the South African Institute of Mining and Metallurgy*, vol. 64, No. 10, 1964, pp. 501-523.
Hoover, Ed R. et al., "Failure Mechanisms of Polycrystalline-Diamond Compact Drill Bits in Geothermal Environments", Sandia Report, *Sandia National Laboratories*, SAND81-1404, 1981, pp. 1-35.
Huff, C. F. et al., "Recent Developments in Polycrystalline Diamond-Drill-Bit Design", *Drilling Technology Division—4741, Sandia National Laboratories*, 1980, pp. 1-29.
Jimeno, Carlos Lopez et al., Drilling and Blasting of Rocks, a. a. Balkema Publishers, 1995, 30 pgs.
Kahraman, S. et al., "Dominant rock properties affecting the penetration rate of percussive drills", *International Journal of Rock Mechanics and Mining Sciences*, 2003, vol. 40, pp. 711-723.
Kelsey, James R., "Drilling Technology/GDO", *Sandia National Laboratories*, SAND-85-1866c, DE85 017231, 1985, pp. 1-7.
Kerr, Callin Joe, "PDC Drill Bit Design and Field Application Evolution",*Journal of Petroleum Technology*, 1988, pp. 327-332.
Ketata, C. et al., "Knowledge Selection for Laser Drilling in the Oil and Gas Industry", *Computer Society*, 2005, pp. 1-6.
Khan, Ovais U. et al., "Laser heating of sheet metal and thermal stress development", *Journal of Materials Processing Technology*, vol. 155-156, 2004, pp. 2045-2050.
Kim, K. R. et al., "$CO_2$ laser-plume interaction in materials processing", *Journal of Applied Physics*, vol. 89, No. 1, 2001, pp. 681-688.
Klotz, K. et al., "Coatings with intrinsic stress profile: Refined creep analysis of (Ti,A1)N and cracking due to cyclic laser heating", *Thin Solid Films*, vol. 496, 2006, pp. 469-474.
Kobayashi, Toshio et al., "Drilling a 2-inch in Diameter Hole in Granites Submerged in Water by $CO_2$ Lasers", *SPE International, IADC 119914 Drilling Conference and Exhibition*, 2009, pp. 1-11.
Kubacki, Emily et al., "Optics for Fiber Laser Applications", *CVI Laser, LLC*, Technical Reference Document #20050415, 2005, 5 pgs.
Kujawski, Daniel, "A fatigue crack driving force parameter with load ratio effects", *International Journal of Fatigue*, vol. 23, 2001, pp. S239-S246.
Labuz, J. F. et al., "Microrack-dependent fracture of damaged rock", *International Journal of Fracture*, vol. 51, 1991, pp. 231-240.
Lacy, Lewis L., "Dynamic Rock Mechanics Testing for Optimized Fracture Designs", *Society of Petroleum Engineers International, Annual Technical Conference and Exhibition*, 1997, pp. 23-36.
Lally, Evan M., "A Narrow-Linewidth Laser at 1550 nm Using the Pound-Drever-Hall Stabilization Technique", *Thesis*, submitted to Virginia Polytechnic Institute and State University, Blacksburg, Virginia, 2006, 92 pgs.
Lau, John H., "Thermal Fatigue Life Prediction of Flip Chip Solder Joints by Fracture Mechanics Method", *Engineering Fracture Mechanics*, vol. 45, No. 5, 1993, pp. 643-654.
Leong, K. H. et al., "Lasers and Beam Delivery for Rock Drilling", *Argonne National Laboratory*, ANL/TD/TM03-01, 2003, pp. 1-35.
Leung, M. et al., "Theoretical study of heat transfer with moving phase-change interface in thawing of frozen food", *Journal of Physics D: Applied Physics*, vol. 38, 2005, pp. 477-482.
Lima, R. S. et al., "Elastic Modulus Measurements via Laser-Ultrasonic and Knoop Indentation Techniques in Thermally Sprayed Coatings", *Journal of Thermal Spray Technology*, vol. 14(1), 2005, pp. 52-60.
Lin, Y. T., "The Impact of Bit Performance on Geothermal-Well Cost", *Sandia National Laboratories*, SAND-81-1470C, 1981, pp. 1-6.
Lomov, I. N. et al., "Explosion in the Granite Field: Hardening and Softening Behavior in Rocks", *U.S. Department of Energy, Lawrence Livermore National Laboratory*, 2001, pp. 1-7.
Long, S. G. et al., "Thermal fatigue of particle reinforced metal-matrix composite induced by laser heating and mechanical load", *Composites Science and Technology*, vol. 65, 2005, pp. 1391-1400.
Lyons, K. David et al., "NETL Extreme Drilling Laboratory Studies High Pressure High Temperature Drilling Phenomena", *U.S. Department of Energy, National Energy Technology Laboratory*, 2007, pp. 1-6.
McElhenny, John E. et al., "Unique Characteristic Features of Stimulated Brillouin Scattering in Small-Core Photonic Crystal Fibers", *J. Opt. Soc. Am. B*, vol. 25, No. 4, 2008, pp. 582-593.

(56) References Cited

OTHER PUBLICATIONS

Marshall, David B. et al., "Indentation of Brittle Materials", *Microindentation Techniques in Materials Science and Engineering, ASTM STP 889; American Society for Testing and Materials*, 1986, pp. 26-46.
Maurer, William C., "Advanced Drilling Techniques", published by Petroleum Publishing Co., copyright 1980, 26 pgs.
Maurer, William C., "Novel Drilling Techniques", published by Pergamon Press, UK, copyright 1968, pp. 1-64.
Mazerov, Katie, "Bigger coil sizes, hybrid rigs, rotary steerable advances push coiled tubing drilling to next level", *Drilling Contractor*, 2008, pp. 54-60.
Medvedev, I. F. et al., "Optimum Force Characteristics of Rotary-Percussive Machines for Drilling Blast Holes", Moscow, Translated from *Fiziko-Tekhnicheskie Problemy Razrabotki Poleznykh Iskopaemykh*, No. 1, 1967, pp. 77-80.
Mensa-Wilmot, Graham et al., "Advanced Cutting Structure Improves PDC Bit Performance in Hard and Abrasive Drilling Environments", *Society of Petroleum Engineers International*, 2003, pp. 1-13.
Messaoud, Louafi, "Influence of Fluids on the Essential Parameters of Rotary Percussive Drilling", *Laboratoire d'Environnement (Tébessa)*, vol. 14, 2009, pp. 1-8.
Mocofanescu, A. et al., "SBS threshold for single mode and multimode GRIN fibers in an all fiber configuration", *Optics Express*, vol. 13, No. 6, 2005, pp. 2019-2024.
Moradian, Z. A. et al., "Predicting the Uniaxial Compressive Strength and Static Young's Modulus of Intact Sedimentary Rocks Using the Ultrasonic Test", *International Journal of Geomechanics*, vol. 9, No. 1, 2009, pp. 14-19.
Muto, Shigeki et al., "Laser cutting for thick concrete by multi-pass technique", *Chinese Optics Letters*, vol. 5 Supplement, 2007, pp. S39-S41.
Naqavi, I. Z. et al., "Laser heating of multilayer assembly and stress levels: elasto-plastic consideration", *Heat and Mass Transfer*, vol. 40, 2003, pp. 25-32.
Nara, Y. et al., "Sub-critical crack growth in anisotropic rock", *International Journal of Rock Mechanics and Mining Sciences*, vol. 43, 2006, pp. 437-453.
Nemat-Nasser, S. et al., "Compression-Induced Nonplanar Crack Extension With Application to Splitting, Exfoliation, and Rockburst", *Journal of Geophysical Research*, vol. 87, No. B8, 1982, pp. 6805-6821.
O'Hare, Jim et al., "Design Index: A Systematic Method of PDC Drill-Bit Selection", *Society of Petroleum Engineers International*, IADC/SPE Drilling Conference, 2000, pp. 1-15.
Okon, P. et al., "Laser Welding of Aluminium Alloy 5083", *21st International Congress on Applications of Lasers and Electro-Optics*, 2002, pp. 1-9.
Ortega, Alfonso et al., "Frictional Heating and Convective Cooling of Polycrystalline Diamond Drag Tools During Rock Cutting", Report No. SAND 82-0675c, *Sandia National Laboratories*, 1982, 23 pgs.
Ortega, Alfonso et al., "Studies of the Frictional Heating of Polycrystalline Diamond Compact Drag Tools During Rock Cutting", *Sandia National Laboratories*, SAND-80-2677, 1982, pp. 1-151.
Ortiz, Blas et al., Improved Bit Stability Reduces Downhole Harmonics (Vibrations), *International Association of Drilling Contractors/Society of Petroleum Engineers Inc.*, 1996, pp. 379-389.
Palashchenko, Yuri A., "Pure Rolling of Bit Cones Doubles Performance", *I & Gas Journal*, vol. 106, 2008, 8 pgs.
Pardoen, T. et al., "An extended model for void growth and Coalescence", *Journal of the Mechanics and Physics of Solids*, vol. 48, 2000, pp. 2467-2512.
Park, Un-Chul et al., "Thermal Analysis of Laser Drilling Processes", *IEEE Journal of Quantum Electronics*, 1972, vol. QK-8, No. 2, 1972, pp. 112-119.
Parker, Richard A. et al., "Laser Drilling Effects of Beam Application Methods on Improving Rock Removal", *Society of Petroleum Engineers*, SPE 84353, 2003, pp. 1-7.
Ping, Cao et al., "Testing study of subcritical crack growth rate and fracture toughness in different rocks", *Transactions of Nonferrous Metals Society of China*, vol. 16, 2006, pp. 709-714.
Plinninger, Ralf J. et al., "Predicting Tool Wear in Drill and Blast", *Tunnels & Tunneling International Magazine*, 2002, pp. 1-5.
Plinninger, Dr. Ralf J. et al., "Wear Prediction in Hardrock Excavation Using the CERCHAR Abrasiveness Index (CAI)", *EUROCK 2004 & 53rd Geomechanics Colloquium. Schubert (ed.)*, VGE, 2004, pp. 1-6.
Polsky, Yarom et al., "Enhanced Geothermal Systems (EGS) Well Construction Technology Evaluation Report", *Sandia National Laboratories*, Sandia Report, SAND2008-7866, 2008, pp. 1-108.
Potyondy, D. O. et al., "A Bonded-particle model for rock", *International Journal of Rock Mechanics and Mining Sciences*, vol. 41, 2004, pp. 1329-1364.
Qixian, Luo et al., "Using compression wave ultrasonic transducers to measure the velocity of surface waves and hence determine dynamic modulus of elasticity for concrete", *Construction and Building Materials*vol. 10, No. 4, 1996, pp. 237-242.
Radkte, Robert, "New High Strength and faster Drilling TSP Diamond Cutters", Report by *Technology International, Inc.*, DOE Award No. DE-FC26-97FT34368, 2006, 97 pgs.
Rauenzahn, R. M., "Analysis of Rock Mechanics and Gas Dynamics of Flame-Jet Thermal Spallation Drilling", *Massachusetts Institute of Technology*, submitted in partial fulfillment of doctorate degree, 1986 583 pgs.
Rauenzahn, R. M. et al., "Rock Failure Mechanisms of Flame-Jet Thermal Spallation Drilling—Theory and Experimental Testing", *Int. J. Rock Merch. Min. Sci. & Geomech. Abstr.*, vol. 26, No. 5, 1989, pp. 381-399.
Raymond, David W., "PDC Bit Testing At Sandia Reveals Influence of Chatter in Hard-Rock Drilling", *Geothermal Resources Council Monthly Bulletin*, SAND99-2655J, 1999, 7 pgs.
Rossmanith, H. P. et al., "Wave Propagation, Damage Evolution, and Dynamic Fracture Extension. Part I. Percussion Drilling", *Materials Science*, vol. 32, No. 3, 1996, pp. 350-358.
Sachpazis, C. I, M. Sc., Ph. D., "Correlating Schmidt Hardness With Compressive Strength and Young's Modulus of Carbonate Rocks", *International Association of Engineering Geology, Bulletin*, No. 42, 1990, pp. 75-83.
Sano, Osam et al., "Acoustic Emission During Slow Crack Growth", *Department Mining and Mineral Engineering, NII-Electronic Library Service*, 1980, pp. 381-388.
Schormair, Nik et al., "The influence of anisotropy on hard rock drilling and cutting", *The Geological Society of London, IAEG*, Paper No. 491, 2006, pp. 1-11.
Shannon, G. J. et al., "High power laser welding in hyperbaric gas and water environments", *Journal of Laser Applications*, vol. 9, 1997, pp. 129-136.
Shuja, S. Z. et al., "Laser heating of semi-infinite solid with consecutive pulses: Influence of materaial properties on temperature field", *Optics & Laser Technology*, vol. 40, 2008, pp. 472-480.
Smith, E., "Crack Propagation at a Constant Crack Tip Stress Intensity Factor", *Int. Journal of Fracture*, vol. 16, 1980, pp. R215-R218.
Solomon, A. D. et al., "Moving Boundary Problems in Phase Change Models Current Research Questions", *Engineering Physics and Mathematics Division*, ACM Signum Newsletter, vol. 20, Issue 2, 1985, pp. 8-12.
Sousa, Luis M. O. et al., "Influence of microfractures and porosity on the physico-mechanical properties and weathering of ornamental granites", *Engineering Geology*, vol. 77, 2005, pp. 153-168.
Takarli, Mokhfi et al., "Damage in granite under heating/cooling cycles and water freeze-thaw condition", *International Journal of Rock Mechanics and Mining Sciences*, vol. 45, 2008, pp. 1164-1175.
Tanaka, K. et al., "The Generalized Relationship Between The Parameters *C* and *m* of Paris' Law for Fatigue Crack Growth",*Scripta Metallurgica*, vol. 15, No. 3, 1981, pp. 259-264.
Tang, C. A. et al., "Coupled analysis of flow, stress and damage (FSD) in rock failure", *International Journal of Rock Mechanics and Mining Sciences*, vol. 39, 2002, pp. 477-489.
Thorsteinsson, Hildigunnur et al., "The Impacts of Drilling and Reservoir Technology Advances on EGS Exploitation", *Proceedings,*

(56) References Cited

OTHER PUBLICATIONS

*Thirty-Third Workshop on Geothermal Reservoir Engineering, Institute for Sustainable Energy, Environment, and Economy* (*ISEEE*), 2008, pp. 1-14.
U.S. Dept of Energy, "Chapter 6—Drilling Technology and Costs", from Report for the Future of Geothermal Energy, 2005, 53 pgs.
Varnado, S. G. et al., "The Design and Use of Polycrystalline Diamond Compact Drag Bits in the Geothermal Environment", *Society of Petroleum Engineers of AIME*, SPE 8378, 1979, pp. 1-11.
Wen-gui, Cao et al., "Damage constituitive model for strain-softening rock based on normal distribution and its parameter determination", *J. Cent. South Univ. Technol*., vol. 14, No. 5, 2007, pp. 719-724.
Wiercigroch, M., "Dynamics of ultrasonic percussive drilling of hard rocks", *Journal of Sound and Vibration*, vol. 280, 2005, pp. 739-757.
Williams, R. E. et al., "Experiments in Thermal Spallation of Various Rocks", *Transactions of the ASME*, vol. 118, 1996, pp. 2-8.
Willis, David A. et al., "Heat transfer and phase change during picosecond laser ablation of nickel", *International Journal of Heat and Mass Transfer*, vol. 45, 2002, pp. 3911-3918.
Wong, Teng-fong et al., "Microcrack statistics, Weibull distribution and micromechanical modeling of compressive failure in rock", *Mechanics of Materials*, vol. 38, 2006, pp. 664-681.
Wood, Tom, "Dual Purpose COTD™ Rigs Establish New Operational Records", *Treme Coil Drilling Corp., Drilling Technology Without Borders*, 2009, pp. 1-18.
Xia, K. et al., "Effects of microstructures on dynamic compression of Barre granite", *International Journal of Rock Mechanics and Mining Sciences*, vol. 45, 2008. pp. 879-887, available at: www.sciencedirect.com.
Xu, Zhiyue et al., "Laser Spallation of Rocks for Oil Well Drilling", *Proceedings of the 23rd International Congress on Applications of Lasers and Electro-Optics*, 2004, pp. 1-6.
Xu, Z et al. "Modeling of Laser Spallation Drilling of Rocks fro gas- and Oilwell Drilling", *Society of Petroleum Engineers*, SPE 95746, 2005, pp. 1-6.
Xu, Z. et al., "Specific Energy for Laser Removal of Rocks", *Proceedings of the 20th International Congress on Applications of Lasers & Electro-Optics*, 2001, pp. 1-8.
Xu, Z. et al., "Specific energy for pulsed laser rock drilling", *Journal of Laser Applications*, vol. 15, No. 1, 2003, pp. 25-30.
Yamshchikov, V. S. et al., "An Evaluation of the Microcrack Density of Rocks by Ultrasonic Velocimetric Method", *Moscow Mining Institute.* (*Translated from Fiziko-Tekhnicheskie Problemy Razrabotki Poleznykh Iskopaemykh*), 1985, pp. 363-366.
Yilbas, B. S. et al., "Laser short pulse heating: Influence of pulse intensity on temperature and stress fields", *Applied Surface Science*, vol. 252, 2006, pp. 8428-8437.
Yilbas, B. S. et al., "Laser treatment of aluminum surface: Analysis of thermal stress field in the irradiated region", *Journal of Materials Processing Technology*, vol. 209, 2009, pp. 77-88.
Yilbas, B. S. et al., "Nano-second laser pulse heating and assisting gas jet considerations", *International Journal of Machine Tools & Manufacture*, vol. 40, 2000, pp. 1023-1038.
Yilbas, B. S. et al., "Repetitive laser pulse heating with a convective boundary condition at the surface", *Journal of Physics D: Applied Physics*, vol. 34, 2001, pp. 222-231.
Yun, Yingwei et al., "Thermal Stress Distribution in Thick Wall Cylinder Under Thermal Shock", *Journal of Pressure Vessel Technology, Transactions of the ASME*, 2009, vol. 131, pp. 1-6.
Zeuch, D.H. et al., "Rock Breakage Mechanism Wirt a PDC Cutter", *Society of Petroleum Engineers, 60th Annual Technical Conference*, Las Vegas, Sep. 22-25, 1985, 11 pgs.
Zhai, Yue et al., "Dynamic failure analysis on granite under uniaxial impact compressive load", *Front. Archit. Civ. Eng. China*, vol. 2, No. 3, 2008, pp. 253-260.
Zhou, X.P., "Microcrack Interaction Brittle Rock Subjected to Uniaxial Tensile Loads", *Theoretical and Applied Fracture Mechanics*, vol. 47, 2007, pp. 68-76.
Zhou, Zehua et al., "A New Thermal-Shock-Resistance Model for Ceramics: Establishment and validation", *Materials Science and Engineering*, A 405, 2005, pp. 272-276.
Zhu, Dongming et al., "Influence of High Cycle Thermal Loads on Thermal Fatigue Behavior of Thick Thermal Barrier Coatings", *National Aeronautics and Space Administration, Army Research Laboratory*, Technical Report ARL-TR-1341, NASA TP-3676, 1997, pp. 1-50.
Zhu, Dongming et al., "Investigation of thermal fatigue behavior of thermal barrier coating systems", *Surface and Coatings Technology*, vol. 94-95, 1997, pp. 94-101.
Zhu, Dongming et al., "Investigation of Thermal High Cycle and Low Cycle Fatigue Mechanisms of Thick Thermal Barrier Coatings", *National Aeronautics and Space Administration, Lewis Research Center*, NASA/TM-1998-206633, 1998, pp. 1-31.
Zhu, Dongming et al., "Thermophysical and Thermomechanical Properties of Thermal Barrier Coating Systems", *National Aeronautics and Space Administration, Glenn Research Center*, NASA/TM-2000-210237, 2000, pp. 1-22.
A Built-for-Purpose Coiled Tubing Rig, by Schulumberger Wells, No. DE-PS26-03NT15474, 2006, 1 pg.

* cited by examiner

LASER BOTTOM HOLE ASSEMBLY

This application claims the benefit of priority under 35 U.S.C. §119(e)(1) of U.S. provisional patent application Ser. No. 61/247,796 filed Oct. 1, 2009 title Method of Communicating Power and/or Data through a Mud Motor; the entire disclosure of the above mentioned provisional patent application is incorporated herein by reference.

This invention was made with Government support under Award DE-AR0000044 awarded by the Office of ARPA-E U.S. Department of Energy. The Government has certain rights in this invention.

BACKGROUND OF THE INVENTION

1. Field of the Invention

The present inventions relates to apparatus and methods for advancing a borehole using laser-mechanical energy. In particular the present inventions relate to such apparatus and methods for laser assisted drilling of boreholes using downhole motors as the source for rotating a laser beam and a mechanical bit. In particular, the present inventions relate to unique and novel systems for, configurations of, and methods for utilizing, a laser bottom hole assembly to advance a borehole.

2. Discussion of Related Art

The novel and innovative co-assigned inventions and teachings set forth in: (1) patent application Ser. No. 12/706,576, filed Feb. 16, 2010; and, (2) patent application Ser. No. 12/840,978 filed Jul. 21, 2010, the entire disclosures of which are incorporated herein by reference, provide, for example and in general, for the transmission of high power laser energy over great distances without substantial loss of power.

The novel and innovative co-assigned inventions and teachings set forth in: (1) patent application publication number 2010/0044106, filed Aug. 19, 2009; (2) patent application publication number 2010/0044104, filed Aug. 19, 2009; (3) patent application publication number 2010/0044105, filed Aug. 19, 2009; (4) patent application publication number 2010/0044102, filed Aug. 19, 2009; and, (5) patent application publication number 2010/0044103, filed Aug. 19, 2009, the entire disclosures of each of which are incorporated herein by reference, provide, for example and in general, for methods, systems and apparatus for laser mechanical drilling activities.

In general, and by way of historical overview, the advancement of boreholes, e.g., the drilling of oil, gas, or geothermal wells, and the apparatus for such tasks involve, among other things, the use of a drilling rig, which could be land or water based. The drilling rig advances a set of jointed tubulars, e.g., drill pipe, having a mechanical drill bit attached to the end of the drill pipe. As the drill pipe and bit are advanced toward/into the earth, the bit would be rotated against the earth's surface, or the bottom surface of the borehole, to cut, crush, scrape or otherwise remove or displace the earth through mechanical force and interaction. In this way the borehole would be advanced.

Typically, during this type of drilling the bit is forced against the bottom surface of the borehole, at times with thousands of pounds of force. During drilling the bit is rotated against the bottom of the borehole surface by rotating the drill pipe to which the bit is attached. A device on the drilling rig, such as a top drive or rotary table, in turn, rotates the drill pipe. Thus, as the borehole advances, the length of drill string increases and consequentially the distance between the drill bit and the rig increases, which results in a longer and longer drill string that must be rotated. In some wells this distance can exceed 10,000 feet. Thus, in this type of drilling the distance between the source of rotational movement, which also is referred to herein as a "rotational movement source", and by way of example in a conventional drilling rig could be the top drive, and the drill bit can be thousands of feet, and at times tens-of-thousands of feet.

Further, the cuttings, waste material, or debris that is removed or displaced by the mechanical action of the drill bit must be carried up and out of the borehole. Typically, in this type of drilling, a drilling fluid, such as water, brine or drilling mud, is pumped into the inside of the drill string, down into and out of the bit, and up the annulus that is formed between the outside of the drill string and the inside walls of the borehole or casing. In this way the drilling fluid carries away removed or displaced material from the borehole.

The great distance between the source of rotational movement and the drill bit in the forgoing type of drilling has been problematic, to greater and lesser degrees. Although, it is believed that the forgoing type of drilling is widely practiced. To overcome the problems associated with these great distances, and to provide additional benefits, locating the rotational movement source in close proximity to the drill bit has been suggested and implemented. Thus, in these embodiments the rotational movement source is positioned at the end of a drill string, coiled tube, wireline, or other means of conveyance into a borehole, in proximity to the drill bit. In this way, the source of rotational movement is placed in the borehole, at or near the bit, and consequentially at or near the bottom of the borehole.

By way of example, one such embodiment of a downhole motor is disclosed in Clark et al. U.S. Pat. No. 3,112,801 ("Clark '801"), the entire disclosure of which is incorporated herein by reference. In general, Clark '801 provides, for example, a motor that is fashioned along the lines of what has become known as a Moineau device, which is described in the Moineau patents, e.g., U.S. Pat. Nos. 1,892,217 and 2,028,407. Moineau devices essentially have an inner and an outer member that are axially arranged with their centerlines being parallel. The outer member has internal helical threads and the inner member has external helical threads, with the outer member having one additional thread to the inner member. The outer and inner members intermesh and can function as a positive displacement motor, i.e, a source of rotational movement, if a driving fluid (liquid, gas, or foam) is forced through them, or a positive displacement pump if an external rotation force is applied to one of the members. Depending upon the specific configuration the inner member may rotate and the outer member may be fixed or the outer member may rotate and the inner member may be fixed. In Clark '801, the inner member, which Clark '801 refers to as the rotor, rotates and the outer member, which Clark '801 refers to as the stator, is stationary. As Clark '801 notes, "[t]he rotor rotates about its own axis and also orbits in a cylindrical path about the axis of the stator." (Clark '801 column 1 lines 41-45) This orbital movement of the inner member of a Moineau device with respect to the outer member has also been referred to as nutation, gyration and nutation-gyration. Clark '801, as well as other teachings, provides various mechanical means to accommodate this orbiting motion and bring, or transmit, the rotational movement back to a non-orbiting centerline axis.

By way of example, another such embodiment of a downhole motor is disclosed in Clark U.S. Pat. No. 3,603,407 ("Clark '407"), the entire disclosure of which is incorporated herein by reference. In Clark '407 there is provided, for example, a Moineau device in which the outer member rotates and the inner member is fixed. Thus, Clark '407 refers to the outer member as an "outer gear having internal helical threads and comprising the rotor to which the drill bit is connected, the inner gear having external threads and being fixed against rotation, the arrangement being such that the inner gear is free to gyrate when driving force flows between the gears so that the outer gear member and the attached drill bit will rotate in a concentric path." (Clark '407 Abstract) This configuration where the outer member rotates and the inner member is fixed has been referred to as a "reverse Moineau" device, motor or pump, or as an "inverted Moineau" device, motor or pump.

A further example of a reverse Moineau motor is provided in Tiraspolsky et al. U.S. Pat. No. 4,011,917 ("Tiraspolsky"), the entire disclosure of which is incorporated herein by reference. Tiraspolsky, for example, provides for the inner non-rotating member of the Moineau device to have a channel through it. An additional example of a reverse Moineau motor having a channel in the non-rotating member is found in Oglesby U.S. Pat. No. 7,055,629 ("Oglesby").

Although a passing reference is made in Oglesby to "using laser . . . energies applied to the materials to be 'drilled' . . . " (see generally, Oglesby column 4 line 53 to column 5 line 2), none of the forgoing references teach or suggest the systems, components, configurations or methods, that are provided by the present inventions for a laser bottom hole assembly and methods of drilling therewith.

SUMMARY

It is desirable to have the ability to transmit high power laser energy to a laser mechanical drill bit. It is further desirable the have the ability to address, control or regulate, as the case may be, the transition from rotating to non-rotating components, flow properties of driving fluids, cooling fluids and beam clearing fluids through the design and configuration of a laser bottom hole assembly. The present inventions, among other things, solves these needs by providing the articles of manufacture, devices and systems taught herein.

There is provided a laser bottom hole assembly, the assembly having: a first end having an opening for receiving a fluid flow and a means for providing a laser beam having at least 5 kW of power; a first means such as a component that separates the fluid flow and conveying the laser beam providing means, the first separating and conveying component is in fluid communication with the fluid flow, a first fluid path and a second fluid path, so that in operation the fluid flow is separated into the first fluid path and the second fluid path; an external housing having a rotating section, a non-rotating section, and an external rotational transition zone, the rotating section of the external housing comprising rotating and non-rotating internal components; the first separating component, and the first and second fluid paths positioned within the external housing; a means for providing rotational motion, such as a component that provides rotational movement that has a non-rotating screw member, at least a portion of the second fluid path contained within the screw member and at least a portion of the laser beam providing component within the screw member; an internal rotational transition zone within the rotating external housing section, whereby a transition from non-rotating internal components to rotating internal components occurs; and, an exhaust port in the rotating outer housing section, the exhaust port in fluid communication with the first fluid path and positioned above the internal rotational transition zones.

There is further provided, a self-regulating system for controlling multiple fluid flows and managing a high power laser fiber optic cable in a reverse Moineau motor laser mechanical bottom hole assembly, the system having: a first flow diverter in fluid communication with a first, a second and a third fluid path, whereby the flow diverter is configured to divert a fluid flow from the first fluid path into the second and third fluid paths; a first check valve in fluid communication with the first and second fluid paths; an isolated flow regulator in fluid communication with the third fluid path; the second fluid path comprising a progressive cavity of mud motor, the cavity comprising an external rotating gear member; the third fluid path in fluid association with a laser optic; the third fluid path in fluid association with a laser mechanical drill bit section, the drill bit section having a laser beam delivery channel; a first exhaust port in fluid communication with the second fluid path, whereby fluid flow through the second fluid path travels from the first flow diverter to the progressive cavity to the first exhaust port; and, the first flow regulator configured to maintain a predetermined flow balance between the second and third flow paths over a predetermined range of motor conditions.

The forgoing devices may yet further have or be configured such that: a means to maintain a predetermined flow balance between the first and second flow paths over a predetermined range of conditions; the first separating means is positioned within the rotating section of the external housing; the first separating means is positioned at least partially within the non-rotating section of the external housing; the predetermined flow balance means is positioned within the rotating section of the external rotating housing; the predetermined flow balance means is positioned at least partially within the non-rotating section of the external rotating housing.

Still further the forging devices may yet further have or be configured such that The laser bottom hole assembly of claim 1, comprising a first and a second means for transmitting a laser beam, wherein the first means for transmitting is non-rotating and is positioned within the rotating section of the external housing and the second means for transmitting is rotating and is positioned within the rotating section of the external housing; having a laser optic positioned in the internal rotational transition zone; a rotating laser optic and a non-rotating laser optic positioned in the internal rotational transition zone.

Moreover, there is provided a laser bottom hole assembly in whch the predetermined flow balance between the first and second flow paths is between from about 70-50% in the first fluid path and from about 30-50% in the second fluid path.

Additionally there is provided a laser bottom hole assembly in which the predetermined flow balance between the first and second flow paths is between from about 60-40% in the first fluid path and from about 40-60% in the second fluid path.

Still further there is provided laser bottom hole assembly having a means for isolating, such as a component that seals, a first fluid path from the second fluid path; a laser bottom hole assembly having a means for preventing assembly material debris, such as a sealing component, from entering the second fluid path during assembly and operation; and a laser bottom hole assembly have both of these components.

There is yet further provided the forgoing laser bottom hole assemblies in having an upper section, a middle section and a lower section, wherein the end opening is located at an end of the upper section, the non-rotating screw member is located in the middle section, and the first exhaust port is located in the middle section.

Still further there is provided a laser bottom hole assembly, such as the forgoing assemblies, having a non-rotating first flex-shaft having a lower end, the lower end attached to the non-rotating screw member, in which at least a portion of the first non-rotating flex-shaft is located within the rotating section of the external housing. Further, there is provided a non-rotating hollow flexible member having an upper end, the upper end attached to the non-rotating screw member.

Additionally, there is provided a laser bottom hole assembly having a second flow separator for separating a fluid flow, the second separator is in fluid communication with a second fluid path in the assembly so that the second fluid path is separated into a third fluid path and a fourth fluid path. Still further there is provided a self-regulating system in which the laser beam delivery channel is found in a portion of a third fluid path. Yet further the flow balance between the second and third flow paths is between about 70-50%, or 40-60%.

Moreover, and still further there is provided the self-regulating system set forth above in which there is a second flow diverter, the second flow diverter in fluid communication with the third fluid path and in fluid communication with a fourth and a fifth fluid path, whereby the second flow diverter is configured to divert a fluid flow from the third fluid path into the fourth and fifth fluid paths; the laser beam delivery channel comprising a portion of the fourth fluid flow path; a second exhaust port, the second exhaust port positioned in the drill bit, the second exhaust port in fluid communication with the fifth flow path; and, the second flow regulator configured to maintain a predetermined flow balance between the fourth and fifth flow paths over a predetermined range of motor conditions. In this and the forgoing systems the laser beam delivery channel may be in a portion of a fourth fluid path in which case the predetermined flow balance between the second and third flow path is between from about 70-50% in the first fluid path and about from 30-50% in the second fluid path, or may be between the second and third flow path is between from about 60-40% in the first fluid path and about from 40-60% in the second fluid path.

Yet further there is provided a self-regulating laser bottom hole assembly that has a second check valve in fluid communication with the fourth flow path and a third check value in fluid communication with the fifth flow path and in which a high power laser fiber optic cable is in association with the third fluid path.

Furthermore, there is provided a laser bottom hole assembly that has: an upper section, a middle section, and a lower section; the upper section comprising a non-rotating connector affixed to a non-rotating outer housing; the middle section comprising a rotating outer housing and non-rotating inner components; the lower section comprising a rotating external outer housing and a rotating connector for connecting to a bit or tool; a flow separator in fluid communication with a first fluid path and a second fluid path; a portion of the first and second fluid paths positioned in the middle section; a portion of the first fluid path position formed by the rotating outer housing and non-rotating inner components of the middle section; a portion of the second fluid path position within the non-rotating inner components of the middle section; a portion of the second fluid path positioned in the lower section; the first fluid path not entering the lower section; and, the lower section comprising a means to deliver a laser beam.

Still additionally, there is provided a laser bottom hole assembly that has: a first end having an opening for receiving a fluid flow and a means for providing a laser beam having at least 5 kW of power; a means for separating the fluid flow, the separating means in fluid communication with the fluid flow, a first fluid path and a second fluid path; an external housing comprising a rotating section, a non-rotating section, and an external rotational transition zone, the rotating section of the external housing comprising rotating and non-rotating internal components; a non-rotating screw member in driving relationship with a rotating gear member; an internal rotational transition zone within the rotating external housing section, whereby a transition from non-rotating internal components to rotating internal components occurs; and, a laser optic positioned in the internal rotational transition zone. This assembly may further have a first and a second means for transmitting a laser beam, wherein the first means for transmitting is non-rotating and is positioned within the rotating section of the external housing and the second means for transmitting is rotating and is positioned within the rotating section of the external housing, and a means for preventing assembly material debris from entering the second fluid path during assembly and operation.

Still further there is provided a laser bottom hole assembly having: a fluid flow separator in fluid communication with a first fluid path and a second fluid path; an external housing comprising a rotating section, a non-rotating section, and an external rotational transition zone, the rotating section of the external housing comprising rotating and non-rotating internal components; a non-rotating screw member in driving relationship with a rotating gear member; a fiber optic cable within the non-rotating screw member; an internal rotational transition zone within the rotating external housing section, whereby a transition from non-rotating internal components to rotating internal components occurs; and, the fiber optic cable and a laser optic positioned in the internal rotational transition zone.

Moreover, there is provided a laser bottom hole assembly having: an external housing comprising a rotating section, a non-rotating section, and an external rotational transition zone, the rotating section of the external housing comprising rotating and non-rotating internal components; a non-rotating screw member in driving relationship with a rotating gear member; a fiber optic cable within the non-rotating screw member; an internal rotational transition zone within the rotating external housing section, whereby a transition from non-rotating internal components to rotating internal components occurs; and, a means for aligning and restricting rotation of internal components during assembly, the aligning and restricting means positioned in the internal rotational transition zone.

A system for controlling multiple fluid flows and managing a high power laser fiber optic cable in a reverse Moineau motor laser mechanical bottom hole assembly having: a first flow diverter in fluid communication with a first, a second and a third fluid path, whereby the flow diverter is configured to divert a fluid flow from the first fluid path into the second and third fluid paths; a high power laser fiber optic cable; an isolated flow regulator in fluid communication with the third fluid path; the high power laser fiber optic cable positioned within the flow regulator; and, a laser optic and the optic cable in association with the third fluid path are also provided.

Additionally, there is provided a system for managing a high power laser fiber optic cable in a reverse Moineau motor laser mechanical bottom hole assembly having: an external housing comprising a rotating section, a non-rotating section, and an external rotational transition zone, the rotating section of the external housing comprising rotating and non-rotating internal components; a non-rotating screw member in driving relationship with a rotating gear member; a high power laser fiber optic cable, the fiber optic cable positioned in the external housing and having a path within the external housing; the rotating external housing section having a first centerline; the non-rotating screw member having a second centerline that is parallel to and non-coaxial with the first centerline; the fiber optic cable positioned within the non-rotating screw member and along the second centerline; and, the fiber optic cable positioned along the first centerline; whereby the path of the fiber optic cable through the laser bottom hole assembly moves from second centerline to first centerline. This system may further be configured such that a portion of the path of the high power laser fiber optic cable moves form the first centerline to the second centerline, the path of the high power laser fiber optic cable comprises a helix having a third centerline, a portion of the third centerline is substantially coaxial with a portion of the second centerline, a portion of the third centerline is substantially coaxial with a portion of the second centerline, a portion of the third centerline is substantially coaxial with a portion of the first centerline, or the path of the high power laser fiber optic cable path comprises a sinusoidal section, the sinusoidal section having a third centerline and a portion of the sinusoidal centerline being substantially coaxial with a portion of the second centerline.

Moreover, a bottom hole drilling assembly having a drilling motor assembly, laser beam conveyance means, and an optical assembly is provided in which the drilling motor assembly has an upper connection means for connection to a drill string, said connection means rotationally fixed with respect to the drill string, an internal assembly comprising a mandrel, an upper flex shaft, a hollow screw shaft, and a lower flex shaft, said internal assembly rotationally fixed with respect to said upper connection means, an external motor body disposed around, and rotatably mounted upon and with respect to, the internal assembly, a bearing assembly disposed between the internal assembly and the external housing, and transmitting thrust and radial loads between said internal assembly and said external body, said hollow screw shaft disposed upon, and rotationally fixed with respect to, said upper flex shaft, said lower flex shaft below, and disposed upon, and rotationally fixed with respect to, said hollow screw shaft, and a helical progressive cavity gear member disposed in said external motor body, and around said hollow screw shaft, and capable of generating rotational movement of said external body with respect to said internal assembly when drilling fluid is forced through said drilling motor assembly; said laser beam conveyance means comprising fiber optic cable, said cable passing through and rotationally fixed with respect to said drilling motor internal assembly; said optical assembly having an upper portion disposed upon, and rotationally fixed to, said drilling motor internal assembly, and optically connected to said laser beam conveyance means, and a lower portion disposed within, and rotationally fixed to, said external motor body.

There is further provided a laser bottom hole assembly and systems having a flow path in communication with a lubrication source.

DESCRIPTION OF THE PREFERRED EMBODIMENTS

In general, the present inventions relate to laser bottom hole assemblies for advancing boreholes in the earth and methods of advancing such boreholes in, for example sandstone, limestone, basalt, salt, granite, shale, etc., or in other materials, such as for example concrete. These inventions further relate to, for example, the use of drilling fluids, e.g., liquids, gases or foams, to remove borehole cuttings, e.g., the debris that is created from the removal of borehole material created by advancing the borehole, to provide a driving force for a downhole motor, to keep the laser beam path free of such cuttings, and to provide cooling for downhole laser beam optics, and downhole mechanical components. Although boreholes may generally be depicted or illustrated as advancing from the surface vertically down into the earth, the present inventions are not limited to such vertical drilling, but also address horizontal drilling, directional drilling, and the advancement of boreholes in any direction relative to the surface. Although the present invention is not limited to any particular size, i.e., diameter of borehole, it is contemplated that the laser bottom hole assembly can be configured such that it is capable of drilling a 4½ inch, a 4¾ inch, a 5⅞ inch, a 6-⅛ inch, a 6½ inch, a 7⅛ inch, a 8½ inch, 8¾ inch, a 9½ inch, a 10⅝ inch, and a 12¼ inch, as well as larger, smaller or other diameter holes.

By advancing the borehole, it is meant that the overall length of the borehole is increased. Boreholes may be vertical, substantially vertical, horizontal, inverted, or any combination and permutation of those varying directions and positions. Further, boreholes may be in the earth, in structures, in materials, and in structures or materials within the earth, partially within the earth, or not within the earth.

Figure 1A:
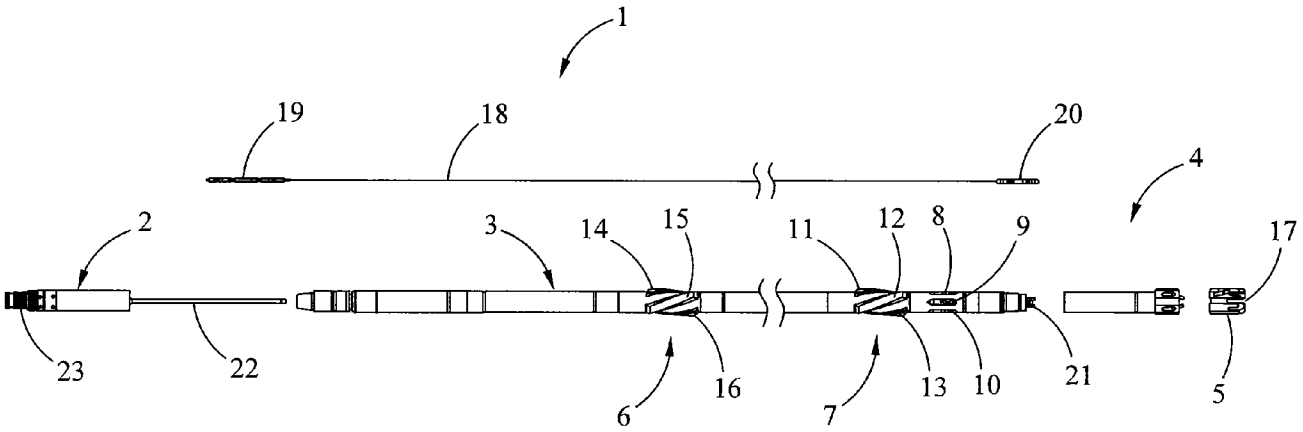
FIG. 1A is plan view of an embodiment of a partially disassembled laser bottom hole assembly of the present invention.
Figure 1B:
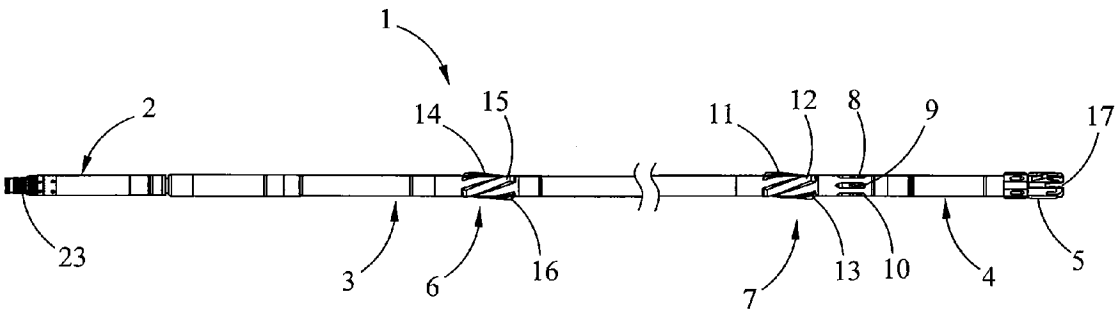
FIG. 1B is a plan view of the laser bottom hole assembly of FIG. 1A assembled.

As illustrated in general in FIGS. 1A and 1B, and by way of example, there is provided a laser bottom hole assembly 1. FIG. 1B shows the laser bottom hole assembly and bit assembled. FIG. 1A shows the laser bottom hole assembly and bit partially disassembled. The laser bottom hole assembly 1 can have three sections: an upper section 2; a middle section 3; and a lower section 4. Having three sections aids in the construction and maintenance of the assembly 1. Further, having a single section, two sections or four, or more, sections may be utilized. Additionally, provided one stays within the spirit of the teachings of the present invention, as set forth herein, the components of each section may be located in other sections or two sections may be united as a section, or a section may be subdivided into multiple sections. As used herein the terms "upper" "middle" and "lower" with respect to the laser bottom hole assembly and its components are relative terms. The term "upper" as used in this context connotates being closer to the connection to the conveyance means and the term "lower" connotates being further away from the connection to the conveyance means and closer to the bit or tool. Similarly, the terms "above" and "below" are used herein as relative terms. Thus, by way of illustration if the laser bottom hole assembly is being held in a horizontal position, e.g., during assembly, the upper and lower sections would be at the same height; and the upper section would be above the middle section and the lower section would be below the middle section.

Preferably, the sections are connected by threaded connections, as are used in the downhole tool arts. However, the sections may be integral, partially integral, separable, or otherwise attached or affixed as is known in the art, e.g., stub acme, acme, other straight threads, tapered threads, pins, welds and press fits. The manner of attachment should be sufficient for the complete assembly to maintain its integrity and function in the downhole environment during drilling or other downhole activities.

The laser bottom hole assembly 1 may have a bit 5, stabilizer sections 6 and 7, which sections 6 and 7 have stabilizers 14, 15, 16 and 11, 12, 13 respectively, side outlets 8, 9, and 10 for fluid, (a fourth outlet is present in this example, which is not shown in FIG. 1) which side outlets provide for the exhaust of the fluid and are primarily for directing cuttings up the borehole, outlet 17 for fluid, which outlet 17 is primarily for directing cuttings away from the laser beam path and optical components, and a connector 23, which is primarily for joining the laser bottom hole assembly 1 to a conveyance means, such as for example coiled tubing, composite tubing, drilling pipe or a wireline.

As further illustrated in FIG. 1A, the laser bottom hole assembly 1 may contain an optical fiber 18, which may further have optically associated therewith an optical coupler 19 and an optical connector 20. The optical coupler 19 is coupled with an optical coupler (not shown in this figure) extending from and optically associated with a laser source on the surface. The optical connector 20 launches the laser beam into the laser optics (not shown in this figure). The laser beam at this point in the laser bottom hole assembly is a high power laser beam having a power of greater than 5 kW, preferably greater than 10 kW, and more preferably at least about 15 kW. The middle section may further have alignment pins 21, which pins 21 may serve to align or protect various components during the assembly of the lower bottom hole assembly. The alignment pins 21 further may serve to limit or prevent the rotation of inner components in the lower section 4. Although pins are illustrated in this example, other devices may be utilized, such as for example, other means to transfer torque such as splines, pegs, magnets, tapered joints, gears, springs and threads. Further, the upper section 2 may have components associated therewith, which components extend into other sections of the lower bottom hole assembly, such as for example flow tube 22.

The upper section 2 of the laser bottom hole assembly 1 may serve multiple and varied purposes. It can provide an attachment to the conveyance means. It can receive fluid from the conveyance means or from a separate line or pipe. The fluid can be in the form of a single flow, multiple flows of different fluids, multiple flows of the same fluid, or combinations and variations of these. Further, the multiple flows may have different or the same flow rates and pressures. The upper section can also contain: a break-away device, such as for example, a shear pin or ring, a flow regulator, a remote control disconnect, a hydraulic disconnect; a flow separator; and a lubricator, which lubricator can either be a self-contained source of lubrication or a component for conveying a lubricant that is provided downhole by way of the conveyance means or from a separate line or pipe associated with a lubrication reservoir at the surface or on the rig. It should be further noted that these and other purposes of the upper section may be accomplished by other sections of the laser bottom hole assembly without departing from the spirit of the present inventions.

Figure 2:
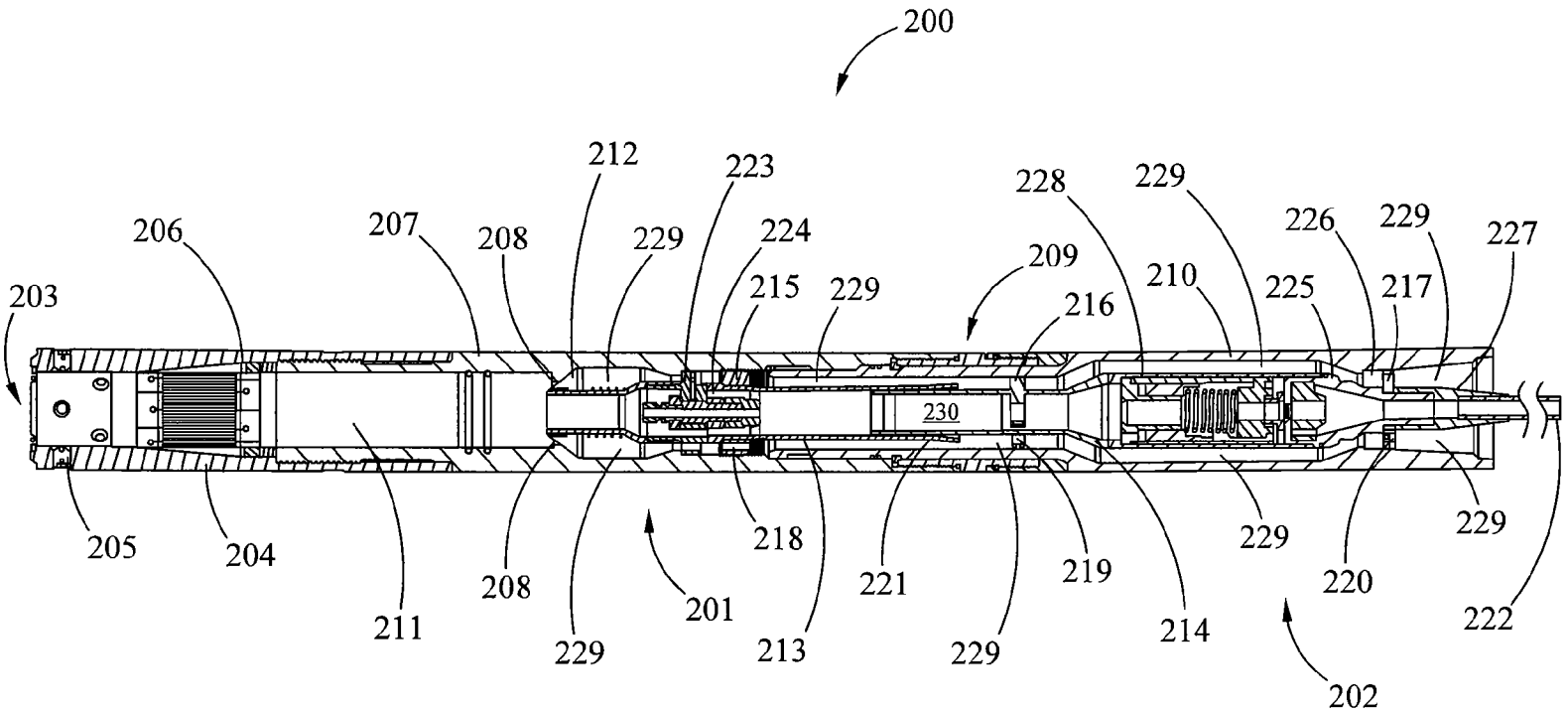
FIG. 2 is a cross-sectional view of an upper section of a laser bottom hole assembly of the present invention.
Figure 2A:
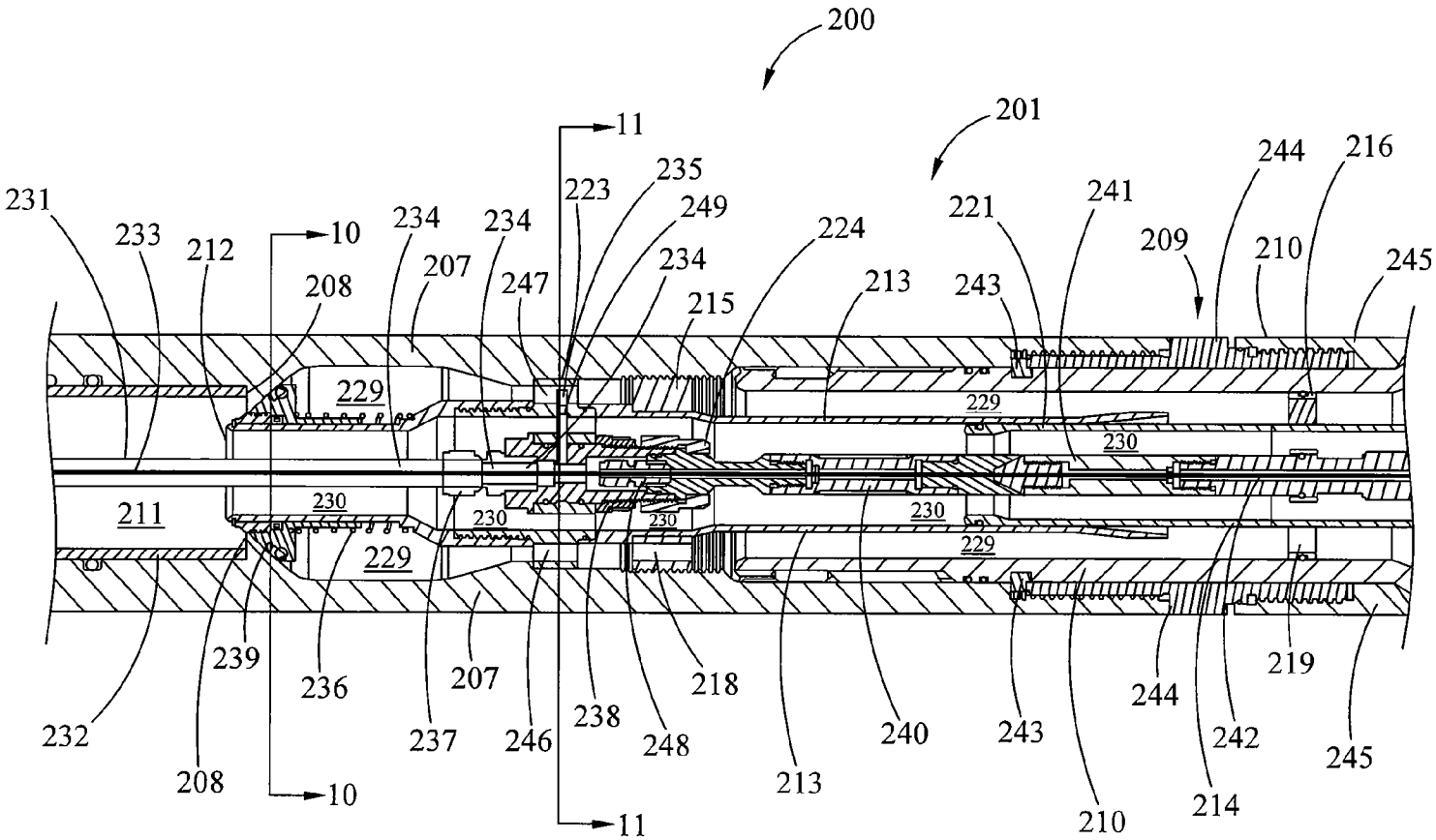
FIG. 2A is an enlarged cross-sectional view of the upper portion of the upper section of the laser bottom hole assembly of FIG. 2.
Figure 2B:
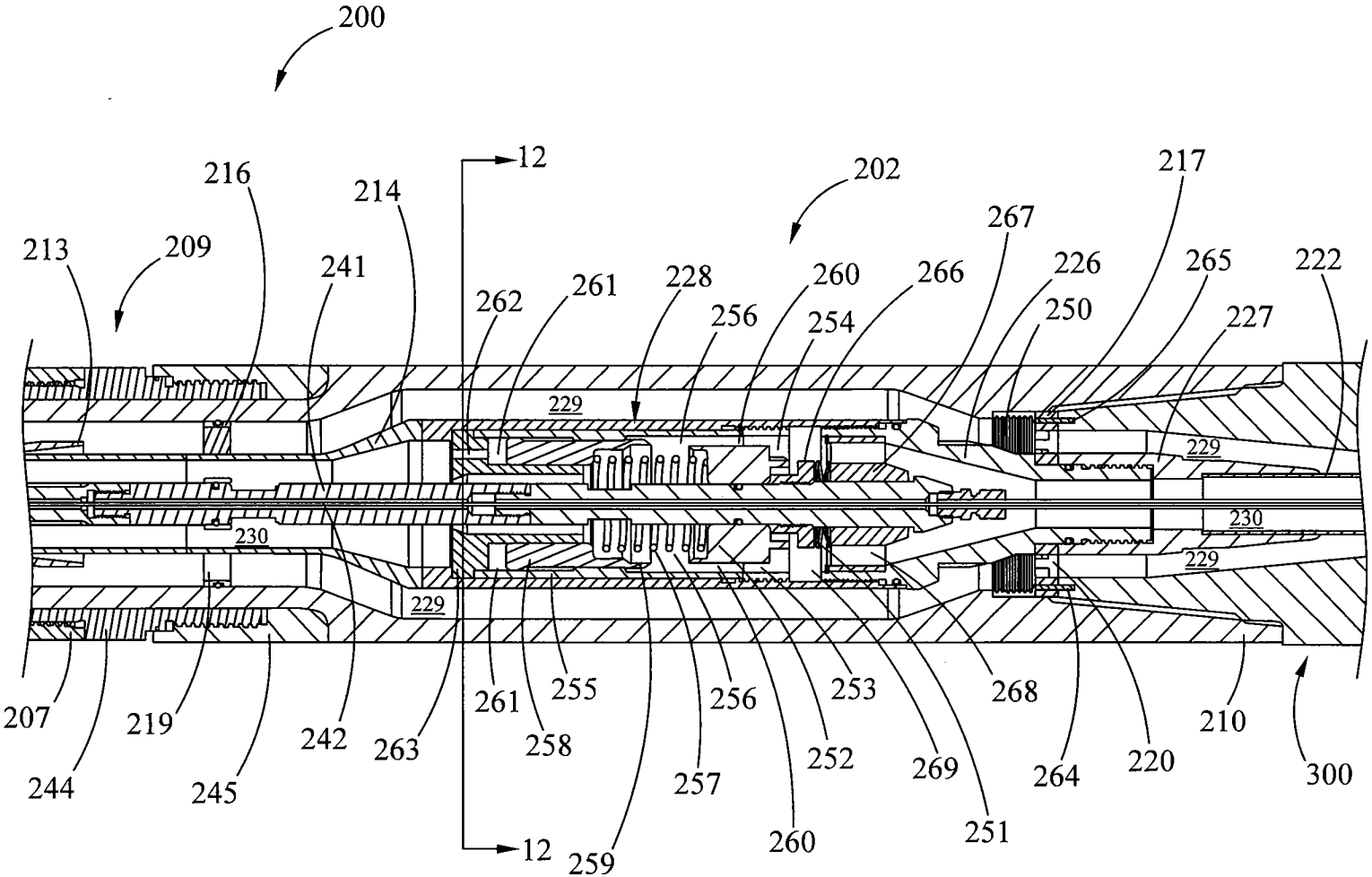
FIG. 2B is an enlarged cross-sectional view of the lower portion of the upper section of the laser bottom hole assembly of FIG. 2.

An illustrative example of an upper section of a laser bottom hole assembly is shown in FIGS. 2, 2A and 2B and related cross-sectional figures. FIG. 2 illustrates the upper section 200 without an optical fiber and its optically related optical components being present. FIGS. 2A and 2B show portions of the same upper section 200 with an optical fiber and its optically related components present and the association of the upper section 200 with a middle section 300 of the laser bottom hole assembly. Thus, in this example there is provided an upper section of a laser bottom hole assembly 200, having an upper portion 201 for connecting to a conveyance means, which in this example is coiled tubing, and a lower portion 202, which in this example is adjacent the middle section of the laser bottom hole assembly. The upper portion 201 has an upper end 203. Although the exemplary upper section of FIG. 2, and its related figures, is shown as being used in conjunction with the exemplary middle section of FIG. 3A, and its related figures, and this FIG. 3A exemplary middle section is shown as being used in conjunction with the exemplary lower section of FIG. 4, and its related figures, other types and configurations of sections may be used with each of these exemplary sections without departing from the spirit of the inventions herein.

Referring back to the example shown in FIG. 2 and its related figures, the upper portion 201 has an outer-upper housing 204, which in this example is a tube having screw securements, for securing the outer upper housing 204 to the coiled tubing (which is not shown in the drawing). The outer upper housing 204 may also be associated with a collet 206 for securing the coiled tubing. The outer upper housing 204 partially surrounds and joins against a connector housing 207, which in this example is a tube having threaded fittings for connecting to the outer upper housing 204. The connection between the outer upper housing 204 and the connector housing 207, or the interior of either or both of these housings, may have seals, bearing materials, slip members or other components that add in assembly, controlling pressure or features that may be needed or beneficial for this junction. Such devices, assemblies and materials may also be employed at other junctions in the lower bottom hole assembly. The connector housing 207 may have a ledge 208, upon which the coiled tubing (232 in FIG. 2A, not shown in FIG. 2) abuts.

The upper portion 201 of the upper section 200 of the laser bottom hole assembly may be connected to the lower portion 202 of the upper section 200 of the laser bottom hole assembly by way of a breakaway device 209, which in this example is a shear ring assembly. The lower portion 202 of the upper section 200 of the laser bottom hole assembly has a lower portion housing 210. The lower portion housing 210 extends within the connector housing 207 and is releasably connected thereto by breakaway device 209. Breakaway device 209, as seen in detail in FIG. 2A, may be a shear ring assembly having a locking member 244, an adjustment member 245 and a shear ring 243 or other suitable breakaway devices may be used such as, e.g., a remotely controlled disconnect device. The inner wall of the connector housing forms a passage 211. The passage 211 remains present when the coiled tubing 232 is affixed to the upper portion 201 of the upper section 200; once the coiled tubing 232 is connected its inner wall may form all or part of the passage 211 (compare FIG. 2, (without coiled tubing) and FIG. 2A (with coiled tubing 232)).

The upper portion 201 of the upper section 200 of the laser bottom hole assembly may have a flow separator 212. The flow separator 212 is formed by the upper end of a connector inner housing 213. There is further provided at the upper end of the inner housing 213 a check valve assembly having an annular valve member 239 that is seated against an inner surface of housing 207 by spring 236. Thus, the check valve assembly when open by a fluid flow from the coiled tubing 232 provides an annular opening or passage that is in fluid communication with passage 229 and thus provides for the flow of a first fluid path. A second fluid flow path is created by the flow separator 212 and this second path travels along inner passage 230. The connector inner housing 213 is further affixed to the connector housing 207 by centralizing flow ring 215, having supports and passages 218. Thus, the check valve assembly prevents back flow from the first fluid path into passage 211 and 230.

The flow separator divides a fluid flow from the surface. Although shown in this example in the upper section of the laser bottom hole assembly, the flow separator may be placed at other locations and multiple flow separators may be utilized. The flow separator may be located at the surface, along the conveyance means, several meters above the laser bottom hole assembly, a meter or less above the laser bottom hole assembly, or within other sections of the laser bottom hole assembly depending upon the purpose for the two fluid flows. Thus, for example, if a first fluid flow is intended to cool the bit and a second flow is intended to keep the laser beam path clear from debris, the separator can be located in the lower section of the bottom hole assembly. Further, and by way of example, if the first fluid flow and the second fluid flow have different compositions the flow separator for these flows should be positioned above, upper to, the location in the laser bottom hole assembly where these compositional differences are needed. Thus, in the situation, for example, where the source of rotational movement, such as an air driven motor, needs lubrication and the optics for the laser must be kept free from lubricants the two flows will need different compositions, a first flow having lubricants for the motor and the second flow essentially free from lubricants for the optics. Moreover, and as discussed in greater detail below, in this and other situations the flow paths should be kept substantially separate, preferably essentially separate (i.e., maintaining sufficient separation to maintain sufficient compositional purity of the two flows to meet the requirement for having two compositionally different flows), or entirely separate. The check valve assembly does not obstruct or directly affect the second flow path.

The connector inner housing 213 is positioned within the upper section 200, by the lubrication apparatus 223, the centralizer 215, and the overlap section 221. The optical coupler is positioned with in the inner housing 213 by a first attachment device 237, a second attachment device 238, and components of the lubrication apparatus 223, although other types of positioning devices are contemplated and may be employed.

The upper portion 201 further may have a lubrication apparatus 223, which may be, e.g., an oil pump, a oil reservoir, or as shown in detail in FIG. 2A an oil passage 234, which passage is in fluid communication with a source of oil from the surface and in fluid communication with an oil port 235; the oil port 235 may also preferably have a pressure regulator and check valve assembly 249, to regulate the flow of oil, to prevent back flow into the oil port, or both.

Thus, in the example as shown in FIGS. 2 and 2A, the lubrication, which may be for example an oil and preferably a readily bio-degradable oil, such as soybean oil may be used. The oil is distributed into the first fluid flow in passage 229 and in particular passage 247 as the oil is provided from the oil port 235. There is also provided passage 246 in the lubrication apparatus 223, which also provides flow for the first fluid path. The flow rates of the lubricant depend upon, for example, the flow rate of the fluid in the first fluid path, the lubrication requirements for the source of rotation, e.g., an air driven motor, the properties of the lubricant, and potentially upon the downhole conditions.

As shown in detail in FIGS. 2, 2A and 2B the lower portion 202 of the upper section 200 of the lower bottom hole assembly has a lower inner housing 214 that is in fluid communication with the connector inner housing 213. Preferably, the lower inner housing 214 has an area of overlap 221 with the connector inner housing 213. This relationship of the inner housings 213 and 214 forms a continuation of the inner fluid passage 230 and the second fluid path.

There is also provided a centralizing flow ring 216 having a passage 219 and a centralizing flow ring 217 having a passage 220. More or less centralizers may be required. The centralizers are configured to permit the flow of the first fluid path while maintaining the position of the inner comments, such as the inner housings.

There is also provided a flow regulator assembly 228 in the lower portion 202 of the upper section 200 of the laser bottom hole assembly. The flow regulator may be positioned at any point below, i.e., lower to, the flow separator. Thus, for example the accuracy of the control of the flow regulator may be increased by positioning the flow regulator in the lower section of the bottom hole assembly while having the flow separator in the upper section. The flow regulator is positioned within one of the two fluid flows streams. The flow regulator controls the flow rate (volume/time) of fluid that flows through both the first and second fluid flow paths and maintains these flows in a predetermined range and maintains this predetermined range as different loads are placed on the source of rotation, e.g., an air driven mud motor. Thus, the flow regulator can balance and maintain the flows in a predetermined distribution range such that: about 20% of the flow is in the first fluid path and about 80% is in the second fluid path; about 30% is in the first fluid path and about 70% is in the second fluid path; about 40% is in the first fluid path and about 60% is in the second fluid path; about 50% is in the first fluid path and about 50% is in the second fluid path; about 60% is in the first fluid path and 40% is in the second fluid path; about 70% is in the first fluid path and 30% is in the second fluid path; about 80% is in the first fluid path and 20% is in the second fluid path; about 20-80% is in the first fluid path and 80-20% is in the second fluid path; about 30-70% is in the first fluid path and 70-30% is in the second fluid path; about 40-60% is in the first fluid path and 60-40% is in the second fluid path, and preferably about from 70-50% in the first fluid path and about from 30-50% in the second fluid path.

The flow regulator may be any type of flow rate control device or assembly, such as valves, flow controlled diaphragms, or other types of regulators, the regulators may have computer controls located either down hole or on the surface. A preferred regulator is one in which the flow distribution is balanced and maintained at a predetermined balance over a wide range of conditions and done so in "isolation", i.e., without the need for controls from the surface and without the need for downhole computers or controllers, e.g., a PLC.

A preferred example of an isolated regulator assembly is shown at 228 in FIGS. 2 and 2B. Thus, the flow regulator assembly 228 is positioned within the lower inner housing 214, within passage 230, and thus, in the path of the second fluid flow. The regulator 228 has a regulator housing 255, which may be a separate housing or tube, a separable housing or tube, a housing or tube that is integral to the inner housing 214, or the inner housing 214. Within the housing 214 there is positioned a spring seat 252, which seat 252 has passages 253, 254 for the flow of the second fluid flow. A single or multiple passages may be employed. The regulator housing 255 has a passage 256 that is in fluid communication with the passages 253, 254. A spring 257 is located between a piston 258 and a seat 252. The piston has a restricting inside diameter 259 that moves toward the seat 252 restricting the annulus 260. The regulator 228 has a regulator cap 263 that has a port 262. The port 262 is in fluid communication with the passage 230 and a piston chamber 261. The size of the components and passage openings and the tension of the spring are selected to obtain and maintain a predetermined flow balance between the first and second flow paths. Thus, in operation as the pressure in piston chamber 261 increases the piston 258 is forced toward the seat 252 restricting the flow rate and thus, maintaining the flow distributions of the two fluid paths. The regulator assembly 228 has the further advantage of being capable of automatically directing a predetermined portion of the entire flow to the first fluid path to address the situation where the source of rotational movement may become stuck or jammed downhole. Thus, should the source of rotation become jammed downhole, the pressure in the piston chamber 261 will rapidly increase driving the piston into engagement with the seat 252, restricting the annulus 260, and directing a predetermined portion of the entire flow to the first fluid flow path to provide maximum fluid force to free up, i.e., start rotation of the rotation source. Conversely, in the event that the pressure requirements in the first path is low, the resulting lower pressure on the piston will allow the spring to push the piston upward, and the piston will be less restrictive, allowing the correct proportion of fluid to flow down the second fluid path.

The exemplary isolated regulator assembly 228 is further retained in position by a first locking member 266, a Belleville washer 251, a second locking member 267, having a passage 268. A space 269 is present around these positioning components. This space 269 is in fluid communication with the passages in the regulator components, as well as, in fluid communication with passage 230 and collectively forms a portion of passage 230.

The centralizer 217 may have bolts 264, 265 that are affixed to upper non-rotating housing 301. In all of the manners of affixing components together, such as the bolts 264, 265, it should be understood that several other manners of affixing the components may be utilized, and unless the specification expressly states otherwise, the inventions are not limited to or restricted by the manner of affixing components together. The centralizer 217 is associated with wave spring 250 which spring abuts against adapter 226. The centralizer 217 is associated with a connector 227 that connects to a tube 222.

FIGS. 2A and 2B show the upper section 200 of the laser bottom hole assembly with optical fibers inserted therein. The optical fibers are preferably of the type disclosed in Ser. No. 12/706,576, filed Feb. 16, 2010 and Ser. No. 12/840,978 filed Jul. 21, 2010. A first optical fiber 233 is positioned within an outer tube 231, which may convey, for example, a lubricant, other optical fiber, a fluid flow, communication lines or combinations of the foregoing. The first optical fiber 233 extends to the surface and is optically associated with the laser and transmits the laser beam from the surface to the laser bottom hole assembly. The fiber 233 is optically associated with an upper coupling section 240. The upper coupling section 240 is optically coupled to a lower coupling section 241, which is optically associated with a second optical fiber 242. The second optical fiber 242 transmits the laser beam to the optics assembly that launches the laser beam toward a surface to be removed. There is further provided fiber support structures 224, 225 and a plugging member 248, e.g., a swage-type tubing connector, which member 248 prevents the oil from entering the second fluid flow path.

The use of two or more fibers in a bundle is also contemplated herein, further the use of a single unitary fiber through the laser bottom hole assembly, as well as a bundle, e.g., a plurality, of unitary fibers, through the laser bottom hole assembly are contemplated.

The fluids that are used may be any type of fluid, e.g., a gas, liquid or foam that is known to the drilling industry or that can be used for drilling and which meets the requirements for laser drilling. Thus, for example, the fluid that flows in the laser path should have a composition that substantially transmits, transmits, or does not interfere with the laser beam. Preferably, the drilling fluid is air or nitrogen. Although it is preferred to have two fluid flows, additional separators and fluid flows are contemplated. Thus, a branching arrangement of fluid flows may be employed or a separator having a manifold assembly that separates a fluid flow from one flow to a plurality of flows may also be employed.

FIGS. 3A, 3B, 3C and 3D and their related cross-sectional drawings show an example of a middle section of a lower bottom hole assembly that contains a source of rotational movement, which in this example is an inverted mud motor. Although this type of motor is commonly referred to as a "mud" motor it should be under stood that the mud motor can be operated with most types of drilling fluids, including gasses, such as air and nitrogen. As used herein the term "inverted" means that the rotational components of the motor are reversed from that which is typically the case. Thus, the central screw portion does not rotate and the outer housing portion does rotate. Accordingly, there is provided a middle section 300 of a laser bottom hole assembly. The middle section 300 has an upper non-rotating housing 301. The middle section 300 can be viewed as having an outer rotating bearing section 302, an upper flex-shaft section 303, a motor section 304, a lower flex shaft section 350, an exhaust section 331 and a bit connector section 351.

The non-rotating housing 301 maybe attached to upper section 200 of the laser bottom hole assembly by a threaded connection, which preferably may be tapered. The non-rotating housing 301 extends inside of the bearing housing 314. Three bearing assemblies 311, 312 and 313 are positioned between the non-rotating housing 200 and the bearing housing 314. The bearing housing 314 rotates in conjunction with the source of rotational movement and the bit. The non-rotating housing 301, bearing housing 314 and bearing assemblies 311, 312 and 313 makeup an exterior rotational transition zone. These bearing assemblies 312, 313 and 311 address thrust and radial loads respectively and work in conjunction with each other. Bearing housing 313 further can be used to provide a preload to bearing assembly 311. Suitable bearing assemblies would include, for example, journal bearings, drilling fluid lubricated angular contact thrust ball bearings, diamond thrust bearings, sealed thrust bearings, and diamond thrust bearings. Thus, an exterior rotational transition zone would include, for example, any area where there is overlap between exterior housings or exterior supporting compo nets, such as exterior walls, where one such component is rotating and the other is not in the area of overlap.

Figure 3A:
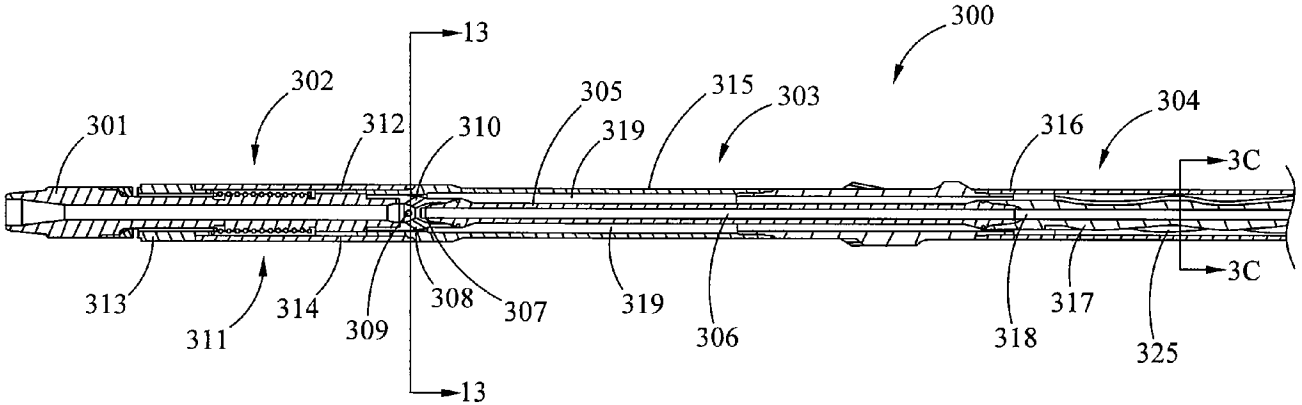
FIG. 3A is a cross-sectional view of the upper portion of a middle section of a laser bottom hole assembly of the present invention.

The tube 222 and optical fiber 242 are positioned within the non-rotating housing-bearing housing 301, 314 assembly. FIG. 3A shows this assembly without the tube 222 and optical fiber 242, while FIG. 3B shows this assembly with the tube 222 and optical fiber 242 in position, as would be the case when the upper section 200 is affixed to the middle section 300 of the laser bottom hole assembly. Thus, there can be seen the passage 229, through which the first fluid flow takes place, and which in this example, and at this point (i.e., section shown in FIG. 3B) is preferably air or nitrogen carrying a lubricating oil. There is also seen in FIG. 3B passage 230. The second fluid flow takes place through passage 230, and in this example, and at this point in the flow path (i.e., section shown in FIG. 3B) is preferably air or nitrogen that is essentially free of oil, assembly debris material and other types of debris and thus is of sufficient purity and cleanness to be suitable for contact with a laser beam and laser optics and more preferably a high power laser beam and high power laser optics.

The tube 222 and the passages 229 and 230 adjoin a flow manifold 307. The flow manifold has four ports, of which ports 308, 309 and 310 can be seen in the figures. The flow manifold 307 sealing adjoins with the non-rotating housing 301 and the upper flex-shaft 305. In this example the flow manifold 307 does not rotate. The upper flex-shaft 305 has a passage 306 that is in fluid communication with passage 230 and carries the second fluid flow. In this example, the upper flex-shaft 305, the flow manifold 307, the tube 222 and the non-rotating housing 301 do not rotate. The flow manifold may be joined to the non-rotating housing 301 and the upper flex-shaft 305 in a sealed manner to maintain the separation of the fluid flow paths. The flow manifold 307 additionally has non-rotating seal 320 with the tube 222. This seal 320 is intended to prevent the mixing of the fluids in the two flow paths. There is further provided sealing ring member 321.

Figure 5:
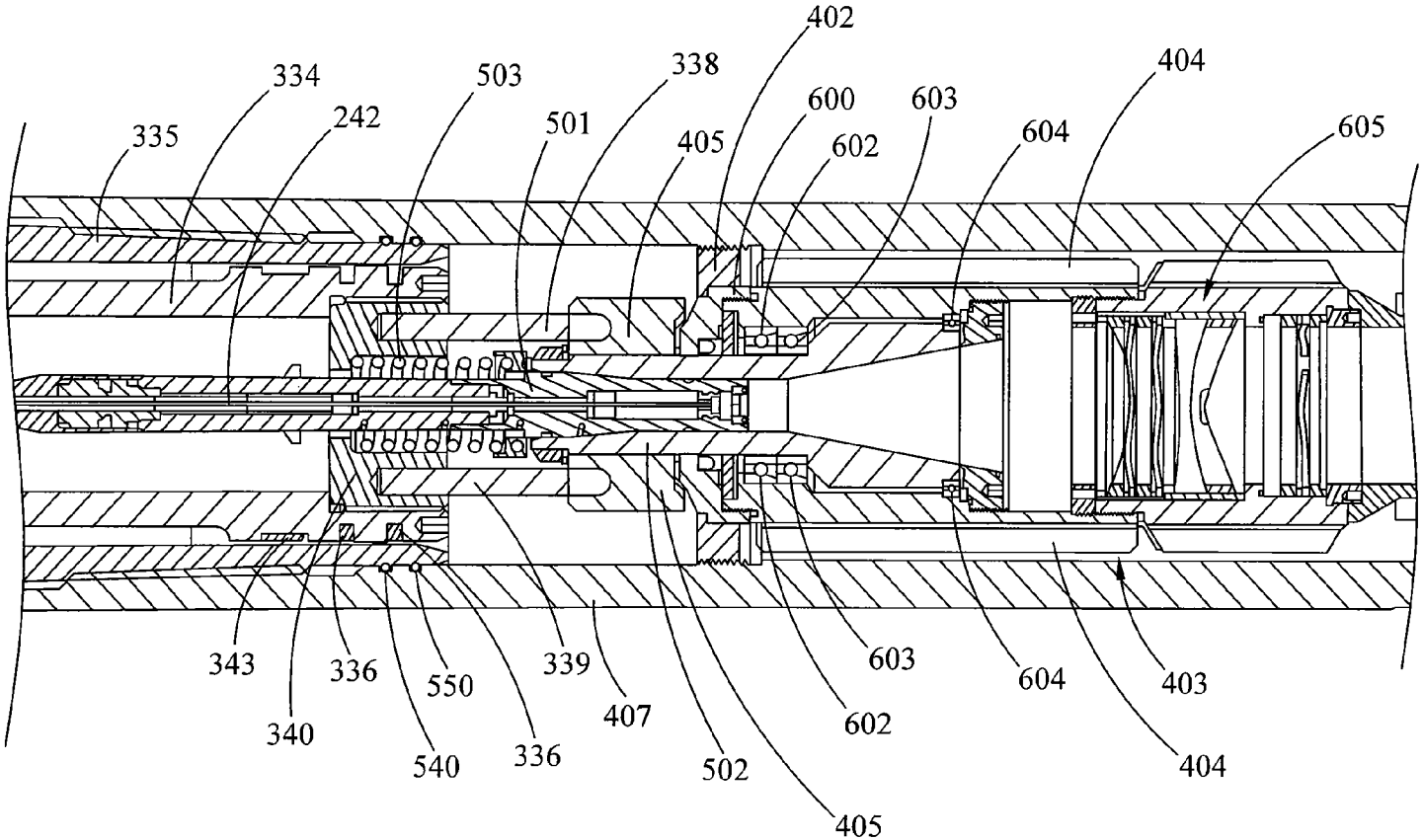
FIG. 5 is a cross-sectional view of the junction between the middle section of FIG. 3D and the lower section of FIG. 4 of a laser bottom hole assembly of the present invention.

In particular, when dealing with high power laser beams and high power laser optics in a downhole tool, it is desirable, strongly suggested, and highly preferable to design and configure the tool such that the fluid path for the laser optics and beam is not contaminated with assembly material debris, such as jointing compounds, pipe dope, anti-seize, thread shavings. Further, this assembly material debris can be created by vibration during operation and should be prevented from migrating into the flow path that is in communiation with the laser beam, the optics or both. To this end, the retaining-isolation member 321 essentially prevents, or greatly minimizes, such debris from entering the second fluid path. Such means for preventing contamination of the laser fluid should be employed at any assembly point or junction where potential contamination may be introduced. Various materials and configurations may be employed as sealing ring members, including, for example, polymers, DELRIN, Nylon, fluorinated ethylene propylene (FEP), viton, rubber, PEEK, garolite, PVC, or other material suitable for sealing. A further example of a means to protect against contamination of such assembly material debris during assembly and during operation is shown in FIG. 5. Thus, there are provided seals 540, 550 that are located between housing 407 and 335. These seals can be for example o-rings or the other type of sealing members and assemblies describe herein or otherwise available.

It is contemplated that the flow manifold 307 may rotate with respect to the flex-shaft, which does not rotate. Thus, various sealing members, sealing means, and positions may be employed and depending upon whether the flow manifold is rotating or non-rotating different configurations and placements may be used. For example, suitable seals, seal arrangements, seal placement, and assemblies would include: rotary lip seals, o-rings and rotary face seals.

The upper flex-shaft 305 is contained within an upper flex-shaft housing 315. The upper flex-shaft housing 315 rotates and is attached to the motor housing 316, which also rotates. The upper flex-shaft 305 is attached to upper end of screw member 317, which screw member does not rotate. The screw member 317 has a passage 318, which passage 318 is in fluid communication with flex-shaft passage 306. The ports, e.g., 310, of the flow manifold are in fluid communication with annular passage 319. This passage 319 is in fluid communication with progressive cavity 325 in the motor section 304. The passage 319 is annular and located between the housing 315, which rotates, and the flex-shaft 305, which does not rotate. The progressive cavity 325 is formed by the interrelationship of the crests 321 and roots 322 of the screw member 317 and the crests 323 and roots 324 of the outer gear member 320, which gear member 320 is affixed to motor housing 316 (the outer portion of gear member 320 may constitute the motor housing, if housing 316 is not present). The crests and roots of both the outer gear member and the screw member are arranged in a helical manner along the length of those members. The screw member and outer gear member (which components may also be called the rotor and stator respectively when used in a conventional motor) may be obtained from commercial sources such as P.V. Fluid Products, Ltd. of Houston Tex.

The terms rotation, rotate, non-rotation and similar terms are relative terms with respect to the components of the laser bottom hole assembly, and imply the capability to rotate during operation under intended conditions. These terms do not relate to, and are not effect by, unless expressly stated otherwise, the overall movement of that assembly. Thus, for example the housing 315 rotates relative to non-rotating flex-shaft 305 during intended operation, regardless of whether the entire laser bottom whole assembly is being moved or turned by the conveyance means.

Figure 3C:
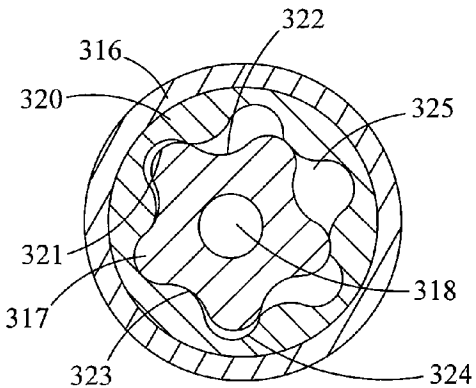
FIG. 3C is a transverse cross-sectional view of the middle section of FIG. 3A taken along line 3C.
Figure 3B:
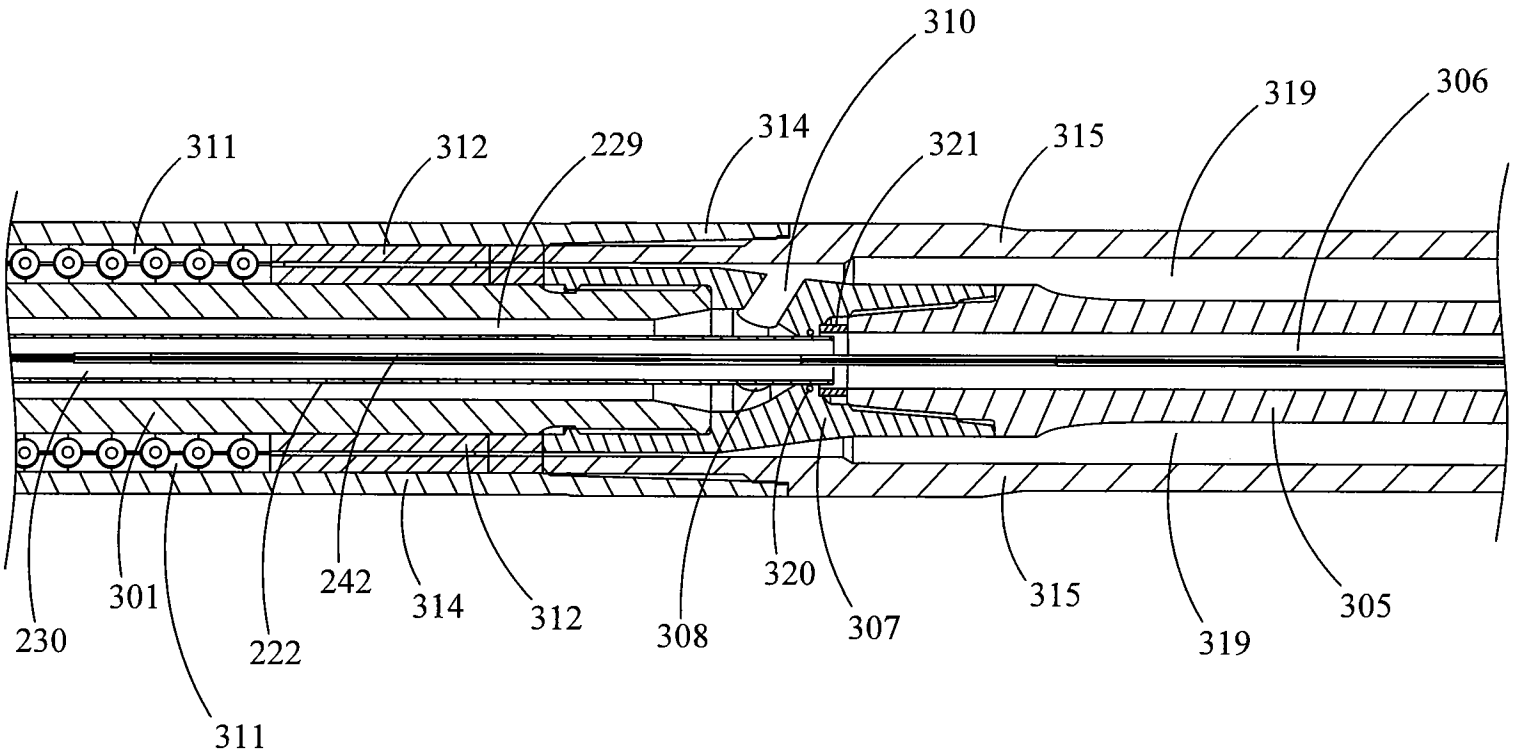
FIG. 3B is cross-sectional view of a portion of the middle section of FIG. 3A.

Thus, as can be seen from viewing FIGS. 3A and 3C, in operation the first fluid flow travels through passage 319 and enters progressive passage 325. The first fluid drives the rotation of the outer gear member 320 causing the progressive cavity 325 to spirally advance down the length of the motor section 304. The inner screw member 317 does not rotate. The screw member 317 and its passage 318, however, orbit around a central point of the motor housing. The upper flex-shaft provides a mechanical transition from the orbiting, non-rotating motion of the screw member 317 to the non-orbiting, non-rotating motion of flow manifold 307 and upper non-rotating housing 301. In addition the upper flex-shaft resists hydraulic down thrust created from the pressure drop across the power section. In the present example the screw member has 5 crests and roots and the outer gear member has 6 crests and roots. A screw member with 7 crests and roots and an outer gear member with 8 crests and roots is also contemplated, however, other variations in the number of crests may be utilized. The number of crests and roots for this type of motor assembly must be n crests and roots (where n is an integer) for the screw member and n+1 crests and roots for the outer gear member. The number n, as well as, other factors including, for example, pitch, functional diameter, pitch diameter, number of stages, root and crest shape, amount of interference between screw and internal gear, hardness of internal gear, and the length of the motor section can be varied to obtain the desired range of RPMs and torques for a particular application.

The first fluid flow path also is in fluid communication with the bearing assemblies 311, 312, and 313 in the upper portion of the middle section and the bearing assemblies 341 and 342 in the lower portion of the middle section. In this manner the first fluid having a lubricant therein can be used to provide lubrication to those bearings. Further if provisions are made of the fluid to flow through, over or past the bearing assemblies the fluid can be used to cool the bearings.

The lower portion of the motor housing 316 attaches to the upper portion of the lower flex-shaft housing 329. The lower flex-shaft 327 is positioned, for example, within the lower flex-shaft housing 329. The lower flex-shaft housing 329 rotates in conjunction with the motor housing 316. The upper end of the lower flex-shaft 327 is attached to the lower end of the screw member 317. The lower flex-shaft 327 has a passage 328 that is in fluid communication with passage 318 of the screw member 317. There is also provided an annular passage 330 that is in fluid communication with progressive passage 325. The lower flex-shaft is attached to an inner lower non-rotating housing 334. The lower flex-shaft 327, like the upper flex-shaft 305 does not rotate and provides a mechanical transition from the orbiting motion of the screw 317 and passage 318 to the non-orbiting, non-rotating lower housing 334 and its associated non-orbiting cavity 337. At all connections points between the flex-shafts and other components forming the second fluid path, preferably a sealing means for preventing contamination of the fluid should be employed.

The lower flex-shaft housing 329 is connected to exhaust housing 360 in exhaust port section 331, which section is attached to an outer lower rotating housing 335. The inner lower non-rotating housing 334 is positioned within the outer lower rotating housing 335. There is provided within the inner lower non-rotating housing 334 a cavity 337, which is configured to contain the optical fiber 242 and an optical connector 501 (as seen for example in FIG. 5).

Figure 3D:
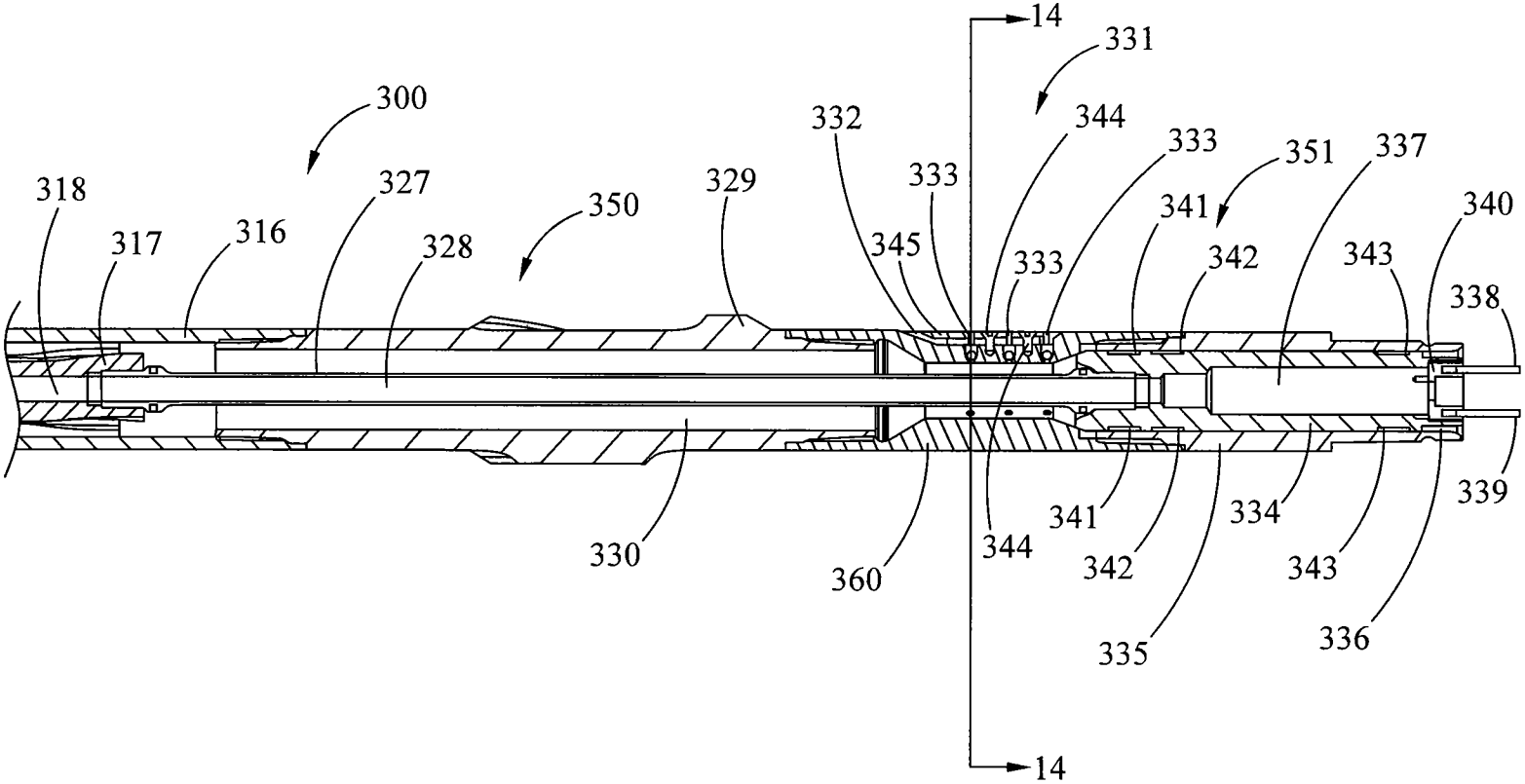
FIG. 3D is a cross-sectional view of the lower portion of the middle section of FIG. 3A of a laser bottom hole assembly of the present invention.

The exhaust section 331 contains exhaust port 332. (one exhaust port is seen in FIG. 3D; although several exhaust ports are contemplated including, for example, 2, 3, 4 and 5 such ports) The exhaust port 332 is formed by an exhaust plate 345 and the outer surface of exhaust housing 360. It is further provided in this example that the exhaust plate 345 is attached to the exhaust housing 360 by way of screws or bolts 344. The exhaust port 332 is in fluid communication with passage 330. In this way the first fluid flow is expelled out of the exhaust ports 332. The shape of the exhaust ports 332 and the surfaces and relative positions of the plate 345 and housing 360 that make up the exhaust port are such that the flow of the expelled first fluid flow is in a direction that is up the borehole toward the surface, and that preferably is such that the shapes function as an air amplifier, or such that they utilize the COANDA effect to move cutting up and out of the borehole. Check valves 333 are also associated with the exhaust section 331 to prevent back flow from entering into passage 330 and thus to assist, in part, to maintain the integrity of the separate flow paths.

There is further provided bearings in the form of bearing assemblies 341, 342, 343. These bearings may be similar to the bearings in section 302, which are discussed above. The bearings serve to constrain the lower end of the lower flex-shaft, along with the fiber optic cable, to the center of the outer housing(s).

In general, and by way of example, the bearings utilized in the laser down hole assembly can be be sleeve bearings, angular contact bearings, thrust bearings, roller bearings, tapered roller bearings, needle bearings, or any combination of these as long as axial movement can be tolerated. One means of toleration of axial movement can be the use of sleeve bearings, while another is to have a splined component.

There is also provided a rotary seal assembly 336. The rotary seal assembly is intended to keep the first fluid essentially separated from, e.g., not contaminated by, the second fluid. Thus, in the present example, the rotary seal assembly 336 essentially prevents the oil in the first fluid flow from significantly contaminating, the clean laser gas. Thus, the rotary seal maintains sufficient separation of the two flows so that the second flow and be used for its intended purpose. As described below, the second fluid flow through cavity 337 and into the lower section 400 of the laser bottom hole assembly, where it cools the optics, the bit, and keeps the laser beam path free of debris. The rotary seal assembly may be for example, a spring energized lip seal, such as for example, those provided by Parker Hannifin Corp., lip seals, face seals, spring energized seals, single acting seals, double acting seals, or any combination of those listings in a variety of materials, such as elastomers, Teflon, impregnated teflons of various sorts) and preferably is a pair of spring energized single acting lip seals.

There is also provided at the lower end of the middle section 300 a pin end member 340 and pins 338, 339 (although two pins are shown, none, one, a plurality, or the other forgoing mentioned pin alternatives are contemplated).

The exterior rotation housings in the lower bottom hole assemblies typically rotate to the right but may also rotate to the left depending upon particular design considerations and uses. When using threaded joints at junctions for the components of the laser bottom hole assembly in general for a right hand rotating laser bottom hole assembly the threads make-up to the right and for a left hand rotating assembly the threads make-up to the left. However, the direction of make-up may vary from component to component based upon design and operations considerations.

The non-rotating passages, such as for example passage 318, provide a passage that in addition to transmitting a fluid and containing an optical fiber for transmitting a high power laser beam, may be used to communicate data and/or power, via wires, and/or light, via fiber optic cable. In the case of electricity, the passage may be used, for example, to transmit data and/or power between sensors in the lower end of the source of rotating motion, e.g., a mud motor, turbine or electric motor, and an M/LWD (measuring/logging while drilling) system above the mud motor. The passage may also be used to transmit data and/or power between an M/LWD system and rotary steering system. A fiber optic cable may be used to transmit sensor data; also, a fiber optic cable may be used to transmit power from above the motor's power section to be used to enhance the drilling process.

Figure 7:
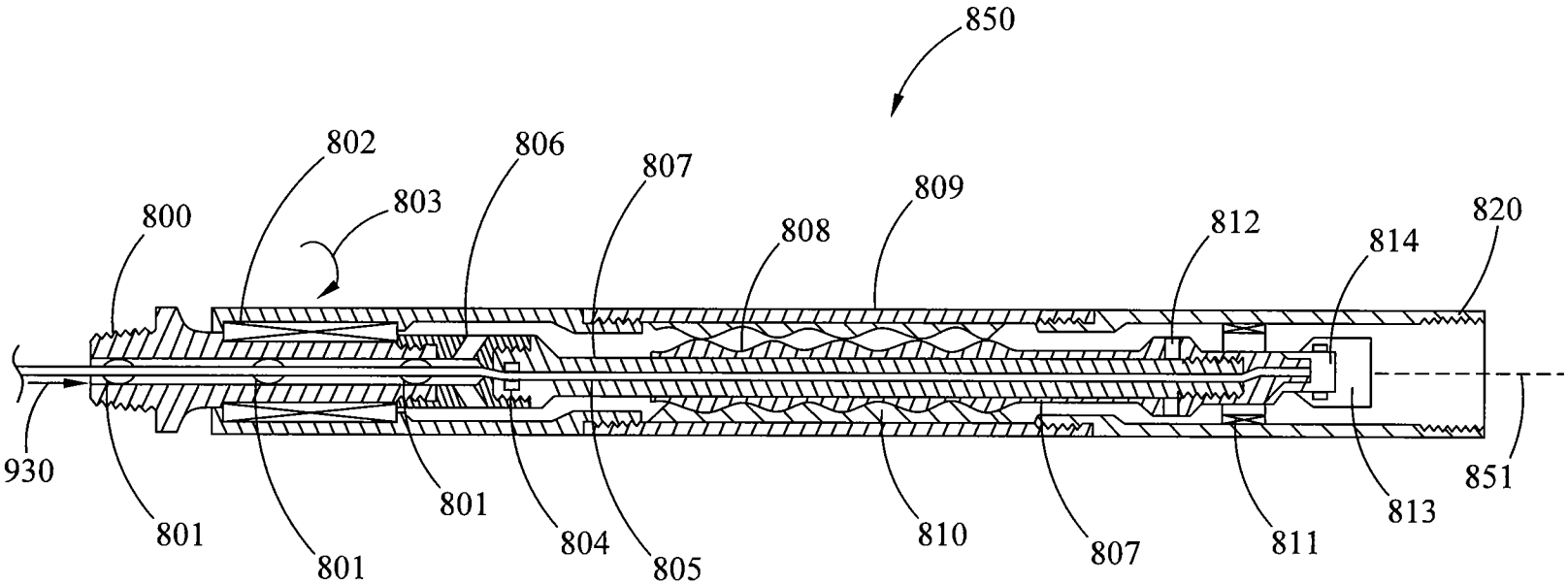
FIG. 7 is a cross-sectional view of a laser bottom hole assembly of the present invention.

In FIG. 7 there is provided an example of a dual rotating element motor having a basic power section 850 having by way of example components including, for example, a rotor 808 and stator 810 (which in combination provide an internally helically profiled motor body). This example, its components and its design, utilize or are based on hypocycloidal geometry. The rotor 808 is mounted on a journal shaft 807. The journal shaft 807 is slightly offset radially from the tool axis 851. The journal shaft 807 is affixed to mandrel 800, which is associated with bearing assembly 802. Bearing assembly 802 is also associated with housing 809. The journal offset or eccentricity is a function of the design geometry of the power section elements and is defined by the conventional design formula e=½*(rotor major diameter−stator minor diameter). (In this case, though, the "stator" 810 actually rotates). The rotor 808 is free to rotate, but not to orbit. Thus, the rotor 808 is rotatable about the journal 807, which journal 807 does not rotate. The rotor 808 is position in housing 809, which housing 809 is affixed to stator 810. Both housing 809 and stator 810 rotate. In this configuration the external motor body (normally thought of as the stator, 810) must rotate if fluid is to pass through the power section, as show by arrow 930 indicating direction of fluid flow. The journal shaft transmits reactive torque to the drill string. Thrust bearings 812 are needed between the bottom of the rotor and the shoulder of the journal shaft. The lower end of the journal shaft must also be supported on radial bearings 811 that maintain its eccentricity with respect to the axis of the motor body. There is also provided in this example a flow diverter 806, a seal 804 and a passage 805. There also is provided optical/electrical connection/transmission means 814, 813. Centralizers 801 may also be employed. A connector end 820, such as a treaded connection, is also provided for connection to a bit, tool or other motor component. The direction of rotation of the external housings is shown by arrow 803.

The example illustrated in FIG. 7 further can serve as a speed increaser as compared to a conventional mud motor. This may or may not be advantageous, depending on the optimum speed of a given drill bit drilling through a given rock. This configuration lends itself well to passing a passage through/past the power section. The journal shaft upon which the rotor is mounted may have a drilled hole, which serves as a passage for electrical, optical, liquid, or gas transmission as described above. The journal shaft does not rotate with respect to the conveyance means, e.g., a drill string, and as such allows the passage to communicate from the top of the motor to the bottom of the motor, at which point an electrical, optical, or fluid coupling may serve to transfer the media from non-rotating to rotating members.

Figure 8:
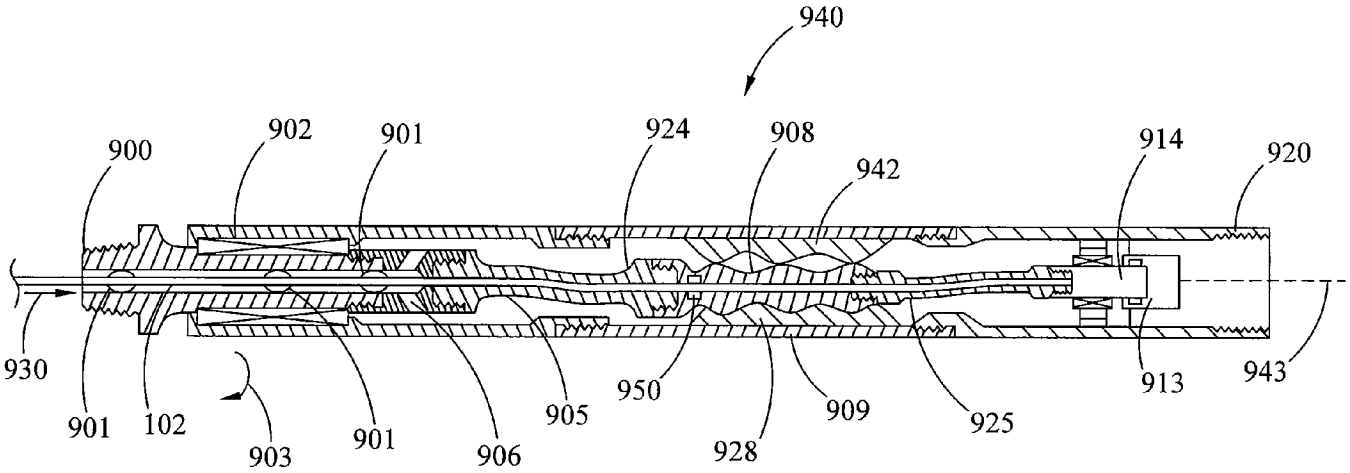
FIG. 8 is a cross-sectional view of a laser bottom hole assembly of the present invention.
Figure 9:
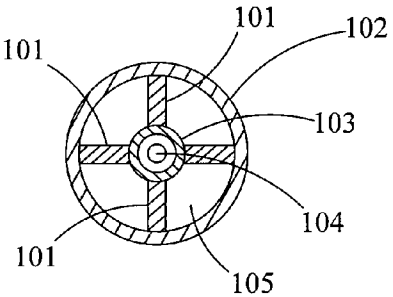
FIG. 9 is a transverse cross-sectional view of a centralizer of the present invention for a fiber optic cable.
Figure 10:
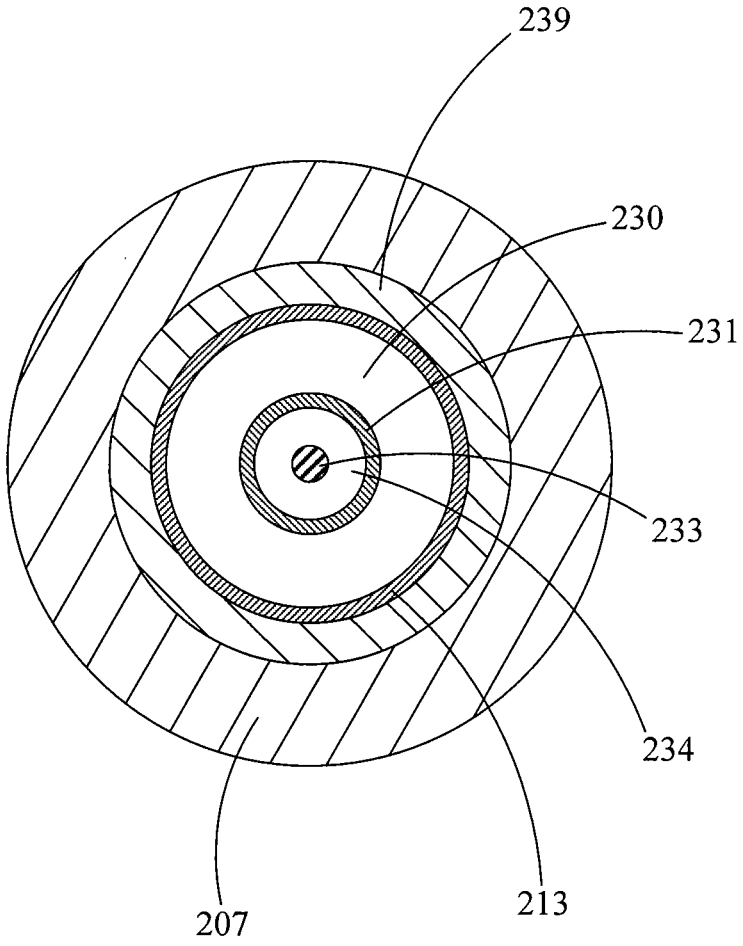
FIG. 10 is a transverse cross-sectional view of the laser bottom hole assembly of FIG. 2A taken along line 10.
Figure 11:
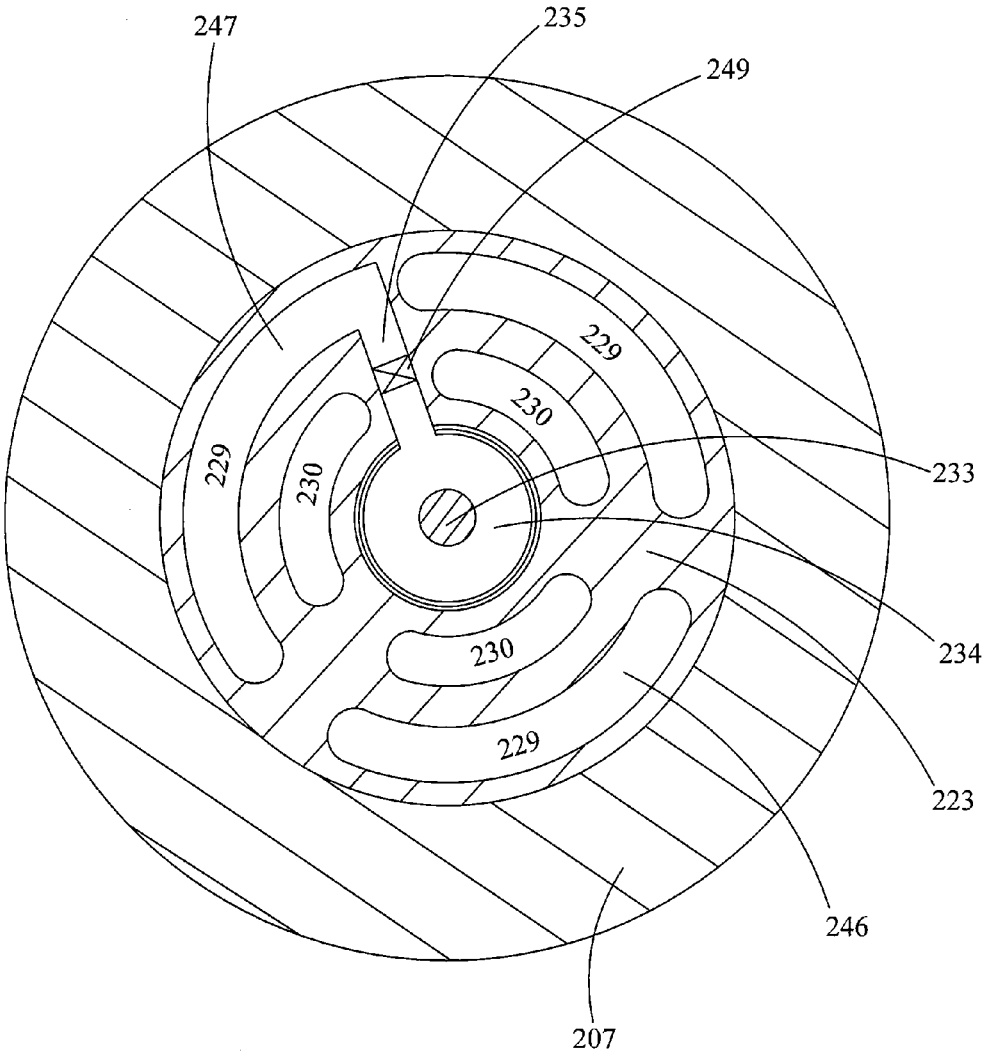
FIG. 11 is an enlarged transverse cross-sectional view of the laser bottom hole assembly of FIG. 2A taken along line 11.
Figure 12:
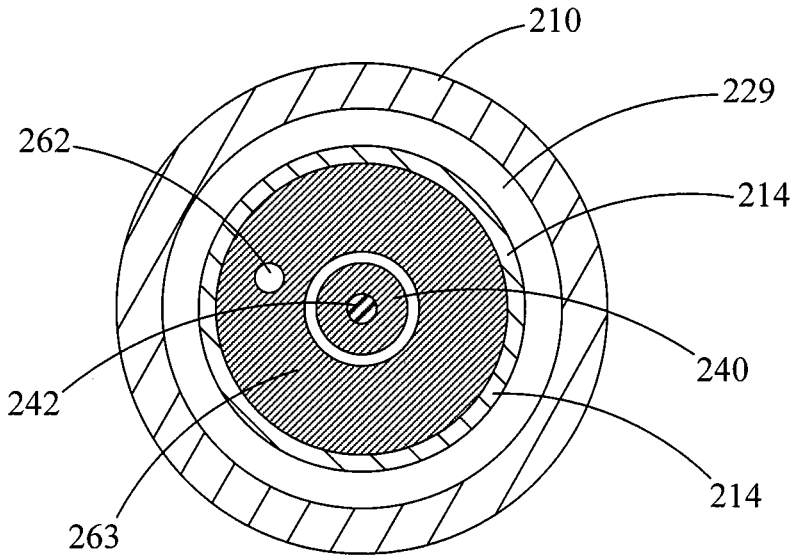
FIG. 12 is an enlarged transverse cross-sectional view of the laser bottom hole assembly of FIG. 2B taken along line 12.
Figure 13:
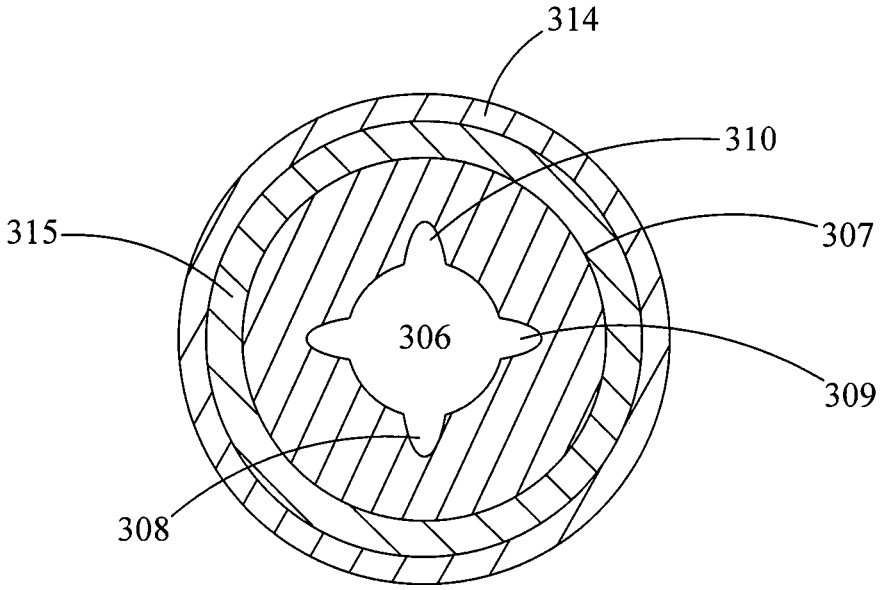
FIG. 13 is an enlarged transverse cross-sectional view of the laser bottom hole assembly of FIG. 3A taken along line 13.
Figure 14:
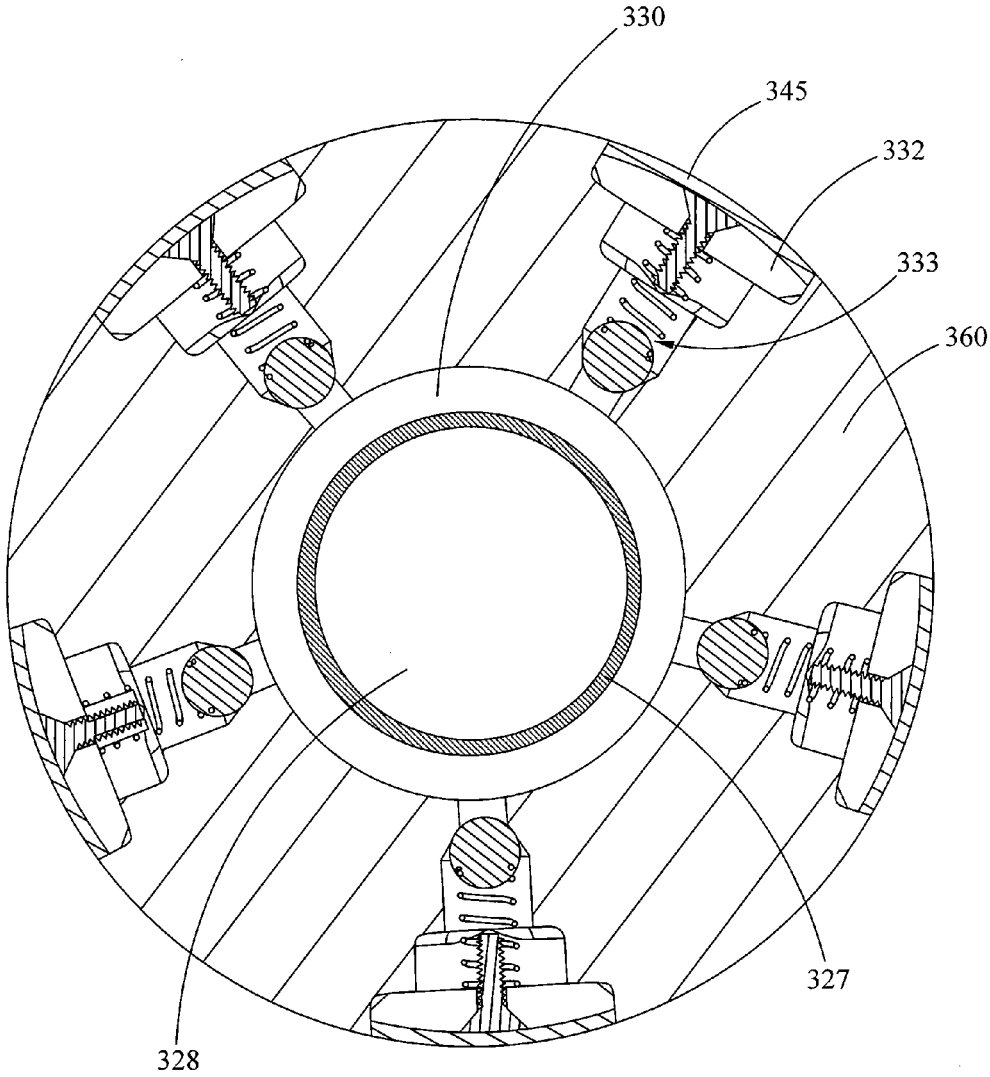
FIG. 14 is an enlarged transverse cross-sectional view of the laser bottom hole assembly of FIG. 3D taken along line 14.

In FIGS. 8 and 9 there is shown an example of an inverted mud motor in which the mandrel 900 of the motor is connected to the drill string. A bearing assembly 902 is disposed between the mandrel 900 and the motor body 930 to transmit internally generated hydraulic thrust loads and externally applied loads (such as bit force) from the motor body 940 to the mandrel 900. In this configuration the motor housing 909 of the motor body 940, as well as the motor body 940 itself, rotate when fluid is pumped through the motor as shown by arrow 930. The power section 942 of the motor is inside the motor body 940 and below the mandrel 900 and bearing assembly 902. (This is unlike the configuration of mud motors commonly used today, in which the power section is above the bearing section, and does not rotate with respect to the drill string.) In the power section 942, a hollow screw shaft 908, having passage 905, is attached by an upper hollow flexible shaft 924 to the mandrel 900. When fluid is pumped through the motor, the flexible shaft 924 allows the screw shaft 908 to orbit around the center point/line of the longitudinal axis 943, i.e., "the tool axis," of the motor housing 941. The flexible shaft, however, prevents the screw shaft 908 from rotating with respect to the mandrel 900. A lower flexible conduit 925 is attached at the lower end of the screw shaft 908. This lower flexible conduit 925, may be a hollow shaft similar to the previously-mentioned flexible shaft or flex-shafts, or may be a lower-strength flexible member such as a hose. The mandrel 900, upper hollow flexible shaft 924, hollow screw shaft 908, and lower hollow flexible conduit 925 in combination provide a passage for wires, high power laser optical fibers and/or fiber optic cable to facilitate transmission of data and/or power. Thus, there is provided centralizer 902, having ribs 101, a tubing 102, which may be a protective sheath, a fiber optics bundle or an optical fiber 104 and a flow path 105 to flow a drilling fluid, e.g., liquid, gas, foam, air or nitrogen. The screw shaft 908 meshes with an internally helically profiled inner gear 928, which is affixed to motor housing 909. The direction of rotation of the external housings is shown by arrow 903.

During operation the upper hollow flexible shaft and other hollow components provide a passage for conveying a member (such as a wire, bundle of wires or fibers, or fiber optic cable) from the mandrel, which is generally concentric with the tool axis, to the screw shaft, which is offset from the tool axis. Likewise, the lower flexible shaft provides a conduit for conveying a passage from the screw shaft (which again is orbiting offset to the tool axis) to the rotating body, where the lower flexible conduit allows the passage to be brought to be concentric to the tool axis. There is provided a threaded section 920 for attachment of a bit, additional section of a laser bottom hole assembly, or a downhole tool.

The lower flexible conduit provides a useful point to make an electrical or optical connection 914 between the non-rotating passage and another, rotating, passage in the rotating body. In the case of electrical wires, the fact that the lower flexible conduit brings the wires back to the tool axis facilitates the use of a contact-type slip ring type coupling. Alternatively, a non-contact coupling such as an inductive coupling may be used. In the case of optical cable, a collimator may be used to direct the light emanating from the non-rotating fiber optic cable to a fiber optic coupling, to a rotating fiber, or to a rotating lens 913 mounted in the rotating body, or to a non-rotating lens, in which chase an addition transfer to a rotating optic may be called for. Further additional and multiple transfers are contemplated. In both cases, a means is provided to transmit data or power from a drill string, past a mud motor power section, and to a rotating section of a tool or motor.

In addition to transmitting electrical or optical data, signals, or power, the passage may also be used to communicate a hydraulic or pneumatic fluid from the drill string and past the power section.

In a preferred configuration, for the above example, the tubing 102 is about 1" OD (outside diameter) with fiber optic cable 104 enclosed in a ⅛" stainless steel tubing sheath 103 running through the tubing 102 ID (internal diameter). To the extent that vibrations for fluid flow may induce vibrations, or for other reasons, the tube 102 can be supported with centralizers 901 through the mandrel. Preferably the fiber optic sheath tubing is also supported by centralizers to minimize its lateral movement and its ability to impact the passage tubing ID as the screw shaft orbits. The space between the fiber optic cable and its sheath may be filled with a fluid to dampen vibrations.

If a flow regulator is not used, then the passage within the hollow members, should be sealed at some point to prevent the motor driving fluid from bypassing the screw shaft. Preferably the passage is sealed at the top of the rotor, by seal 950, other locations for the seal placement could include the flow diverter 952 (below the ports 906), the upper flex shaft 924, or the lower flex shaft 925.

The tubing passage may extend all the way from the top of the motor (i.e., the end closest to the surface) to the electrical coupling, collimator, and/or optical coupling near the bottom of the motor. In this, and all, case(s) a fairly large annulus is required between the tubing passage and the mandrel & flow diverter ID to allow flow of the motor driving fluid. However, little clearance is needed between the passage tubing and the drilled holes through the flexible shafts and the screw shaft. In an alternate design (not illustrated) the passage tubing may end at the bottom of the flow diverter, or in the top of the upper flex shaft, to prevent the passage tubing from having to endure cyclic bending as the flex shaft accommodates the orbital movement of the screw shaft. In this case the drilled holes through the upper and lower flex shafts and through the screw shaft serve as the passage, as the fiber optic cable and its sheath still pass all the way through the ID bores and terminate below the power section at the collimator or coupling, or other optical device (i.e., mirror).

It should be understood that in this example, and other configurations contemplated herein, the loads on the upper flex shaft are significantly greater than those imposed on the lower flex shaft. The upper flex shaft must transmit reactive the torque of the power section to the mandrel. In addition, it must withstand a longitudinal tension force due to the pressure drop across the power section. The lower flex shaft, on the other hand, does not have to transmit power section torque; it must only accommodate the orbital motion of the screw shaft and bring the fiber optic cable into alignment with the collimator or fiber optic coupling. The lower flex shaft also may have to withstand some positive or even negative internal pressure relative to the pressure of the fluid exhausting from the power section. The lower flex shaft overall strength requirements are much lower than those of the upper flex shaft. As such, it may be a smaller diameter than that of the upper flex shaft, and may even be made of a high-temperature hose material or a composite material. It may be beneficial to size the upper connection of the lower flex shaft to be smaller in diameter than the minor diameter of the screw shaft, so that the screw shaft and lower flex shaft may be installed through the helically profiled body as an assembly.

In a further example, not illustrated herein, the mud motor is configured with the rotor inside the stator as in a conventional mud motor. In this configuration, the stator is part of the external motor body and does not rotate with respect to the drill string; also, what was the mandrel in the first embodiment now becomes the output shaft (as with the prior art motor). Fiber optic cable runs through the laser bottom hole assembly and terminates in a optical coupler in the top of the motor. The top portion of the fiber optic coupler does not rotate with respect to the laser bottom hole assembly; the bottom half is mounted to a flexible shaft which is attached to the rotor. The flexible shaft allows the bottom half of the coupler to stay aligned with the upper half of the coupler and accommodate the orbiting action of the rotor. The lower portion of the coupler is attached to a second fiber optic cable that passes through a passage in the rotor. A flexible shaft is attached to the lower end of the rotor, and to the upper end of a bit output shaft. This allows fiber optic cable to transmit data and/or power through the motor to the bit or any other tool attached to the bottom of the motor.

This example is similar to the example illustrated in FIGS. 8 and 9, but turned up-side-down, so no illustration is given. The greatest practical design difference between these two is that what was previously the upper flex shaft is now the lower flex shaft, and that the hydraulic thrust from the power section will now put this shaft in compression instead of tension. It must therefore be designed for buckling instead of tension. Another minor difference may be that the end connections may reverse, e.g. the output shaft connection may be a box instead of a pin.

Figure 4:
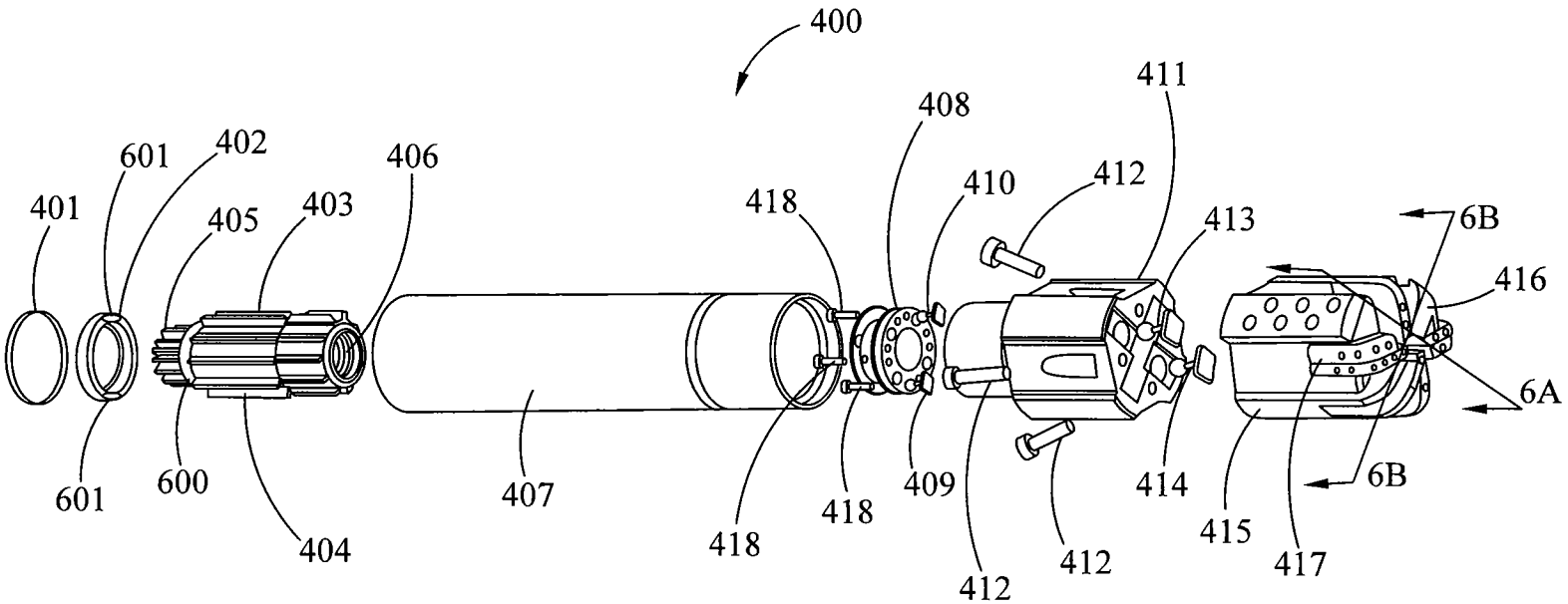
FIG. 4 is an exploded perspective view of the lower section of a laser bottom hole assembly of the present invention.
Figure 6A:
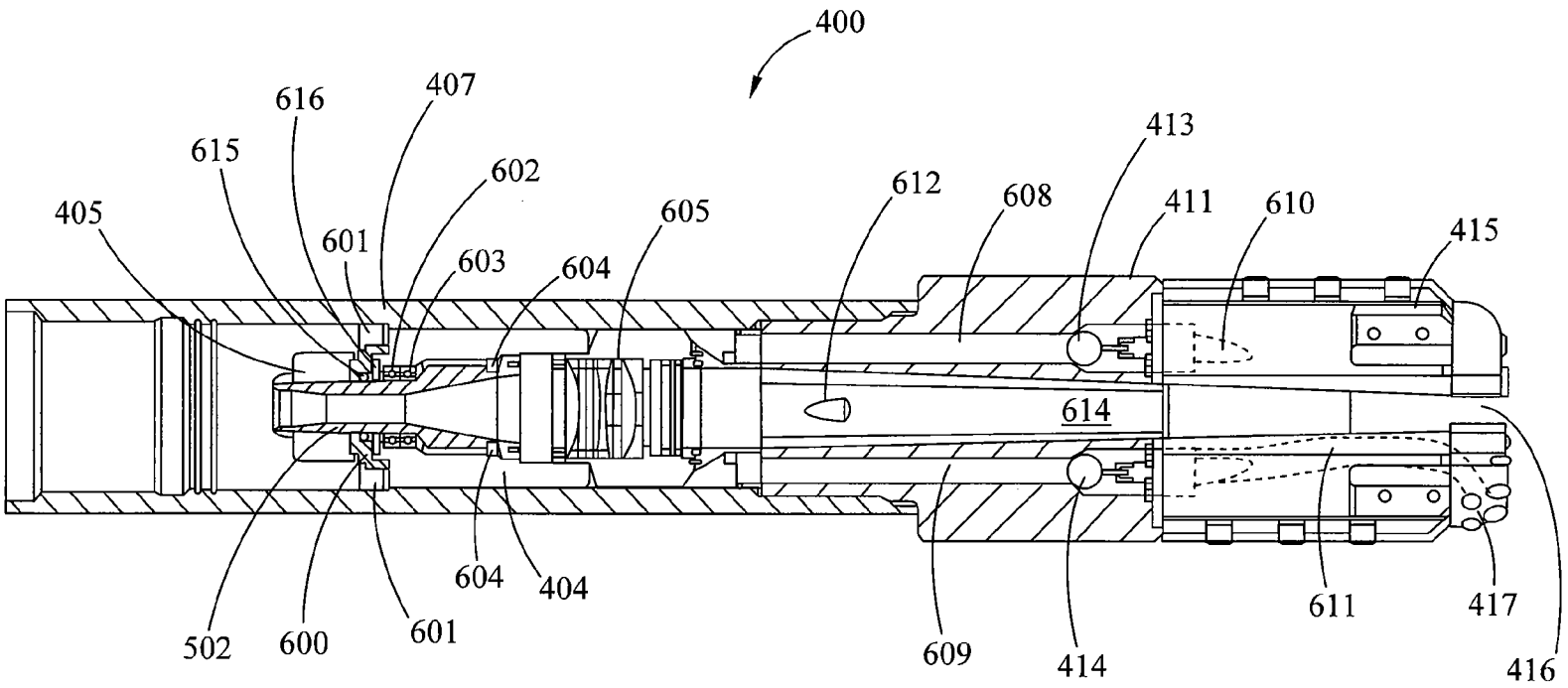
FIGS. 6A and 6B are cross-sectional views of the lower section of FIG. 4 taken along lines 6A and 6B respectively.
Figure 6B:
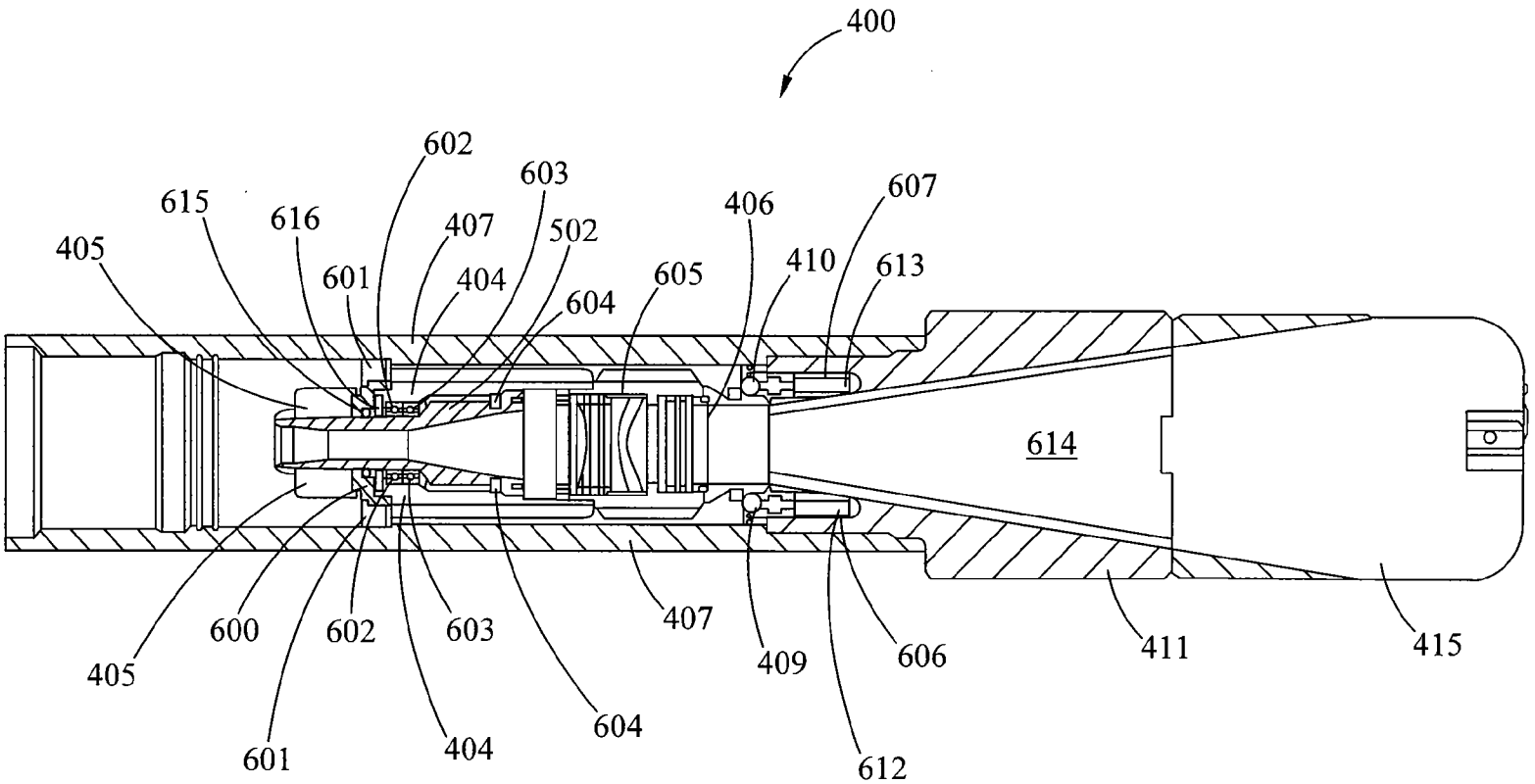

An example of a lower section of laser bottom hole assembly is shown in FIG. 4 and FIGS. 6A and 6B. The junction between the middle section and the lower section is shown in FIG. 5. Thus, turning toward these figures there is provided lower section 400 of a laser bottom hole assembly, having an optics housing 407, a laser beam guide housing 411 and a bit 415. Associated with the optics assembly 403 is an o-ring 401, an optics retainer ring 402 having openings 601. The optics assembly has a window 406, through which the laser beam is transmitted to the surface to be removed. The openings 601 provide a flow path for the second fluid and are in fluid communication with passage 337, which is in fluid communication with passage 328. Fins 404 are associated with the optics assembly 403 and are cooled by the flow of the first fluid. Fins 405 are fixedly associated with support housing 502 and are adjacent engagement member 600.

During assembly the pins 339, 338 gradually move into the space occupied by fins 405, as the pins move into this space they move between the fins 405 and restrict the degree of rotational movement of the fins 405 and housing 502. Fins 405 and housing 502 are rotatable with respect to optics housing 407, and optics assembly 403, prior to engagement with the pins. This pre-assembly ability to rotate permits the fins 405 to rotate slightly to prevent jamming of the pins 338, 339 against the fins 405 during assembly. Depending upon the shape and number of pins and fins various angles, shapes and arrangements may be used to ease assembly. Further, the fins 405 may also provide cooling. Once engaged the pins 338, 339, which are non-rotating, essentially prevent the fins 405 and housing 502 from rotation, and thus as assembled the fins 405 and housing 502 is consider to be a non-rotating internal component of the laser bottom hole assembly.

Associated with the pin end member 340 is a spring 503 and an optical connector 501. When assembled the spring provides a load on the housing 502 and its associated components. The spring further may serve to protect the connector during assembly and to permit slight movements of the connector to address minor alignment issues during assembly.

The optics assembly 403 and its associated optics 605, as well as engagement member 600 are fixedly attached to optics housing 407; and all of these components rotate. Bearings 602, 603 and 604 are positioned between these rotating components and the non-rotating housing 502.

Thus, and by way of example, the transition between the connector 501, which does not rotate, and the optical assembly 403, which does rotate, is an internal rotational transition zone that is contained within a rotating external housing. Thus, an interior rotational transition zone would include, for example, any area where there is overlap between interior components, such as interior housings, where one such component is rotating and the other is not in the area of overlap.

The lower section 400 may also contain an optics support manifold 408 that is affixed between the beam guide housing 411 and the optics housing 407. By way of example, the manifold 408 is attached to housing 411 by way of screws or bolts 418. There is also provided check valve assembly 409 and check valve assembly 410. Check valve 409, 410 are in fluid communication with passages 606 and 607 respectively. These check valves are intended to prevent back flow into the passages for the second fluid flow. The second fluid flow through passages 606 and 607 are intended to keep the laser beam path, in the laser beam channel 614 essentially free from debris and to protect the window 406 from debris. The fluid flow exits passages 606 and 607 at openings 612 and 613 respectively, entering the beam channel 614 and exiting the beam channel 614 through opening 416 in bit 415.

There also may be check valves 413 and 414. These check valves are in fluid communication with passages 608 and 609, respectively, and are also in fluid communication with passages 610 and 611 respectively. Theses check valves prevent back flow into passages 608 and 609. In operation the second fluid enters passages 608, 609 flows past check valves 413 and 414, into passages 610, 611 and exits the bit at openings 416, 417. The fluid flow through these passages is intended to cool the bit and the bit cutters, in particular, it is preferred that openings 416 and 417 direct flow toward the gage cutters. The bit 15 is attached by way of example to the beam guide housing 411 by bolts 412.

In operation the manifold 408 divides the second fluid flow to two sets of flow paths. The set of flow paths is to protect the optics window and beam path from debris and the second set is to provide cooling to the bits. The balance of flow rate between these two sets of paths is determined by the various orifice sizes, passage dimensions and exit opening configurations that are present in the flow path. Further, it will be understood that this flow upon exiting the bit assists in carrying the cuttings or debris up the borehole.

The outer housings, and other similar structural components of the laser bottom hole assembly can be made from any suitable material that is used for the construction of downhole tools and equipment, and meets the intended purpose requirements, strength requirements, chemical resistivity requirements, and end use environmental requirements for the component, including, for example, metals, steel and composite materials. For example, the housings may be made from high strength steel, and preferably are made from SAE 4145 and further may be made for a quenched and tempered AISI 4100 series steel, such as 4130, 4140, 4145, 4145H, or a quenched and tempered AISI 4300 series steel, such as 4330, 4330V and 4340.

Further the internal components, such as for example lower internal housing 214 and centralizes 215 may be made from any suitable material, e.g., steel, metals, aluminum allows, high density high strength polymers, and composite materials, which suit the components intended purpose, strength requirements, chemical resistivity requirements, and end use environmental requirements. For example, such materials may be SAE 17-4 PH.

The outer surface of the crests 321 and roots 322, or the entire screw member 317, may be made from any materials, which suit the components intended purpose, strength requirements, chemical resistivity requirements, and end use environmental requirements. For example, for example SAE 17-4 PH with a hard chrome surface plating or a tungsten carbide plating may be used for the construction of these surfaces or the entire screw member 317.

The inner, i.e. contacting, surfaces of the crests 323 and roots 324, or the entire gear member 320 may be made from any materials, which suit the components intended purpose, strength requirements, chemical resistivity requirements, and end use environmental requirements. For example, nitrile rubber may be used for the construction of these surfaces or the entire gear member 320. It being recognized that the material for the outer gear surface and the screw member surface must be capable of properly interacting so that they form a seal around, or otherwise seal, the progressive cavity as it is advanced along the motor section. In this way the screw and gear function in a manner that has been referred to as a positive displacement motor.

The flex-shafts and flexible shafts, disclosed herein, may be made from any materials, which suit the components intended purpose, strength requirements, fatigue requirements, chemical resistivity requirements, and end use environmental requirements. For example, these flexible hollow members may be made from SAE 17-4 PH, or may be made from stainless steel, quenched and tempered E4330V or titanium.

Additionally, the laser bottom hole assembly may have the optical fiber cable, cables or bundles of cable in several configurations. Thus, such high power energy laser beam transition means can follow a helical path, a straight path, a sinusoidal path, or a combination of these paths, portions of these paths, or other paths, thought the various sections of the laser bottom hole assembly. The external housings, and the laser bottom hole assembly have a centerline. These various configurations of the optical fiber path will also have a centerline. The relationship of these various centerlines is managed by the laser bottom hole assemblies provided herein and contemplated by the present invention. Thus, the straight, the helical the sinusoidal and other optical paths will each have their respective centerlines and there is presented a system for managing these high power laser fiber optic cable in a laser bottom hole assembly and in particular in a reverse Moineau motor laser mechanical bottom hole assembly that has a high power laser fiber optic cable positioned in the external housing of the laser bottom hole assembly and that has a path within the external housing, the rotating sections of the external housing and the non-rotating screw member. This rotating external housing section would have a centerline and the non-rotating screw member having a centerline. However, these two centerlines would be parallel but would not be coaxial. Thus, by way of example, the fiber optic cable may be positioned within the non-rotating screw member and along the non-rotating screw member centerline while also being positioned along the external rotating housing centerline. Accordingly the path of the fiber optic cable through the laser bottom hole assembly would be seen as moving from rotating housing member centerline to the screw member centerline and then back, on center, to rotating housing centerline, if the assembly was viewed from top to bottom in cross section along the axis. It should be understood, that exact coaxial arrangement is not required. All that is required is that the centerlines are sufficient close as to not cause damage to the fiber, binding of the assembly or otherwise interfere with operation and delivery of the laser beam to the bit. Further, the entirety of the centerlines does not need to be coaxial only a sufficent portion of the centerlines needs to be coaxial to meet the aforementioned considerations.

The invention may be embodied in other forms than those specifically disclosed herein without departing from its spirit or essential characteristics. The described embodiments are to be considered in all respects only as illustrative and not restrictive, and the scope of the invention is commensurate with the appended claims rather than the foregoing description.

What is claimed is:

1. A laser bottom hole assembly comprising:

a. an end having an opening for receiving a fluid flow and a means for providing a laser beam having at least 5 kW of power;

b. a means for separating the fluid flow and conveying the means for providing the laser beam, the means for separating the fluid flow and conveying the means for providing a laser beam in fluid communication with the fluid flow, a first fluid path and a second fluid path, whereby in operation the fluid flow is separated into the first fluid path and the second fluid path;

c. an external housing comprising a rotating section, a non-rotating section, and an external rotational transition zone, the rotating section of the external housing comprising rotating and non-rotating internal components;

d. the means for separating the fluid flow and conveying the means for providing a laser beam, and the first and second fluid paths positioned within the external housing;

e. a means for providing rotational movement comprising a non-rotating screw member, at least a portion of the second fluid path contained within the screw member and at least a portion of the means for providing a laser beam within the screw member;

f. an internal rotational transition zone within the rotating section of the external housing, whereby a transition from the non-rotating internal components to the rotating internal components occurs; and, g. an exhaust port in the rotating section of the external housing, the exhaust port in fluid communication with the first fluid path and positioned above the internal rotational transition zones.

2. The laser bottom hole assembly of claim 1, comprising a means for maintaining a predetermined flow balance between the first and second flow paths over a predetermined range of conditions.

3. The laser bottom hole assembly of claim 2, wherein the means for maintaining a predetermined flow balance is positioned within the rotating section of the external rotating housing.

4. The laser bottom hole assembly of claim 2, wherein the means for maintaining a predetermined flow balance is positioned at least partially within the non-rotating section of the external rotating housing.

5. The laser bottom hole assembly of claim 2, wherein the predetermined flow balance between the first and second flow paths is between from about 70-50% in the first fluid path and from about 30-50% in the second fluid path.

6. The laser bottom hole assembly of claim 2, wherein the predetermined flow balance between the first and second flow paths is between from about 60-40% in the first fluid path and from about 40-60% in the second fluid path.

7. The laser bottom hole assembly of claim 1, wherein the means for separating the fluid flow and conveying the means for providing a laser beam is positioned within the rotating section of the external housing.

8. The laser bottom hole assembly of claim 1, wherein the means for separating the fluid flow and conveying the means for providing a laser beam is positioned at least partially within the non-rotating section of the external housing.

9. The laser bottom hole assembly of claim 1, comprising a first and a second means for transmitting a laser beam, wherein the first means for transmitting a laser beam is non-rotating and is positioned within the rotating section of the external housing and the second means for transmitting a laser beam is rotating and is positioned within the rotating section of the external housing.

10. The laser bottom hole assembly of claim 1, comprising a laser optic positioned in the internal rotational transition zone.

11. The laser bottom hole assembly of claim 1, comprising a rotating laser optic and a non-rotating laser optic positioned in the internal rotational transition zone.

12. The laser bottom hole assembly of claim 1, comprising a means for isolating the first fluid path from the second fluid path.

13. The laser bottom hole assembly of claim 1, comprising a means for preventing assembly material debris from entering the second fluid path during assembly and operation.

14. The laser bottom hole assembly of claim 1 comprising an upper section, a middle section and a lower section, wherein the opening of the opening end is located at an end of the upper section, the non-rotating screw member is located in the middle section, and the exhaust port is located in the middle section.

15. The laser bottom hole assembly of claim 1, comprising a non-rotating flex-shaft having a lower end attached to the non-rotating screw member.

16. The laser bottom hole assembly of claim 15, wherein at least a portion of the non-rotating flex-shaft is located within the rotating section of the external housing.

17. The laser bottom hole assembly of claim 15, comprising a non-rotating hollow flexible member having an upper end, the upper end attached to the non-rotating screw member.

18. The laser bottom hole assembly of claim 17, wherein the non-rotating hollow flexible member is located within the rotating section of the external housing.

19. The laser bottom hole assembly of claim 18, comprising a second means for separating the fluid flow and conveying the means for providing a laser beam that is in fluid communication with the second fluid path, whereby the second fluid path is separated into a third fluid path and a fourth fluid path.

20. A system for controlling multiple fluid flows and managing a high power laser fiber optic cable in a reverse Moineau motor laser mechanical bottom hole assembly comprising:

a. a flow diverter in fluid communication with a first, a second and a third fluid path, whereby the flow diverter is configured to divert a fluid flow from the first fluid path into the second and third fluid paths;

b. a high power laser fiber optic cable;

c. an isolated flow regulator in fluid communication with the third fluid path;

d. the high power laser fiber optic cable positioned within the flow regulator; and, e. a laser optic and the optic cable in association with the third fluid path.

21. A self-regulating system for controlling multiple fluid flows and managing a high power laser fiber optic cable in a reverse Moineau motor laser mechanical bottom hole assembly comprising:

a. a flow diverter in fluid communication with a first, a second and a third fluid path, whereby the flow diverter is configured to divert a fluid flow from the first fluid path into the second and third fluid paths;

b. a first check valve in fluid communication with the first and second fluid paths;

c. an isolated flow regulator in fluid communication with the third fluid path;

d. the second fluid path comprising a progressive cavity of a mud motor, the cavity comprising an external rotating gear member;
e. the third fluid path in fluid association with a laser optic;
f. the third fluid path in fluid association with a laser mechanical drill bit section, the drill bit section having a laser beam delivery channel;
g. an exhaust port in fluid communication with the second fluid path, whereby fluid flow through the second fluid path travels from the first flow diverter to the progressive cavity to the exhaust port; and,
h. the flow regulator configured to maintain a predetermined flow balance between the second and third flow paths over a predetermined range of conditions of the mud motor.

22. The self-regulating system of claim 21, wherein the laser beam delivery channel comprises a portion of the third fluid path.

23. The self-regulating system of claim 21, wherein the predetermined flow balance between the second and third flow paths is between from about 70-50% in the first fluid path and from about 30-50% in the second fluid path.

24. The self-regulating system of claim 21, wherein the predetermined flow balance between the second and third flow paths is between from about 60-40% in the first fluid path and from about 40-60% in the second fluid path.

25. The self-regulating system of claim 21, comprising:
a. a second flow diverter, the second flow diverter in fluid communication with the third fluid path and in fluid communication with a fourth and a fifth fluid path, whereby the second flow diverter is configured to divert a fluid flow from the third fluid path into the fourth and fifth fluid paths;
b. the laser beam delivery channel comprising a portion of the fourth fluid flow path;
c. a second exhaust port, the second exhaust port positioned in the drill bit section, the second exhaust port in fluid communication with the fifth flow path; and,
d. a second flow regulator configured to maintain a predetermined flow balance between the fourth and fifth flow paths over a predetermined range of conditions of the mud motor.

26. The self-regulating system of claim 25, wherein the laser beam delivery channel comprises a portion of the fourth fluid path.

27. The self-regulating system of claim 25, wherein the predetermined flow balance between the second and third flow path is between from about 70-50% in the first fluid path and about from 30-50% in the second fluid path.

28. The self-regulating system of claim 25, wherein the predetermined flow balance between the second and third flow path is between from about 60-40% in the first fluid path and about from 40-60% in the second fluid path.

29. The self-regulating system of claim 25, comprising a second check valve in fluid communication with the fourth flow path and a third check valve in fluid communication with the fifth flow path.

30. The self-regulating system of claim 21, comprising a high power laser fiber optic cable in association with the third fluid path.

31. The systems of claim 21, 25 or 20 wherein a fluid path is in communication with a lubrication source.

32. A laser bottom hole assembly comprising:
a. an upper section, a middle section, and a lower section;
b. the upper section comprising a non-rotating connector affixed to a non-rotating outer housing;
c. the middle section comprising a rotating outer housing and non-rotating inner components;
d. the lower section comprising a rotating external outer housing and a rotating connector for connecting to a bit or tool;
e. a flow separator in fluid communication with a first fluid path and a second fluid path;
f. a portion of the first and second fluid paths is positioned in the middle section;
g. a portion of the first fluid path is formed by the rotating outer housing and non-rotating inner components of the middle section;
h. a portion of the second fluid path is positioned within the non-rotating inner components of the middle section;
i. a portion of the second fluid path positioned in the lower section;
j. the first fluid path not entering the lower section; and,
k. the lower section comprising a means to deliver a laser beam.

33. A laser bottom hole assembly comprising:
a. an end having an opening for receiving a fluid flow and a means for providing a laser beam having at least 5 kW of power;
b. a means for separating the fluid flow that is in fluid communication with the fluid flow, a first fluid path and a second fluid path;
c. an external housing comprising a rotating section, a non-rotating section, and an external rotational transition zone, the rotating section of the external housing comprising rotating and non-rotating internal components;
d. a non-rotating screw member in driving relationship with a rotating gear member;
e. an internal rotational transition zone within the rotating section of the external housing, whereby a transition from the non-rotating internal components to the rotating internal components occurs; and,
f. a laser optic positioned in the internal rotational transition zone.

34. The laser bottom hole assembly of claim 33, comprising a first and a second means for transmitting a laser beam, wherein the first means for transmitting the laser beam is non-rotating and is positioned within the rotating section of the external housing and the second means for transmitting the laser beam is rotating and is positioned within the rotating section of the external housing.

35. The laser bottom hole assembly of claim 33, comprising a means for preventing assembly material debris from entering the second fluid path during assembly and operation.

36. A laser bottom hole assembly comprising:
a. a fluid flow separator in fluid communication with a first fluid path and a second fluid path;
b. an external housing comprising a rotating section, a non-rotating section, and an external rotational transition zone, the rotating section of the external housing comprising rotating and non-rotating internal components;
c. a non-rotating screw member in driving relationship with a rotating gear member;
d. a fiber optic cable within the non-rotating screw member;
e. an internal rotational transition zone within the rotating section of the external housing, whereby a transition from the non-rotating internal components to the rotating internal components occurs; and,
f. the fiber optic cable and a laser optic positioned in the internal rotational transition zone.

37. The laser bottom hole assembly of claim 36, comprising a first and a second means for transmitting a laser beam, wherein the first means for transmitting the laser beam is non-rotating and is positioned within the rotating section of the external housing and the second means for transmitting the laser beam is rotating and is positioned within the rotating section of the external housing.

38. The laser bottom hole assembly of claim 36, comprising a means for preventing assembly material debris from entering the second fluid path during assembly and operation.

39. The laser bottom hole assembly of claim 36, comprising an isolated flow regulator.

40. The laser bottom hole assembly of claim 36, comprising a means for preventing assembly material debris from entering the second fluid path during assembly and operation.

41. A laser bottom hole assembly comprising:

a. an external housing comprising a rotating section, a non-rotating section, and an external rotational transition zone, the rotating section of the external housing comprising rotating and non-rotating internal components;

b. a non-rotating screw member in driving relationship with a rotating gear member;

c. a fiber optic cable within the non-rotating screw member;

d. an internal rotational transition zone within the rotating section of the external housing, whereby a transition from the non-rotating internal components to the rotating internal components occurs; and, e. a means for aligning and restricting rotation of the internal components during assembly, the means for aligning and restricting rotation is positioned in the internal rotational transition zone.

42. The laser bottom hole assembly of claim 41, comprising a fluid path associated with a laser beam optic and a means for preventing assembly material debris from entering the fluid path during assembly and operation.

43. The laser bottom hole assemblies of claim 1, 36, 39, or 20 wherein a fluid path is in communication with a lubrication source.

44. The laser bottom hole assembly of claim 43, comprising a first and a second means for transmitting a laser beam, wherein the first means for transmitting the laser beam is non-rotating and is positioned within a rotating section of an external housing and the second means for transmitting the laser beam is rotating and is positioned within the rotating section of the external housing.

45. The laser bottom hole assembly of claim 43, comprising a means for preventing assembly material debris from entering the third fluid path during assembly and operation.

46. A system for managing a high power laser fiber optic cable in a reverse Moineau motor laser mechanical bottom hole assembly comprising:

a. an external housing comprising a rotating section, a non-rotating section, and an external rotational transition zone, the rotating section of the external housing comprising rotating and non-rotating internal components;

b. a non-rotating screw member in driving relationship with a rotating gear member;

c. a high power laser fiber optic cable, the fiber optic cable positioned in the external housing and having a path within the external housing;

d. the rotating external housing section having a first centerline;

e. the non-rotating screw member having a second centerline that is parallel to and non-coaxial with the first centerline;

f. the fiber optic cable positioned within the non-rotating screw member and along the second centerline; and, g. the fiber optic cable positioned along the first centerline;

h. whereby the path of the fiber optic cable through the laser bottom hole assembly moves from second centerline to first centerline.

47. The system of claim 46, wherein a portion of the path of the high power laser fiber optic cable moves form the first centerline to the second centerline.

48. The system of claim 46, wherein the path of the high power laser fiber optic cable comprises a helix having a third centerline.

49. The system of claim 46, wherein a portion of the third centerline is substantially coaxial with a portion of the second centerline.

50. The system of claim 46, wherein a portion of the third centerline is substantially coaxial with a portion of the second centerline.

51. The system of claim 46, where in a portion of the third centerline is substantially coaxial with a portion of the first centerline.

52. The system of claim 46, wherein the path of the high power laser fiber optic cable path comprises a sinusoidal section, the sinusoidal section having a third centerline and a portion of the sinusoidal centerline being substantially coaxial with a portion of the second centerline.

53. A bottom hole drilling assembly comprising a drilling motor assembly, laser beam conveyance means, and an optical assembly;

a. the drilling motor assembly comprising i. upper connection means for connection to a drill string, said upper means for connection to a drill string is rotationally fixed with respect to the drill string, ii. an internal assembly comprising a mandrel, an upper flex shaft, a hollow screw shaft, and a lower flex shaft, said internal assembly rotationally fixed with respect to said upper means for connection to a drill string, iii. an external motor body disposed around, and rotatably mounted upon and with respect to, the internal assembly, iv. a bearing assembly disposed between the internal assembly and the external motor body, and transmitting thrust and radial loads between said internal assembly and the external motor body, v. the hollow screw shaft disposed upon, and rotationally fixed with respect to, the upper flex shaft, vi. the lower flex shaft is positioned below, and disposed upon, and rotationally fixed with respect to, the hollow screw shaft, and vii. a helical progressive cavity gear member disposed in the external motor body, and around the hollow screw shaft, and capable of generating rotational movement of the external body with respect to the internal assembly when drilling fluid is forced through the drilling motor assembly;

b. the laser beam conveyance means comprises a fiber optic cable that passes through and is rotationally fixed with respect to the drilling motor internal assembly; and, c. the optical assembly comprising i. an upper portion disposed upon, and rotationally fixed to, the drilling motor internal assembly, and optically connected to the laser beam conveyance means, and ii. a lower portion disposed within, and rotationally fixed to, the external motor body.

* * * * *